US012371901B2

(12) United States Patent
Goosen et al.

(10) Patent No.: US 12,371,901 B2
(45) Date of Patent: Jul. 29, 2025

(54) FURNITURE SYSTEM

(71) Applicant: Steelcase Inc., Grand Rapids, MI (US)

(72) Inventors: Gregory Goosen, Grand Rapids, MI (US); David Eberlein, Hudsonville, MI (US); William Patrick Fricke, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 378 days.

(21) Appl. No.: 17/660,752

(22) Filed: Apr. 26, 2022

(65) Prior Publication Data

US 2022/0251830 A1 Aug. 11, 2022

Related U.S. Application Data

(63) Continuation of application No. 17/125,440, filed on Dec. 17, 2020, now Pat. No. 12,203,267.

(60) Provisional application No. 62/952,918, filed on Dec. 23, 2019.

(51) Int. Cl.
*E04B 2/74* (2006.01)
*A47B 85/04* (2006.01)

(52) U.S. Cl.
CPC ..... *E04B 2/7405* (2013.01); *A47B 85/04* (2013.01); *A47B 2200/12* (2013.01); *A47B 2220/0091* (2013.01)

(58) Field of Classification Search
CPC ..... A47B 57/40; A47B 57/50; A47B 57/402; A47B 96/1441; A47B 47/021; A47B 85/04; A47B 2200/12; A47B 2220/0091; F16B 2200/205; F16B 21/09; E04B 2/7405
See application file for complete search history.

(56) References Cited

U.S. PATENT DOCUMENTS

| | | | | | |
|---|---|---|---|---|---|
| 918,039 | A | * | 4/1909 | Grundmann | |
| 1,366,743 | A | * | 1/1921 | O'Connor | A47B 47/021 108/107 |
| 1,401,041 | A | * | 12/1921 | Chipperfield | A47B 47/03 312/257.1 |
| 2,855,255 | A | | 10/1958 | Sonderstrup | |
| 2,930,638 | A | | 3/1960 | Morrissey | |
| 3,144,265 | A | | 8/1964 | Francis | |

(Continued)

FOREIGN PATENT DOCUMENTS

| | | | |
|---|---|---|---|
| AU | 429630 | B2 | 10/1972 |
| DE | 2161889 | A1 | 6/1973 |

(Continued)

*Primary Examiner* — Brian E Glessner
*Assistant Examiner* — Daniel J Kenny
(74) *Attorney, Agent, or Firm* — Price Heneveld LLP

(57) ABSTRACT

A furniture system includes vertical and horizontal frame members, and a connection assembly that includes a T-shaped slot located within the vertical frame member, a T-shaped tab extending from the horizontal frame member and configured to engage the at least one T-shaped slot, at least one locking slot located within the vertical frame member, a locking member configured to engage the locking slot, and a fastener configured such that when the fastener is secured to the locking member the T-shaped tab is driven into engagement with the T-shaped slot and the horizontal frame member is pulled toward the vertical member so as to connect the horizontal frame member to the vertical frame member.

27 Claims, 36 Drawing Sheets

(56) References Cited

U.S. PATENT DOCUMENTS

| | | | | |
|---|---|---|---|---|
| 3,286,416 | A * | 11/1966 | Ashworth | E04H 12/2215 52/153 |
| 3,338,602 | A | 8/1967 | Arnd | |
| 3,353,853 | A | 11/1967 | Heywood | |
| 3,556,569 | A | 1/1971 | Bruhn | |
| 3,574,367 | A | 4/1971 | Jankowski | |
| 3,603,628 | A | 9/1971 | Smith et al. | |
| 3,736,009 | A | 5/1973 | Juhnke | |
| 3,797,948 | A | 3/1974 | Weininger | |
| 3,804,542 | A | 4/1974 | Hammerschmidt | |
| 3,811,785 | A | 5/1974 | Hagglund | |
| 4,148,106 | A | 4/1979 | Gallien | |
| 4,338,990 | A | 7/1982 | Blodee et al. | |
| 4,360,286 | A | 11/1982 | Beer | |
| 4,382,518 | A * | 5/1983 | Bondoux | A47B 57/50 248/222.41 |
| 4,391,545 | A | 7/1983 | Zummer | |
| 4,415,292 | A | 11/1983 | Alperson | |
| 4,431,331 | A | 2/1984 | Brody | |
| 4,549,832 | A | 10/1985 | Sterl | |
| 4,556,337 | A | 12/1985 | Marshall | |
| 4,572,694 | A | 2/1986 | Hoeksema | |
| 4,574,552 | A | 3/1986 | Korth | |
| 4,799,819 | A | 1/1989 | Swoboda | |
| 4,867,596 | A | 9/1989 | Ocuin | |
| 4,907,388 | A | 3/1990 | Siahatgar | |
| 4,923,322 | A | 5/1990 | Burg | |
| 5,052,565 | A | 10/1991 | Zachrei | |
| 5,309,686 | A | 5/1994 | Underwood et al. | |
| 5,509,361 | A | 4/1996 | Chen | |
| 5,657,604 | A | 8/1997 | Malott | |
| 5,802,789 | A | 9/1998 | Goodman et al. | |
| 5,820,289 | A | 10/1998 | Kern et al. | |
| 5,899,035 | A | 5/1999 | Waalkes et al. | |
| 6,106,183 | A | 8/2000 | Marcel et al. | |
| 6,173,545 | B1 | 1/2001 | Feldpausch et al. | |
| 6,402,420 | B1 | 6/2002 | Yang | |
| 6,442,805 | B2 | 9/2002 | Pfister | |
| 6,848,230 | B2 | 2/2005 | Kopish | |
| 7,565,772 | B2 | 7/2009 | Hand et al. | |
| 8,631,965 | B2 | 1/2014 | Leasure | |
| 8,702,053 | B2 * | 4/2014 | Line | B60N 2/0732 248/424 |
| 9,441,657 | B2 | 9/2016 | Hooper et al. | |
| 9,476,441 | B2 | 10/2016 | Strassle et al. | |
| 9,638,229 | B2 | 5/2017 | Gamain | |
| 9,814,310 | B2 | 11/2017 | Kassanoff et al. | |
| 10,034,545 | B2 | 7/2018 | Pensi | |
| 10,036,156 | B1 | 7/2018 | Macdonald et al. | |
| 10,143,298 | B2 | 12/2018 | Wood | |
| 10,299,588 | B1 | 5/2019 | Lai et al. | |
| 11,415,159 | B2 * | 8/2022 | Ronda | A47B 96/1433 |
| 11,478,080 | B2 * | 10/2022 | Briosi | F16B 12/32 |
| 11,608,626 | B2 * | 3/2023 | Kim | E04B 1/2403 |
| 2002/0023391 | A1 | 2/2002 | Nymark | |
| 2005/0127802 | A1 | 6/2005 | Chen | |
| 2008/0169667 | A1 * | 7/2008 | Siniarski | B60R 7/082 296/37.8 |
| 2013/0121760 | A1 | 5/2013 | Chen et al. | |
| 2015/0060321 | A1 | 3/2015 | Wang | |

FOREIGN PATENT DOCUMENTS

| | | | |
|---|---|---|---|
| DE | 19845138 | C1 | 1/2000 |
| DE | 20112397 | U1 | 12/2001 |
| EP | 1154167 | A1 | 11/2001 |
| EP | 1211428 | A1 | 6/2002 |
| EP | 1530922 | A1 | 5/2005 |
| FR | 1478394 | A | 4/1967 |
| FR | 2297020 | B1 | 1/1979 |
| GB | 683386 | A | 11/1952 |
| GB | 846790 | A | 8/1960 |
| GB | 2006379 | A | 5/1979 |
| JP | 08238131 | A | 9/1996 |
| JP | 2001116026 | A | 4/2001 |
| JP | 2017051401 | A | 3/2017 |
| JP | 2019084006 | A | 6/2019 |
| JP | 6680491 | B2 | 4/2020 |
| KR | 101900162 | B1 | 9/2018 |
| WO | 9641960 | A1 | 12/1996 |
| WO | 2019146979 | A1 | 8/2019 |

* cited by examiner

FURNITURE SYSTEM

CROSS-REFERENCE TO RELATED APPLICATIONS

This application is a continuation of U.S. patent application Ser. No. 17/125,440, filed Dec. 17, 2020, entitled "FURNITURE SYSTEM," which claims priority to U.S. Provisional Patent Application No. 62/952,918, filed on Dec. 23, 2019, entitled "FURNITURE SYSTEM," the entire disclosures of which are incorporated herein by reference.

BACKGROUND

The various embodiments as disclosed herein relate to interconnecting and alternatively configurable furniture systems that cooperate to provide an overall furniture arrangement that allows easy reconfiguration to optimize effective utilization of and management of utilities within a given workspace area.

BRIEF SUMMARY

The furniture system as described herein may include a pair of beam members each having a bottom wall and a pair of side walls that cooperate to define a longitudinally-extending channel configured to route wires therethrough, the beam members each having a first end and a second end, each end including a flange, a leg including a first end configured to abut a floor surface, and a second end, and a mechanical fastener extending through the flange of the first end of one of the beam members, through the second end of the leg, and through the flange of the second end of the other of the beam members.

The furniture system may additionally or alternatively include a beam member including a bottom wall and side walls that cooperate to define a channel configured for routing wires therethrough, the beam member further including a first end and a second end each including a first connection arrangement, and a housing assembly including a top wall, a pair of end walls and a front wall and/or a rear wall that cooperate to define an interior storage space, wherein the beam member is located within the interior storage space, and wherein each of the end walls includes a second connection arrangement that is substantially identical to the first connection arrangement and that is connected to one of the first connection arrangements.

The furniture system may also additionally or alternatively include a furniture member including at least one slot, the furniture member having a first portion defining a first width of the at least one slot and second portion defining a second width of the at least one slot, the second width greater than the first width, a pair of support members each having a pair of recesses, each support member rotatable between a first position where the support member may be inserted into or removed from the at least one slot, and a second position where the recesses of the support member engage the first portion of the furniture member preventing removal of the support member from the at least one slot, and a screen member engaging each of the support members thereby preventing the support members from rotating from the second position to the first position.

The furniture system may also additionally or alternatively include a furniture member including a longitudinally-extending slot, the furniture member having a first portion defining a first width of the slot and second portion defining a second width of the slot, the second width greater than the first width, a pair of support members each having a pair of recesses and an upwardly-opening relief, each support member rotatable between a first position where the support member may be inserted into or removed from the slot, and a second position where the recesses of the support member engage the first portion of the furniture member preventing removal of the support member from the slot, and a screen member engaging the relief of each of the support members thereby preventing each of the support members from rotating from the second position to the first position.

The furniture system may also additionally or alternatively include a furniture member including a longitudinally-extending slot, the furniture member having a first portion defining a first width of the slot and second portion defining a second width of the slot, the second width greater than the first width, a pair of support members each having a pair of recesses, each support member rotatable between a first position where the support member may be inserted into or removed from the slot, and a second position where the recesses of the support member engage the first portion of the furniture member preventing removal of the support member from the slot, and a screen member sandwiched between and connected to the pair of support members thereby preventing the support members from rotating from the second position to the first position.

The furniture system may also additionally or alternatively include a furniture member, a pair of end supports supporting the furniture member above a floor surface, a support assembly coupled with the furniture member, and a screen member engaging the support member, wherein a first portion of the screen member extends directly above the furniture member and a second portion of the screen member abuts a floor surface.

The furniture system may also additionally or alternatively include a furniture member including a longitudinally-extending slot configured for routing wires therethrough, a first end and a second end, a pair of support members each engaging the slot, and a screen member frictionally engaging each of the support members and movable between an extended position where the screen member extends beyond one of the ends of the furniture member, and a retracted position where the screen member does not extend beyond the one end of the furniture member.

The furniture system may also additionally or alternatively include a frame assembly, including a plurality of vertical frame members, a plurality of laterally-extending horizontal frame members extending between the vertical frame members, and a plurality of longitudinally-extending horizontal frame members extending between the vertical frame members, each of the plurality of longitudinally-extending horizontal frame members having a first length, the frame members cooperating to define an interior space. The embodiment further includes a beam member located in the interior space and having a longitudinally-extending channel configured to route wires therethrough, the beam member having a first end and a second end each coupled to the vertical frame members, the beam member having a second length that is substantially similar to the first length.

The furniture system may also additionally or alternatively include a plurality of vertical frame members, a plurality of horizontal frame members extending between the vertical frame members, wherein the frame members cooperate to define an interior storage space, and a connection arrangement connecting at least one of the horizontal frame members of the plurality of horizontal frame members to at least one of the vertical frame members of the plurality of vertical frame members. The connection arrangement includes a receiving slot and a locking slot located in the at least one vertical frame member, the receiving slot including a first portion having a first width and a second portion having a second width that is less than the first width, a tab extending from the at least one horizontal frame member, the tab having a first portion having a first width and a second portion having a second width that is less than the first width of the first portion of the tab, a locking member received within the at least one horizontal frame member and having an engagement portion configured to be received within the locking slot, the locking member movable between a locked position wherein the engagement portion is located a first distance from the tab and an unlocked position where the engagement portion is located at a second distance from the tab that is less than the first distance, and an actuator engagable with the horizontal frame member and the locking member. The tab is configured to be positioned within the receiving slot such that the second portion of the tab is vertically aligned with the second portion of the locking slot, thereby preventing disengagement of the tab from within the receiving slot in a horizontal direction, and wherein the actuator engages the horizontal frame member and the locking member, thereby moving the locking member from the unlocked to the locked position and preventing the locking member from moving in a horizontal direction with respect to the horizontal frame member.

The furniture system may also additionally or alternatively include a plurality of vertical and horizontal frame members adapted to interconnect and form a furniture element, and a connection assembly configured to couple at least one horizontal frame member of the plurality of horizontal frame members to at least one vertical frame member of the plurality of vertical frame members. The connection assembly includes at least one T-shaped slot located within the at least one vertical frame member, at least one T-shaped tab extending from the end of the at least one horizontal frame member and configured to engage the at least one T-shaped slot, at least one locking slot located within the at least one vertical frame member, a locking member configured to engage the locking slot, and a fastener configured such that when the fastener is secured to the locking member the T-shaped tab is driven into engagement with the T-shaped slot and the at least one horizontal frame member is pulled toward the at least one vertical member so as to connect the at least one horizontal frame member to the at least one vertical frame member.

The furniture system may also additionally or alternatively include a plurality of vertical and horizontal frame members adapted to interconnect and form a furniture element, and a connection assembly configured to couple at least one horizontal frame member of the plurality of horizontal frame members to at least one vertical frame member of the plurality of vertical frame members. The connection assembly may include at least one aperture located within the at least one vertical frame member and including a T-shaped first portion and a second portion, at least one T-shaped tab extending from the at least one horizontal frame member and configured to engage the T-shaped first portion of the at least one aperture, a locking member configured to engage the second portion of the at least one aperture, and a fastener configured such that when the fastener is secured to the locking member the T-shaped tab is driven into engagement with the T-shaped first portion of the at least one aperture and the at least one horizontal frame member is pulled toward the at least one vertical member so as to connect the at least one horizontal frame member to the at least one vertical frame member.

The furniture system may also additionally or alternatively include a furniture member including a bottom wall and a pair of side walls that cooperate to define a channel configured to route a plurality of wires therethrough, and an electrical power block located at least partially within the channel, wherein a portion of at least one of the walls is movable between a first position where the portion is substantially planar with the at least one of the walls, and a second position where the portion extends into the channel and is not planar with the at least one of the walls, and wherein the electrical power block is supported by the portion.

The furniture system may also additionally or alternatively include a furniture member including a bottom wall and a pair of side walls that cooperate to define a channel configured to route a plurality of wires therethrough, and a divider member dividing the channel into a first section and a second section thereby allowing the separation of at least one wire of the plurality of wires located in the first section from at least one other wire of the plurality of wires located in the second section, wherein a portion of at least one of the bottom wall and the side walls is movable between a first position where the portion is substantially planar with the at least one of the walls, and a second position where the portion extends into the channel and is not planar with the at least one of the walls, and wherein the divider is supported by the portion.

The furniture system may also additionally or alternatively include an elongated furniture member including a bottom wall and a pair of side walls that cooperate to define a longitudinally-extending channel configured to route wires therethrough, a first support having an upper end attached to the furniture member along a length of the beam member, and a second end including a friction reduction member abutting a floor surface, and a second support member having an upper end attached to the furniture member along the length of the furniture member, and a lower end configured to move between an in-use position where the lower end of the second support member frictionally engages the floor surface and inhibits horizontal movement of the furniture member relative to the floor surface, and a moving position where the lower end of the second support is spaced from the floor surface and the friction reduction member facilitates horizontal movement of the furniture member relative to the floor surface.

The furniture system may also additionally or alternatively include an elongated furniture member, a support assembly configured to engage the furniture member, and a work accessory supported by the support assembly, where the work accessory includes at least a select one of a privacy panel, an elevated storage assembly and a seat assembly. The furniture system further includes a first support having an upper end attached to the furniture member along a length of the furniture member, and a second end including a friction reduction member abutting a floor surface, and a second support member having an upper end attached to the beam member along the length of the furniture member, and a lower end configured to move between an in-use position where the lower end of the second support member frictionally engages the floor surface and inhibits horizontal movement of the furniture member relative to the floor surface, and a moving position where the lower end of the second support is spaced from the floor surface and the friction reduction member facilitates horizontal movement of the furniture member relative to the floor surface.

The furniture system may also additionally or alternatively include a storage assembly defining an interior storage space, a first screen assembly that includes a first support bracket attached to the storage assembly, and a first screen member releasably supported by the first support bracket such that the first screen member is substantially vertically oriented, and a second screen assembly that includes a second support bracket attached to the storage assembly, and a second screen member releasably supported by the second support bracket such that the second screen member is substantially vertically oriented and at least partially overlaps with the first screen member to define a gap therebetween configured to route wires therein, wherein the gap between the first and second screen members is at least partially located within the interior space of the storage assembly.

The furniture system may also additionally or alternatively include a beam member including a bottom wall, a pair of side walls extending upwardly from the bottom wall, and a pair of top walls extending inwardly from the side walls, wherein the walls cooperate to define a longitudinally-extending channel configured to route wires therethrough, a work accessory including at least one of a worksurface, a seat and a storage assembly, and a clamp assembly including a first clamp member attached to the work accessory and a second clamp member, wherein a portion of the beam member is clamped between the first clamp member and the second clamp member to support the work accessory from the furniture member.

The furniture system may also additionally or alternatively include a plurality of beam members each including a longitudinal axis and a longitudinally-extending channel configured to route wires therethrough, and a leg assembly including a plurality of substantially identical leg plate members each configured to abut a floor surface and that cooperate to define a hollow passage configured to route the wires therethrough and into the channels of the plurality of beam members, wherein each beam member is supported above a floor surface by a corresponding one of the leg plate members, and wherein an angle between the longitudinal axis of the two of the beam members of the plurality of beam members is 360° divided by the number of leg plate members.

The embodiments of the various furniture assemblies cooperate to provide an overall furniture arrangement that is easily reconfigurable to effectively and efficiently optimize the utilization of a given office workspace area. The furniture assemblies share common connection arrangements to allow significant flexibility when combining the various furniture assemblies with one another, and are configured to allow easy horizontal and/or vertical routing of wires such as communication lines and electrical lines therethrough to provide necessary communication and electrical user interfacing through the furniture arrangement. The various furniture assemblies of the furniture arrangement can be easily and quickly assembled and reconfigured, are efficient for effectively optimizing the given office workspace area, may be assembled with common, non-specialized tools by unskilled personnel, and are particularly well adapted for the proposed use.

These and other features, advantages, and objects of the embodiments disclosed herein will be further understood and appreciated by those skilled in the art by reference to the following specification, claims, and appended drawings.

BRIEF DESCRIPTION OF THE DRAWINGS

FIG. 1B is a perspective view of the plurality of furniture systems of FIG. 1A with certain components removed to show supporting beam arrangements;

DETAILED DESCRIPTION

Figure 1A:
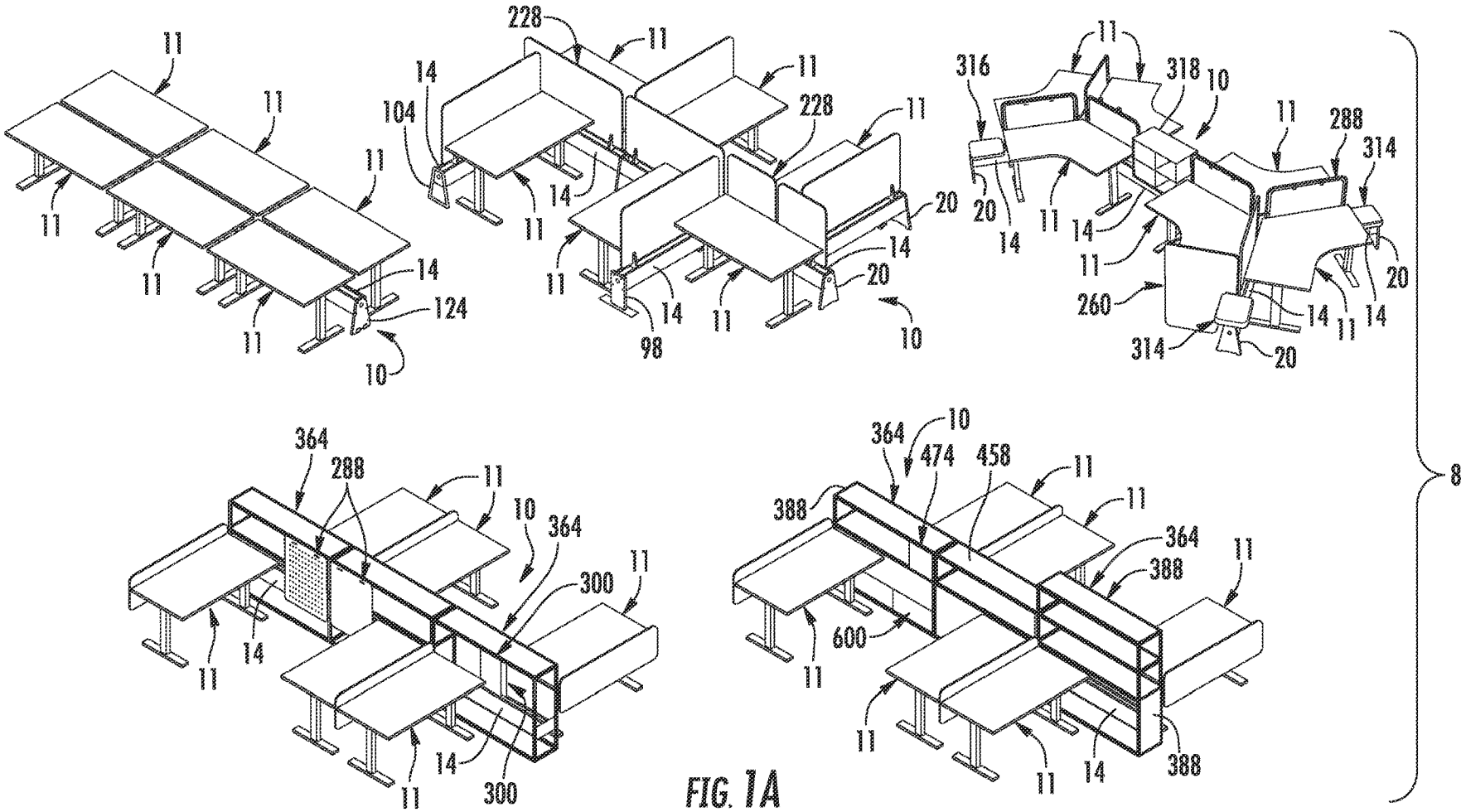
FIG. 1A is a perspective view of a plurality of variously configured furniture systems adapted to cooperate to form an overall furniture arrangement to subdivide an office floor space and route utilities therethrough.
Figure 7B:
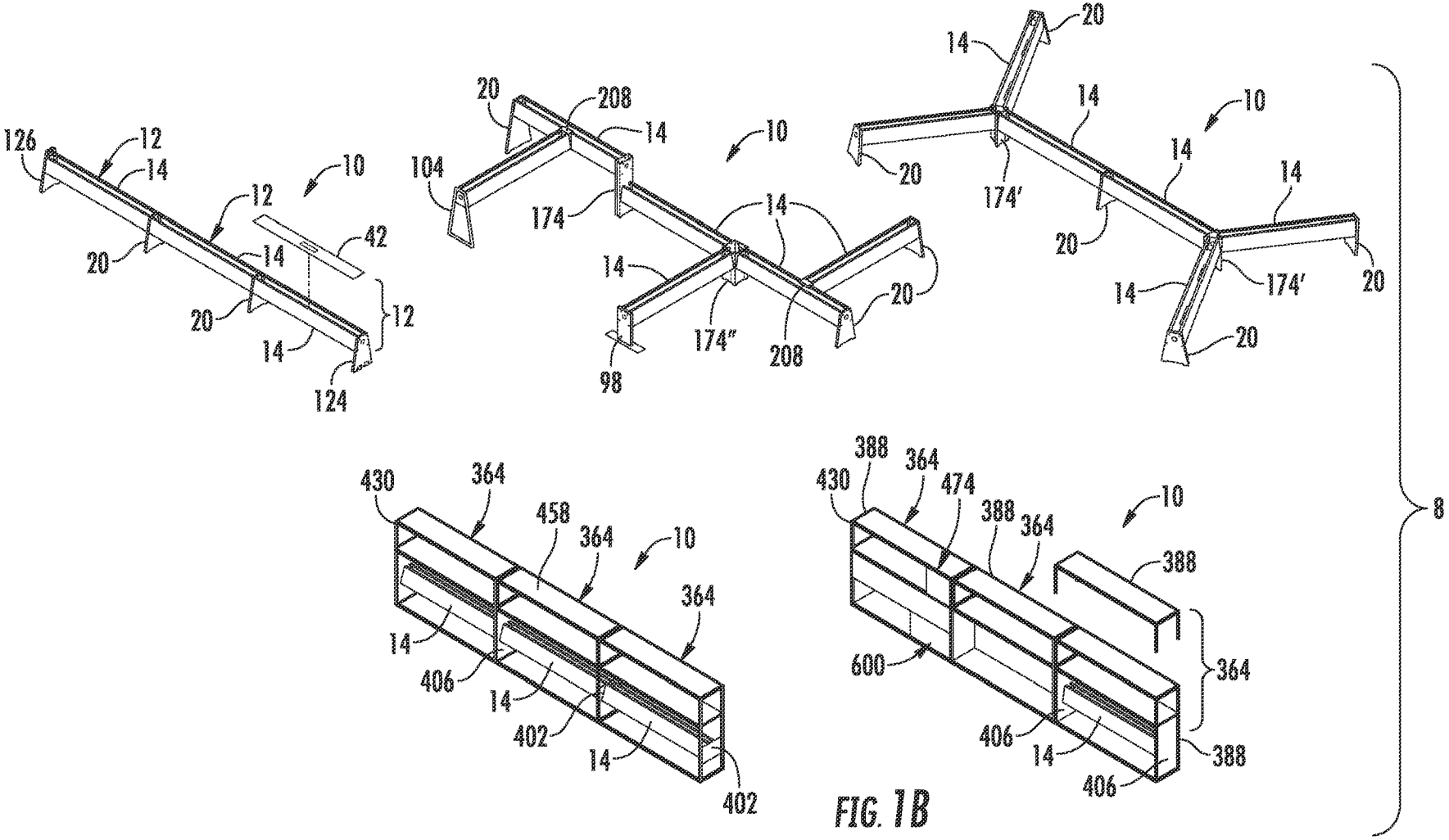
FIG. 7 is a cross-sectional end view of the beam member with another alternative cross-sectional configuration.
Figure 2:
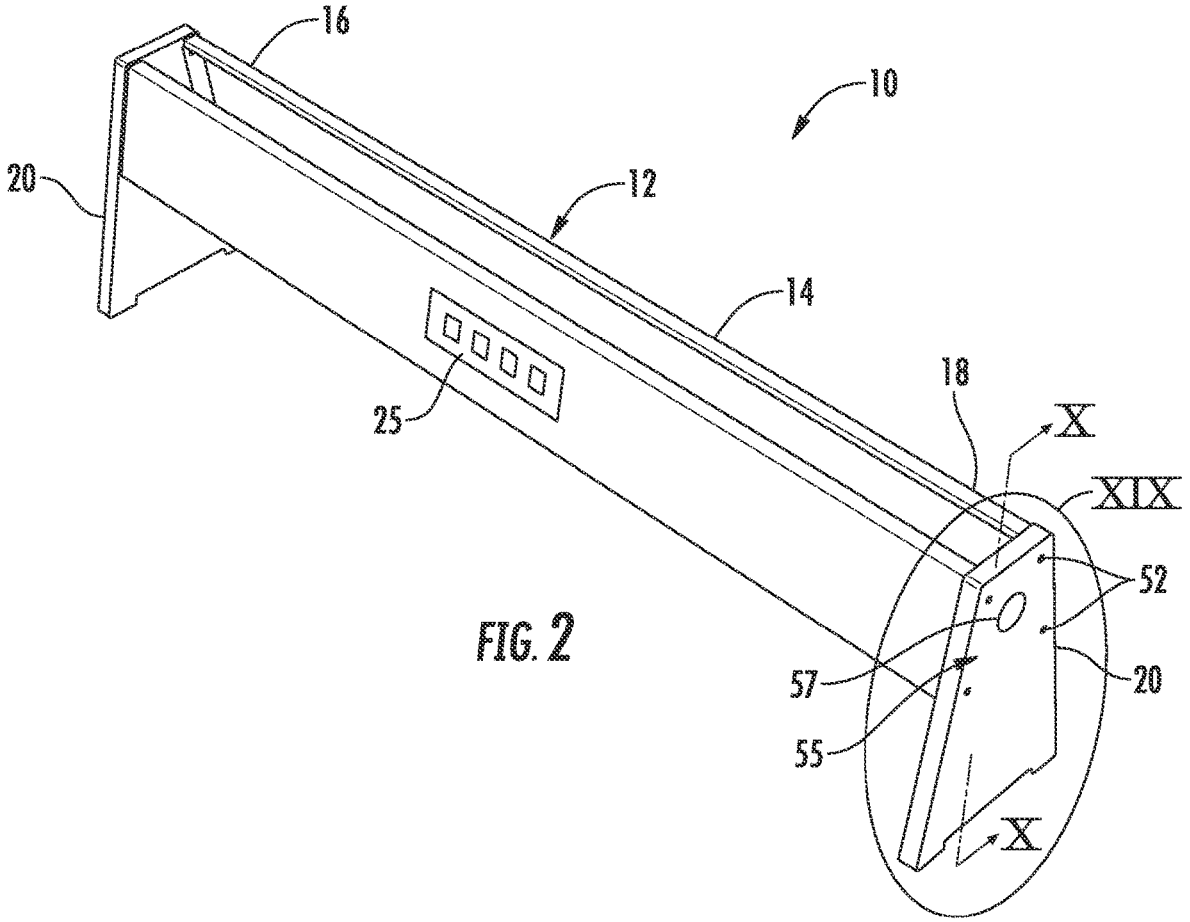
FIG. 2 is a perspective view of a furniture system that includes a beam arrangement.

For purposes of description herein, the terms "upper," "lower," "right," "left," "rear," "front," "vertical," "horizontal," and derivatives thereof shall relate to the invention as oriented in FIGS. 1 and 2. However, it is to be understood that the furniture systems as disclosed herein may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise. Further, similar features, elements and components identified by reference characters used herein will apply to those features, elements and components identified by variations of those reference characters unless explicitly stated otherwise herein.

FIGS. 1A and 1B illustrate an overall furniture arrangement 8 that includes a variously configured furniture system adapted to divide a given office workspace area. As described further herein, the furniture systems 10 may include variously configured beam arrangements, storage assemblies, table assemblies, seating arrangements and the like. The furniture systems 10 may be configured to provide horizontal and/or vertical routing of wires such as communication lines and electrical wires therethrough and therebetween. Further, the furniture systems 10 may be configured to couple to one another via substantially identical coupling arrangements, may be configured to alternatively support various work accessories such as seating arrangements, worksurface arrangements and storage arrangements therefrom via a common platform, and may be configured to intermix the components of variously configured furniture systems with one another, thereby providing a significantly flexible overall furniture arrangement that allows easy reconfiguration to efficiently and effectively optimize the utilization of the workspace area. In the examples illustrated in FIGS. 1A and 1B, various configurations of 6-user furniture systems 10 are utilized to provide the overall furniture arrangement 8. The variously configured furniture systems 10 may be utilized with worksurface assemblies, work stations, and/or table assemblies 11 spaced within and about the furniture systems 10. Of course, the furniture systems 10 may be configured to effectively organize an overall furniture arrangement 8 for more or less users. FIG. 1A illustrates the variously configured furniture systems 10 supporting various components of the furniture arrangement 8, while FIG. 1B illustrates the furniture systems of FIG. 1A with certain components of the furniture arrangement removed.

Figure 3:
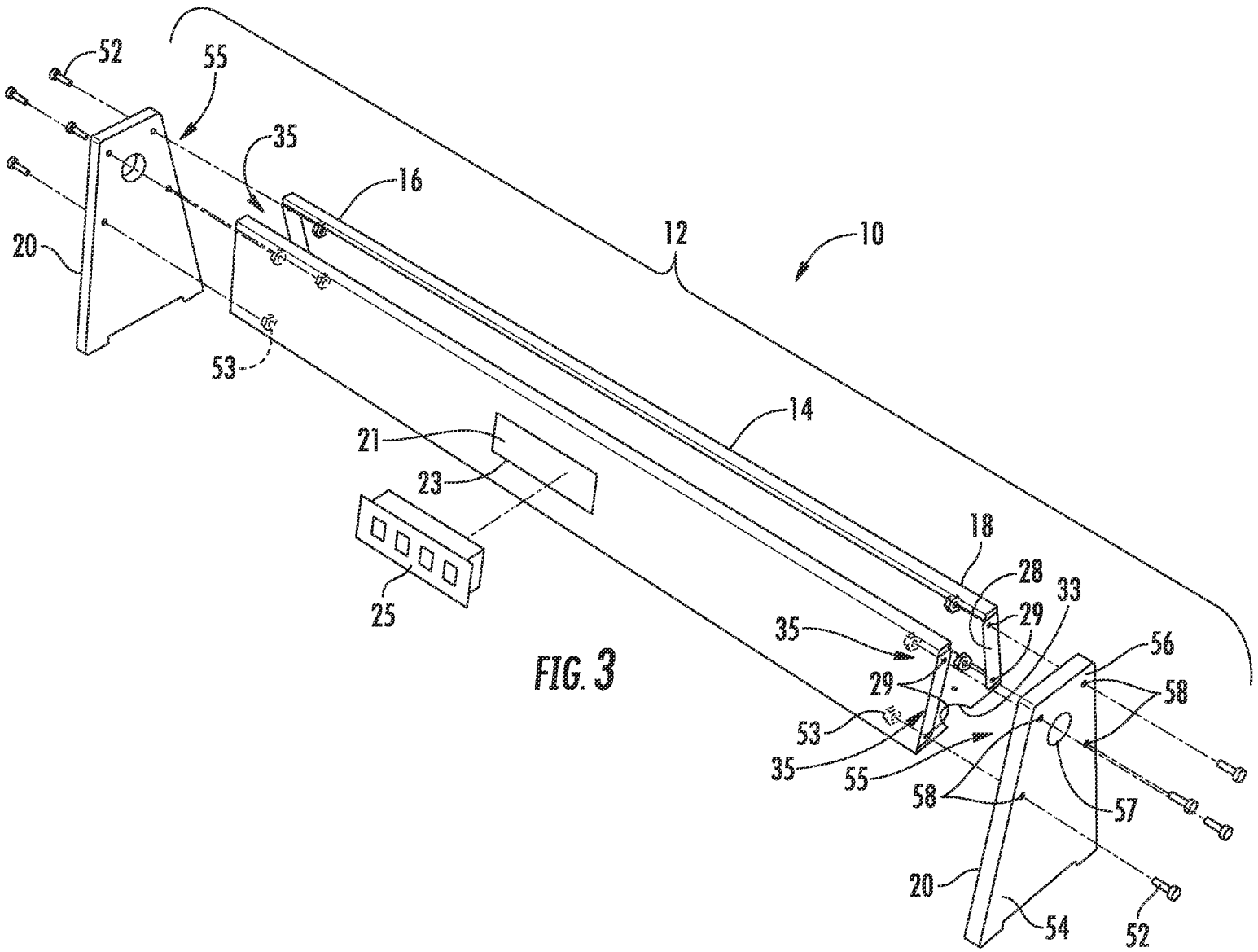
FIG. 3 is an exploded perspective view of the beam arrangement of FIG. 2.
Figure 4:
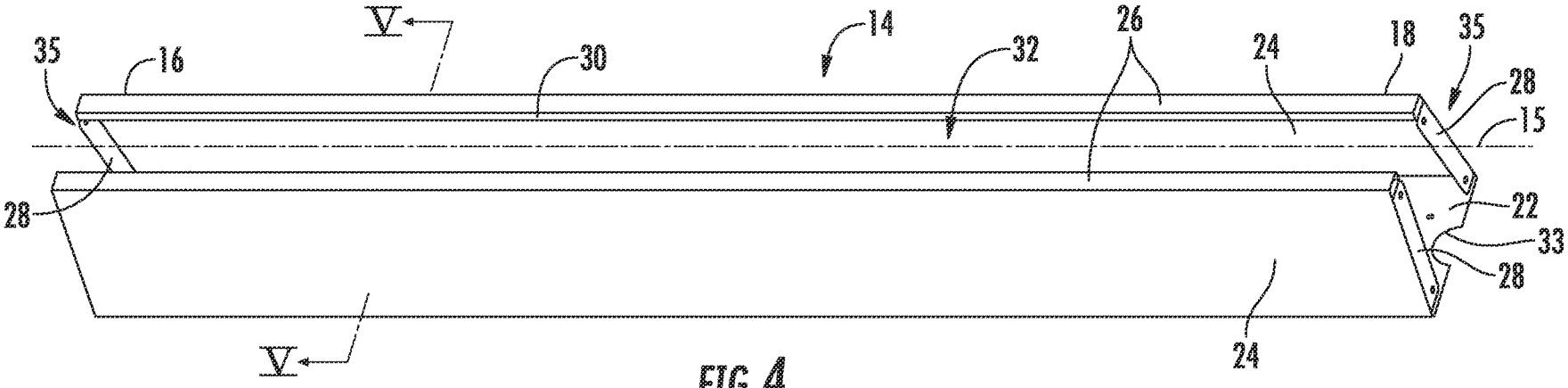
FIG. 4 is a perspective view of a beam member.
Figure 7:
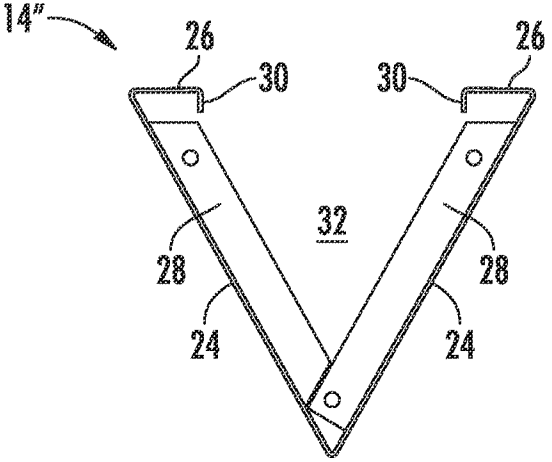
Figure 6:
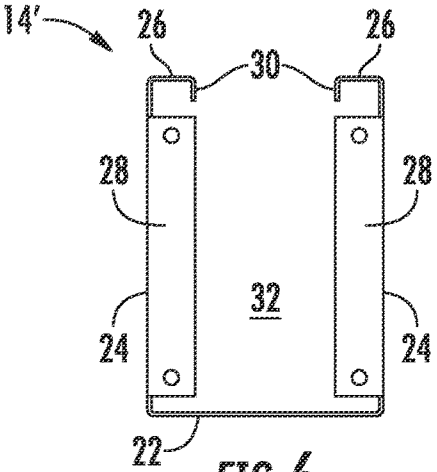
FIG. 6 is a cross-sectional end view of the beam member with an alternative cross-sectional configuration.
Figure 5:
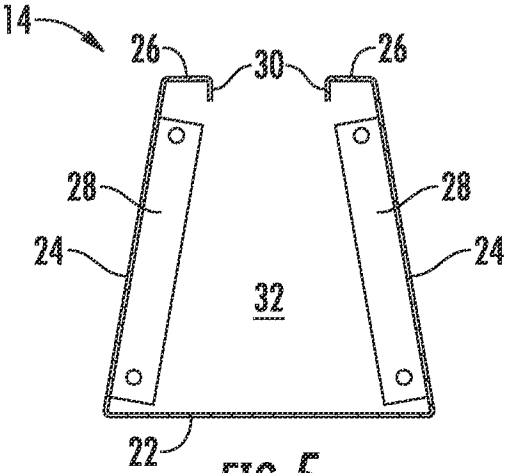
FIG. 5 is a cross-sectional end view of the beam member taken along the line V-V, FIG. 4.

As best illustrated in FIGS. 2-4, the furniture system 10 may include a beam arrangement 12 that includes a beam member 14 having a first end 16, a second end 18 and a longitudinal axis 15 extending therebetween, where each end 16, 18 is supported by a leg 20. The beam member 14 (FIGS. 4 and 5) includes a bottom wall 22, a pair of side walls 24 extending upwardly from the bottom wall 22, a pair of top walls 26 extending inwardly from the side walls 24 and substantially parallel with the bottom wall 22, and flanges 28 extending inwardly from the side walls 24 at each end 16, 18 of the beam member 14. Each top wall 26 may include a downwardly-extending flange 30. The beam member 14 may be constructed of a metal, such as steel, and may be formed from a single piece, such that the bottom wall 22, the side walls 24, the top walls 26, the flanges 28 and/or the flanges 30 form an integral, homogeneous, single-piece with one another. In one example, the beam member 14 is formed from a flat sheet of steel. As illustrated in FIGS. 5-7, the beam member 14 may be provided with various cross-sectional configurations, including a beam member 14 having an isosceles trapezoidal-shaped cross-sectional configuration as shown in FIG. 5, a beam member 14' having a rectangularly-shaped cross-sectional configuration as shown in FIG. 6, and a beam member 14" having a V-shaped cross-sectional configuration as shown in FIG. 7. The bottom wall 22, the side walls 24 and the top walls 26 cooperate to define a longitudinally-extending channel or slot 32 configured to receive and route wires such as communication lines and electrical wires therethrough. The bottom wall 22 may be provided with a recess or notch 33 at each end 16, 18 of the beam member 14 to allow for the routing of the wires outside the beam member 14 without passing through the leg 20. The notch 33 is particularly useful when the leg 20 is positioned at an end of a run of beam members 14 that includes a solid end closure of the channel 32. The beam members 14 within the various configurations of the furniture system 10 disclosed herein may include side walls 24 each including a punch-out 21 that may be removed to create an aperture 23 configured to receive a power/data outlet assembly 25 therein where the power/data outlet assembly 25 may include electrical outlets such as NEMA outlets and/or data outlets. Each end 16, 18 of the beam member 14 may also include a first connection arrangement 35 which includes a plurality of apertures 29 extending through the pair of flanges 28 located at each end 16, 18 of the beam member 14 and cooperating to define a first pattern.

Figure 8:
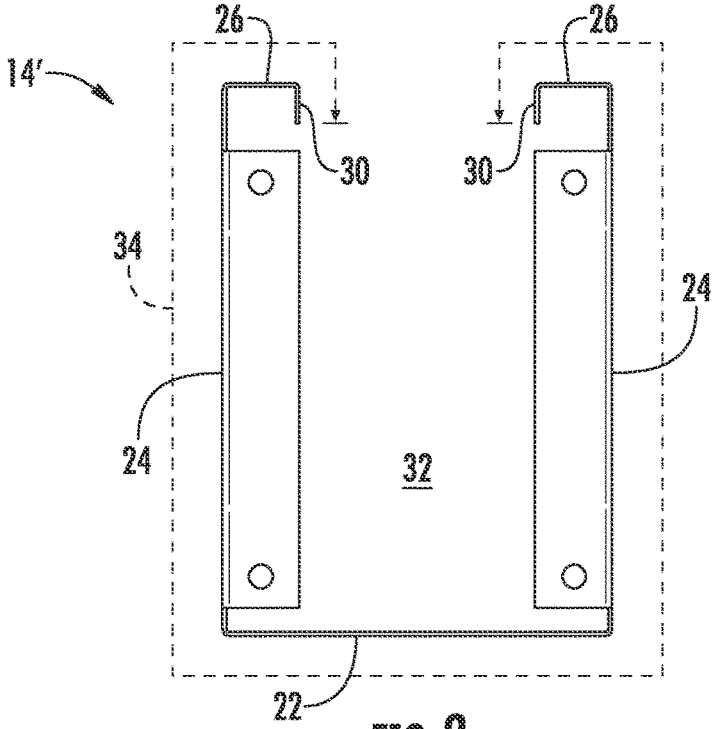
FIG. 8 is an end view of one of the beam members as shown in FIG. 6.
Figure 9:
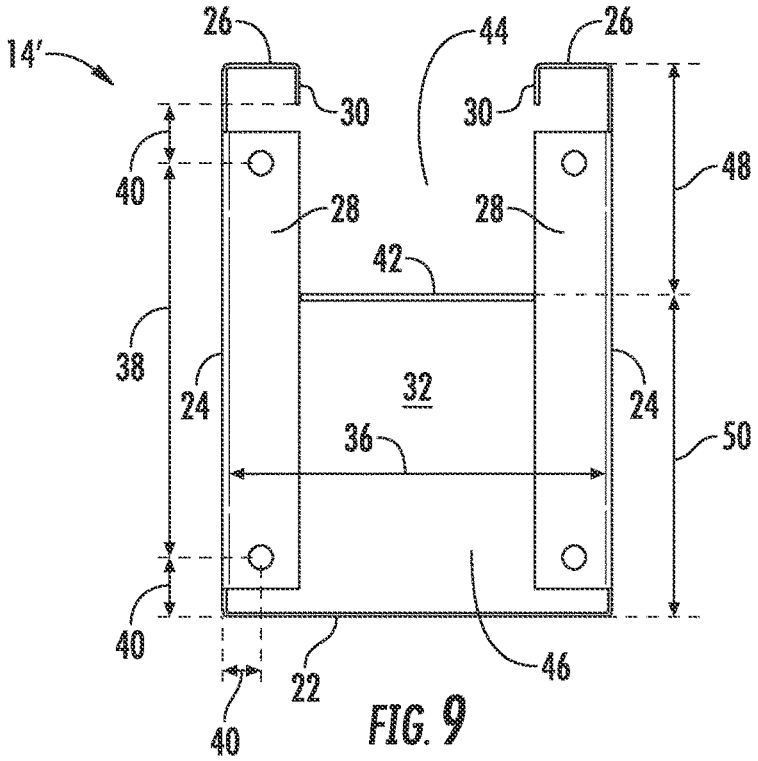
FIG. 9 is an end view of one of the beam members as shown in FIG. 6.

As noted above, one example of the beam member 14 may include forming the beam member 14 from a single-piece of flat or planar, stock material. As best illustrated in FIGS. 8 and 9, one example of the beam member 14, 14', 14" includes forming the beam member 14 from a stock material having an un-bent width 34 of less than about 24 inches and preferably of less than about 23.5 inches. In the illustrated example, the beam 14, 14', 14" is dimensioned such that the width 36 of the beam member 14 averages a minimum width 36 of about 4 inches, while the vertical distance or spacing 38 between the center of the apertures 29 of each of the flanges 28 is about 5 inches. Further, the distance 40 between the center of the apertures 29 and the corresponding bottom wall 22, side walls 24 and flanges 30 are greater than or equal to about ¾ of an inch to provide proper spacing for tool access during assembly and disassembly of the beam arrangement 12. In certain embodiments, as described in further detail below, the beam arrangement 12 may include a divider member 42 that extends at least along a partial length of the channel 32, and preferably along a majority of the length of channel 32, thereby dividing the channel 32 into an upper section or first section 44 and a lower section or second section 46, as further described below. In those embodiments that include a divider member 42, certain examples of the beam members 14, 14', 14" provide a distance 48 greater than or equal to about 3 inches between the divider member 42 and the top walls 26, and a distance 50 of greater than or equal to about 4 inches between the divider member 42 and the bottom wall 22 so as to provide adequate space for the housing of certain electrical components therein.

Figure 10:
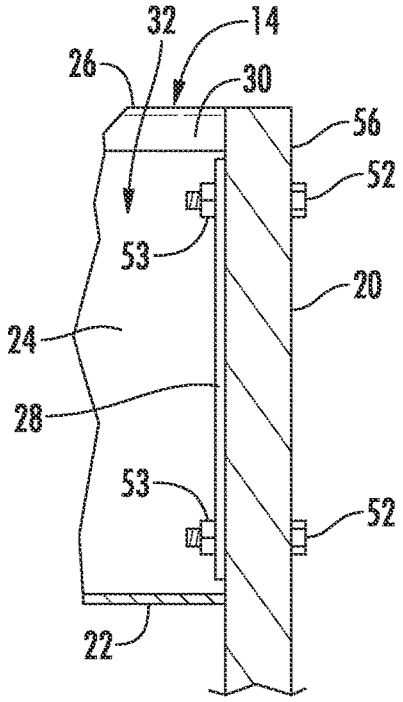
FIG. 10 is a partial cross-sectional view of the beam arrangement in the configuration as shown in FIG. 2 taken along the line X-X, FIG. 2.

In assembly, the beam member 14 (FIGS. 2, 3 and 10) may be attached to the legs 20 by a plurality of mechanical fasteners such as bolts 52 and nuts 53. In the illustrated example, each leg 20 includes a lower portion 54 configured to abut a floor surface and an upper portion 56 including a second connection arrangement 55 that is substantially identical to the first connection arrangements 35 of the beam member 14. Specifically, the second connection arrangement 55 of the illustrated example includes a plurality of apertures 58 spaced in a second pattern substantially identical to the first pattern of the apertures 29 of the first connection arrangement 35 at each end 16, 18 of the beam member 14. Each of the bolts 52 extend through an aperture 58 of one of the legs 20, through a corresponding and aligned aperture 29 of one of the flanges 28, and is threadably coupled to a corresponding nut 53. Each leg 20 may also include a wire-routing aperture 57 aligned with the channel 32 of the beam member 14 or beam members 14 attached thereto and configured to route the wires therethrough.

Figure 11:
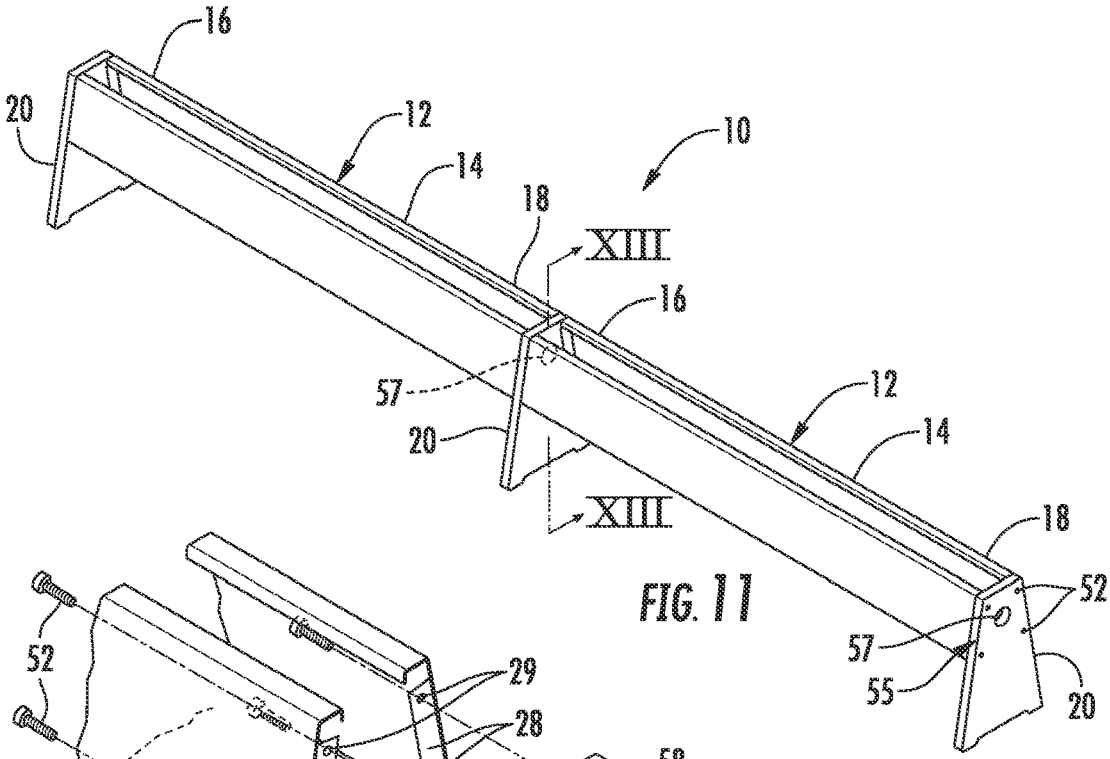
FIG. 11 is a perspective view of the furniture system including a pair of beam arrangements.
Figure 12:
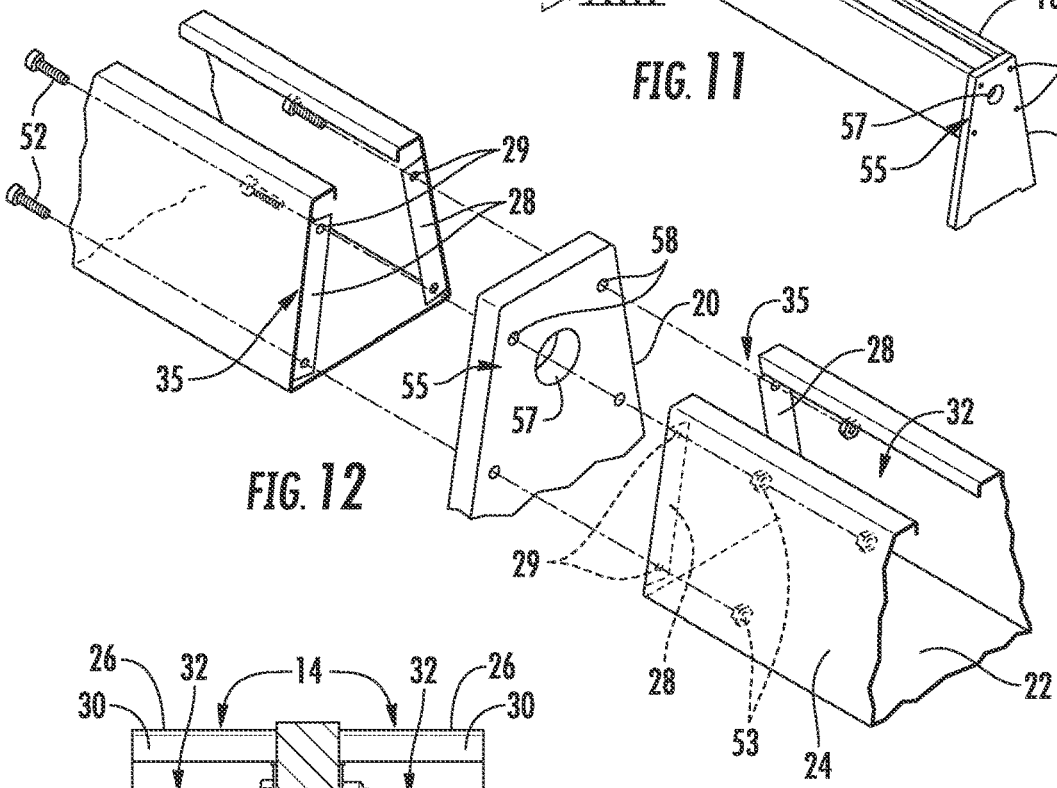
FIG. 12 is an exploded, partial perspective view of the beam arrangements in the configuration as shown in FIG. 11.
Figure 13:
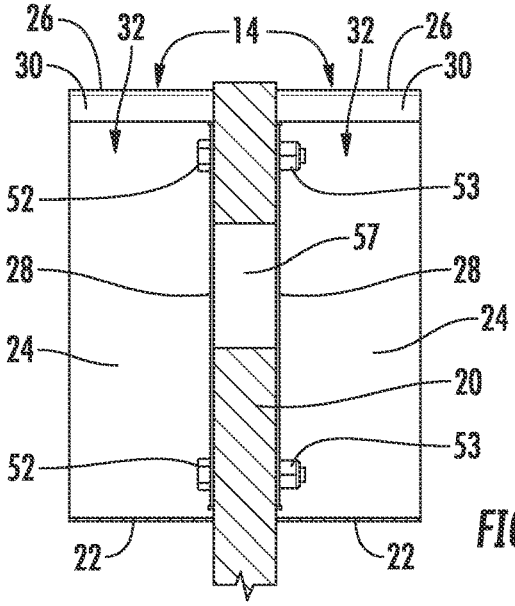
FIG. 13 is a cross-sectional side view of the beam arrangements in the configuration as shown in FIG. 13 taken along the line XIII-XIII, FIG. 11.

The furniture system 10 (FIGS. 11-13) may include multiple beam arrangements 12 including a plurality of the beam members 14 and the legs 20. In the illustrated example, the distal end 16 of one of the beam members 14 and the proximate end 18 of the other of the beam members 14 is supported by a separate leg 20, while the proximate end 18 of one of the beam members 14 and the distal end 16 of the other of the beam members 14 are supported by a common leg 20. In the illustrated example, each bolt 52 extends through an aperture 29 of one of the flanges 28, or first connection arrangement 35, of one of the beam members 14 through a corresponding and aligned aperture 58 of the common leg 20, or second connection arrangement 55, positioned between the pair of beam members 14, and through an aligned and corresponding aperture 29 of one of the flanges 28, or first connection arrangement 35, of the other of the beam members 14, and is then threadably received within one of the corresponding nuts 53, thereby securely fastening both of the beam members 14 to the common leg 20 with a single mechanical fastener, such as bolt 52, that passes through each of the components.

The furniture system 10 (FIGS. 14-17) may also include the divider member 42 that extends along the length of the channel 32 to divide the channel 32 into the upper portion or first section 44 and the lower portion or second section 46. The divider 42 is supported in the channel 32 of the beam member 14 by a pair of support portions 62 formed in the bottom wall 22. In the illustrated example, the support portions 62 are formed by laser-scored fault lines 64, although other methods for forming the fault lines may be utilized, such as stamping, scribing, etching and the like. The bottom wall 22 may be bent or separated along the fault lines 64 to create the support portions 62. Each support portion 62 may include a tab 66 extending orthogonally upward from the bottom wall 22, and a supporting flange 68 extending orthogonally from the tab 66. Each supporting flange 68 may include a mechanical-fastener receiving aperture 70. In the illustrated example, the supporting portions 62 are moved from a first position where the tabs 66 and supporting flange 68 of each of the support portions 62 are substantially planar with the bottom wall 22, and a second position where the support portions 62 each extend upwardly from the bottom wall 22, thereby forming an aperture 72 in the bottom wall 22 that may be utilized to route wires from a position below the beam member 14 and into the channel 32.

In assembly, the divider member 42 may be positioned within the channel 32 of the beam member 14 such that the divider member 42 is supported on the supporting flange 68 of each of the support portions 62. The divider member 42 may be secured to the support portions 62 by mechanical fasteners such as screws 74 that extend through apertures 76 of the divider member 42 and into the apertures 70 of the support flange 68 of each of the support portions 62. Further, the divider member 42 may be provided with an opening 78 that receives an electrical power block 80 therein. In the illustrated example, the electrical power block 80 includes a housing 82 housing a plurality of electrical outlets 84, and a flange 86 extending outwardly from and about the housing 82. The divider member 42 and the electrical power block 80 may be secured within the channel 32 of the beam member 14 by placing the divider member 42 into the channel 32 such that the divider member 42 is supported by the support portions 62. The power block 80 may be positioned within the channel 32 of the beam member 14 and the opening 78 of the divider member 42, such that the divider member 42 is sandwiched between the flange 86 of the power block 80 and the supporting flange 68 of each of the support portions 62. The divider member 42 and the power block 80 may then be secured to the beam member 14 by mechanical fasteners 74 that extend through apertures 88 of the flange 86 of the power block 80, through the apertures 76 of the divider member 42, and that are threadably received into the apertures 70 of the supporting flanges 68 of the support portions 62. The electrical outlets 84 of the power block 80 may include NEMA outlets, and the electrical outlets 84 are located within the channel 32 such that a majority of each electrical outlets 84 may be located within the lower portion 46 of the channel 32 while the receptacles of the outlets 84 are upwardly disposed into the upper portion 44 thereby allowing access to a user. In the illustrated example, an electrical line 90 is routed through the aperture 57 of the leg 20 and into the lower portion 46 of the channel 32 and provides power to the power block 80. The divider member 42 effectively divides the channel 32 into the upper portion 44 and the lower portion 46, thereby allowing the separation of communication lines and electrical wires from one another to reduce or eliminate electrical interference therebetween.

Figure 18:
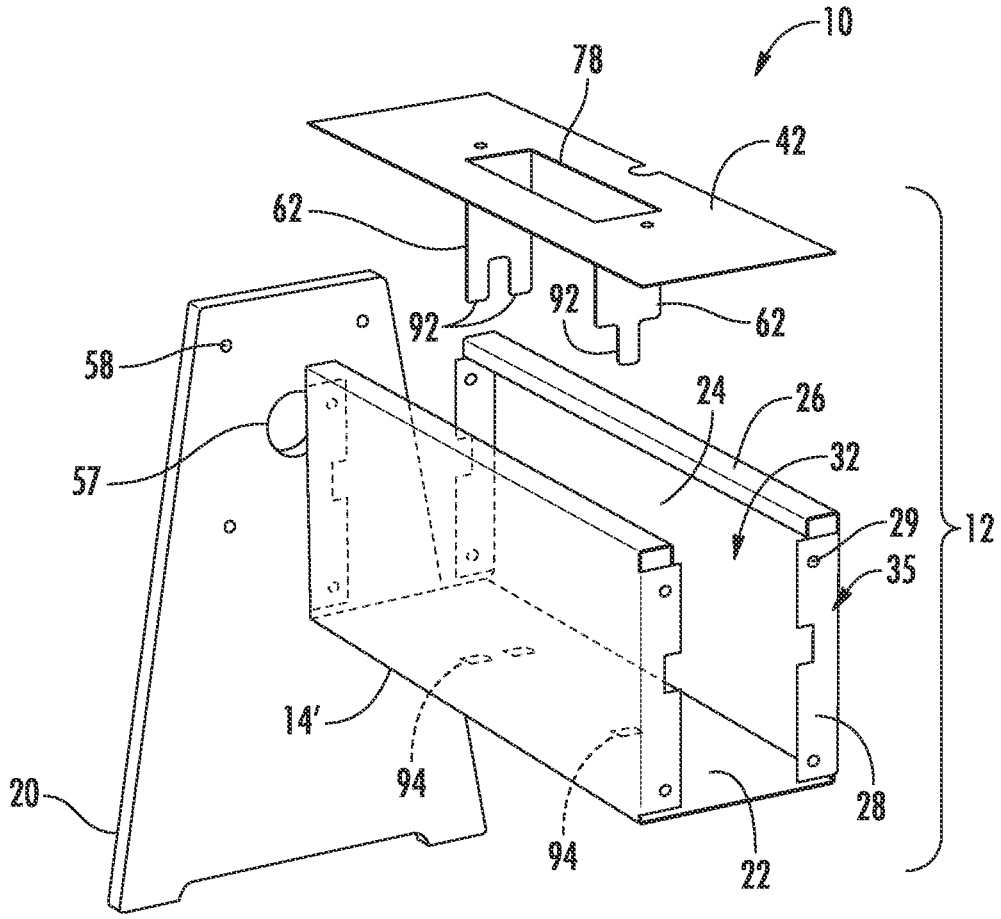
FIG. 18 is an exploded perspective view of the beam arrangement supporting an alternatively configured divider member.

Alternatively, the divider member 42 (FIG. 18) includes the pair of support portions 62 each formed via laser-scored fault lines etched into the divider member 42, such that the support portions 62 are moved between a first position where the support portions 62 are substantially planar with the majority of the divider member 42, to a second position where the support portions 62 extend orthogonally downward from the majority of the divider member 42. In the illustrated example, each support portion 62 includes either one or two engagement tabs 92 configured to be received within corresponding slots 94 formed within the bottom wall 22 of the beam member 14, thereby supporting the divider member 42 within the channel 32 of the beam member 14.

Figure 19:
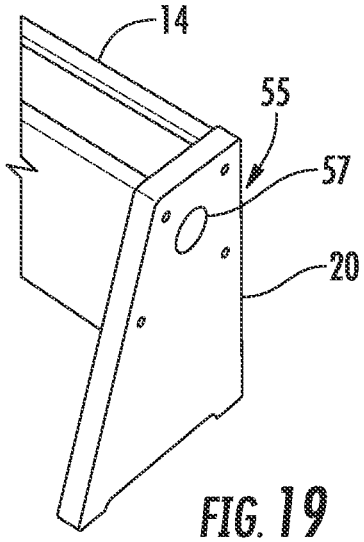
FIG. 19 is a partial perspective view of the area XIX, FIG. 2, illustrating a full-height leg.
Figure 20:
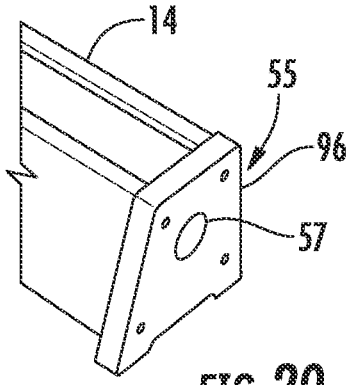
FIG. 20 is a partial perspective view of the beam arrangement including a shortened or reduced-height leg.
Figure 21:
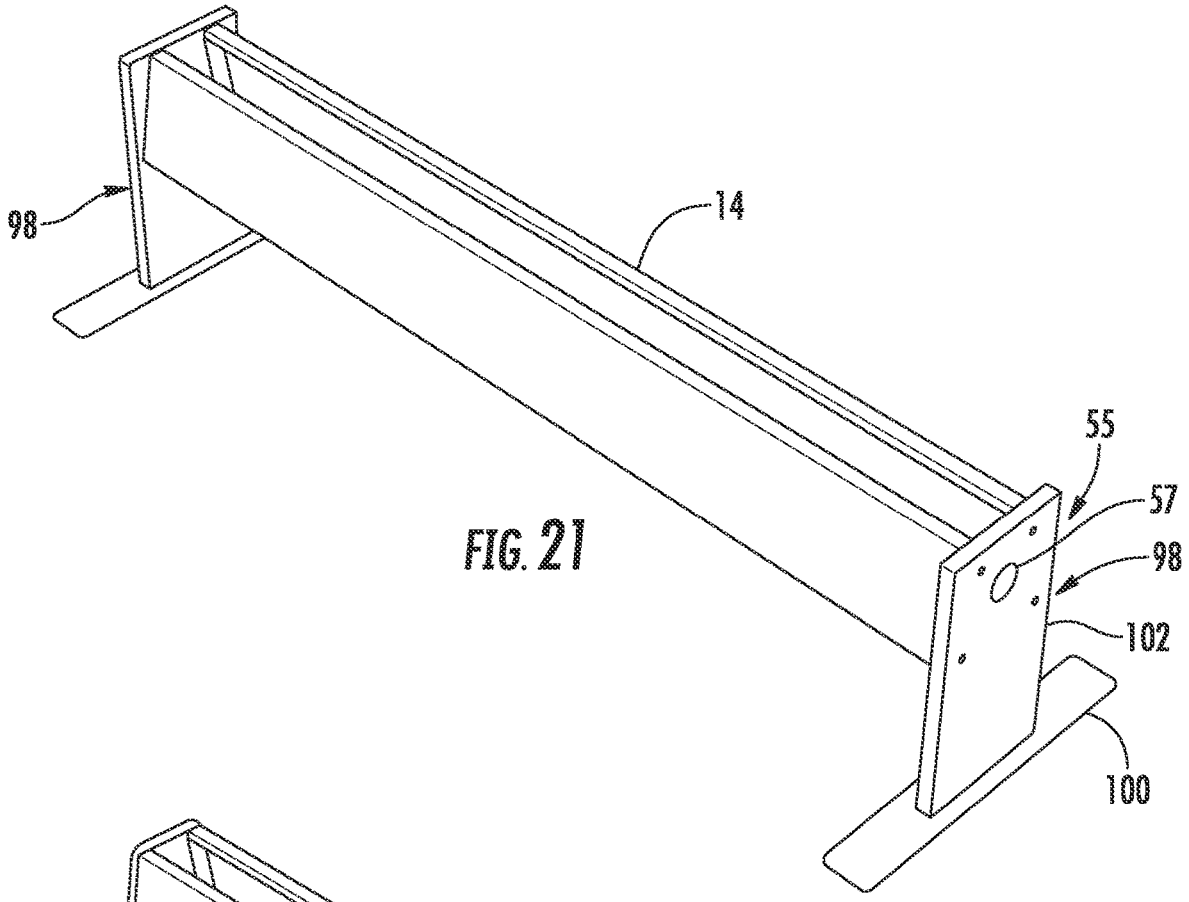
FIG. 21 is a perspective view of the beam arrangement including the beam member supported by a leg assembly including an outrigger portion.
Figure 22:
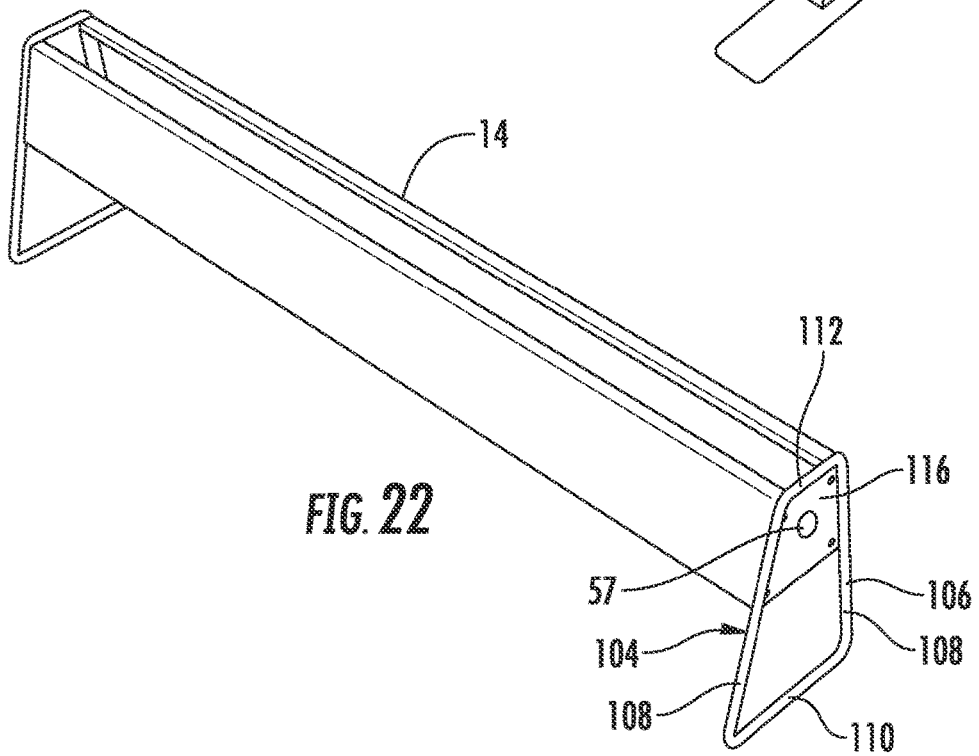
FIG. 22 is a perspective view of the beam arrangement including the beam member supported by tube end panels.
Figure 23:
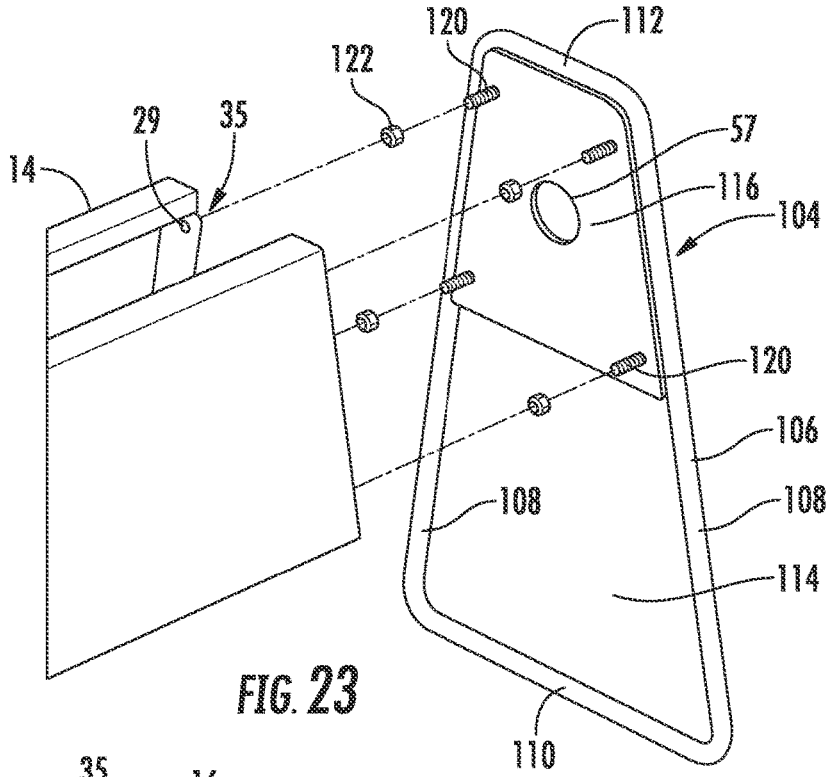
FIG. 23 is an exploded, partial perspective view of the beam member and one of the tube end panels of the beam arrangement in the configuration as shown in FIG. 22.

Alternative configurations of the legs 20 and supporting arrangements may be provided within the various configurations of the furniture system. For example, FIGS. 2 and 19 illustrate a full-height leg 20, while FIG. 20 illustrates a reduced-height leg 96 configured to support the associated beam member 14 closer to the floor surface. FIG. 21 illustrates the beam member 14 supported by a pair of leg assemblies 98 each including an outrigger portion 100 that extends laterally outward from a leg portion 102. FIGS. 22 and 23 illustrate the beam member 14 as being supported by tube end panels 104. Each tube end panel 104 may include a bent tube leg 106 including two downwardly-extending side portions 108, a floor-abutting bottom portion 110 extending laterally between the side portions 108, and a top portion 112 extending laterally between the side portions 108, where the side portions 108, the bottom portion 110 and the top portion 112 cooperate to form an interior space 114. An attachment plate 116 is located within the interior space 114 and is secured to the side portions 108 and the top portion 112 via welding. The tube end panels 104 may be attached to the associated beam member 14 via separate mechanical fasteners similar to the bolts 52 and nuts 53 as previously described. Alternatively, a plurality of threaded studs 120 may be fixed to the attachment plate 116 via welding, press-fitting, and the like. The permanently fixed studs 120 cooperate with a plurality of corresponding nuts 122 to secure the tube end panels 104 to the beam member 14.

Figure 24:
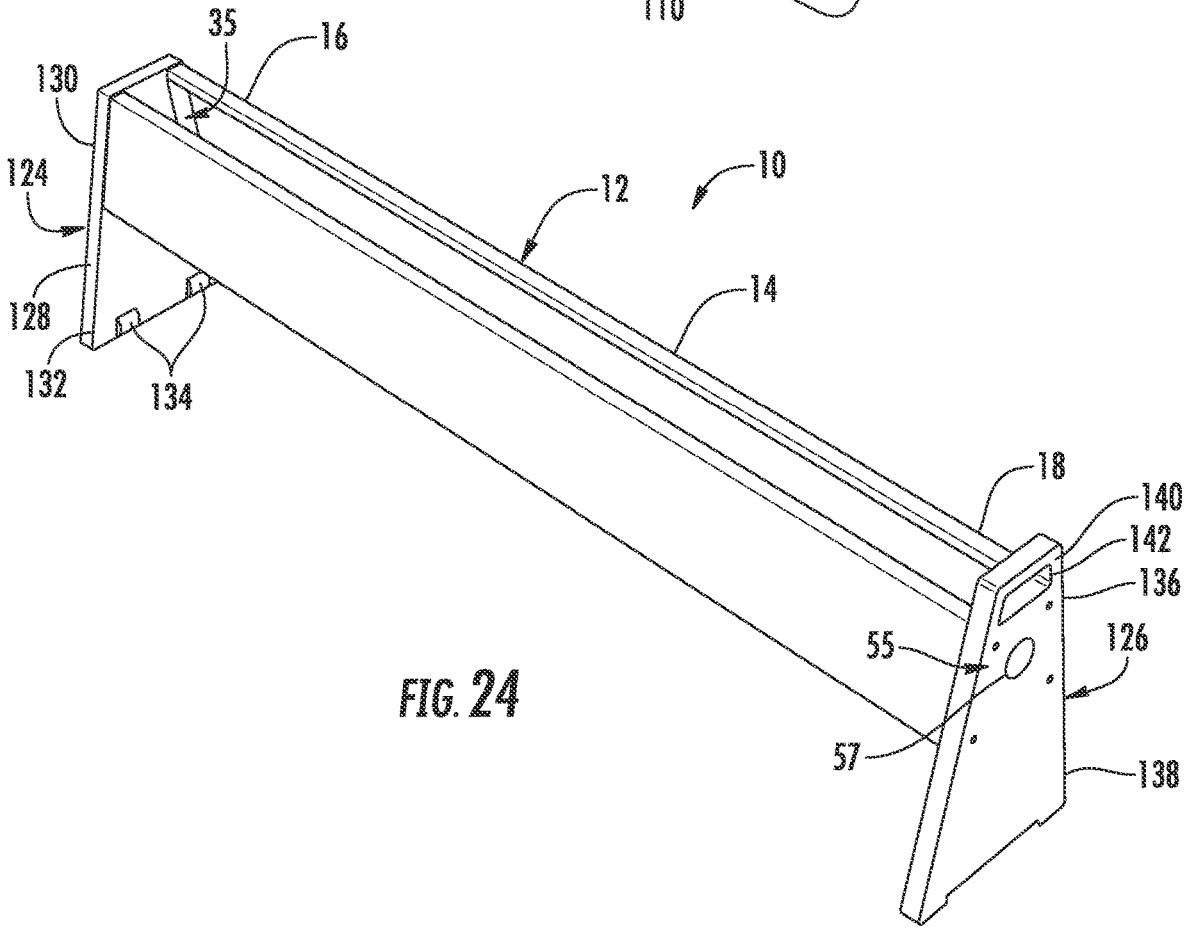
FIG. 24 is a perspective view of the furniture system including the beam member supported by a leg assembly including a plurality wheels.
Figure 25:
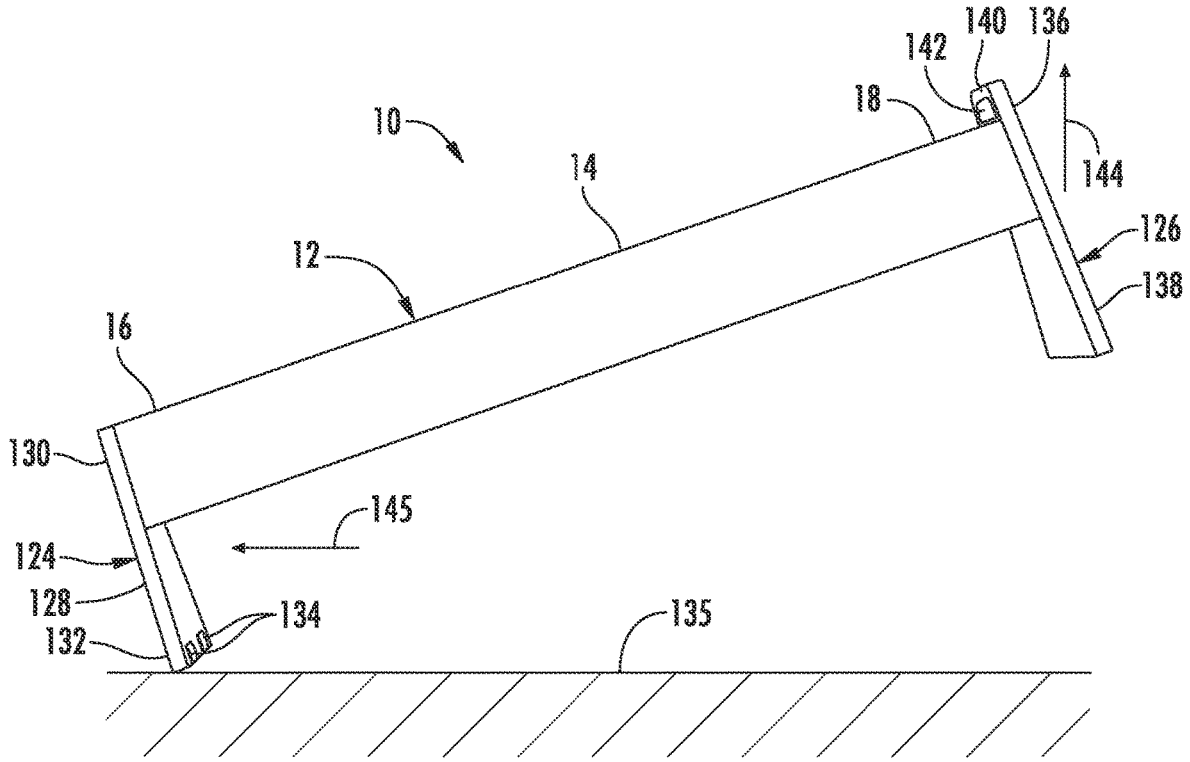
FIG. 25 is a perspective view of the furniture system in the configuration as shown in FIG. 24 shown in a moving position.

As best illustrated in FIGS. 24 and 25, the first end 16 of the beam member 14 may be supported by a leg assembly 124, while the second end 18 of the beam member 14 may be supported by a leg 126, where the leg assembly 124 includes a leg member 128 having an upper end 130 attached to the beam member 14 via the first connection arrangement 35 and the second connection arrangement 55, and a lower end 132 configured to abut a floor surface 135. A pair of wheels 134 may be affixed to the lower end 132 so as to facilitate movement of the overall furniture system 10 across the floor surface 135. Although the leg assembly 124 includes a plurality of wheels 134 in the illustrated example, other friction-reducing members may also be utilized, including rollers, casters and friction-reducing pads. The leg 126 includes an upper end 136 connected to the beam member 14 via the first and second connection arrangements 35, 55, and a lower end 138. In the illustrated example, the upper end 136 includes a graspable handle 140 formed via an aperture 142 extending through the upper end 136 of the leg assembly 126. In use, the lower end 138 of the leg assembly 126 frictionally engages the floor surface 135 such that the furniture system 10 remains in place during use. In order to facilitate movement of the furniture assembly 10 with respect to the floor surface 135, a user grasps the handle 140 of the leg 126 and lifts the leg 126 away from the floor surface in a direction 144 such that the lower end 138 of the leg 126 no longer frictionally engages or abuts the floor surface 135. A user may then easily maneuver the furniture system 10 in a horizontal direction 145 with respect to the floor surface 135 via the wheels 134. Once the furniture system 10 is correctly repositioned, the leg 126 is then lowered until the lower end 138 of the leg 126 abuts and frictionally engages the floor surface 135.

Figure 26:
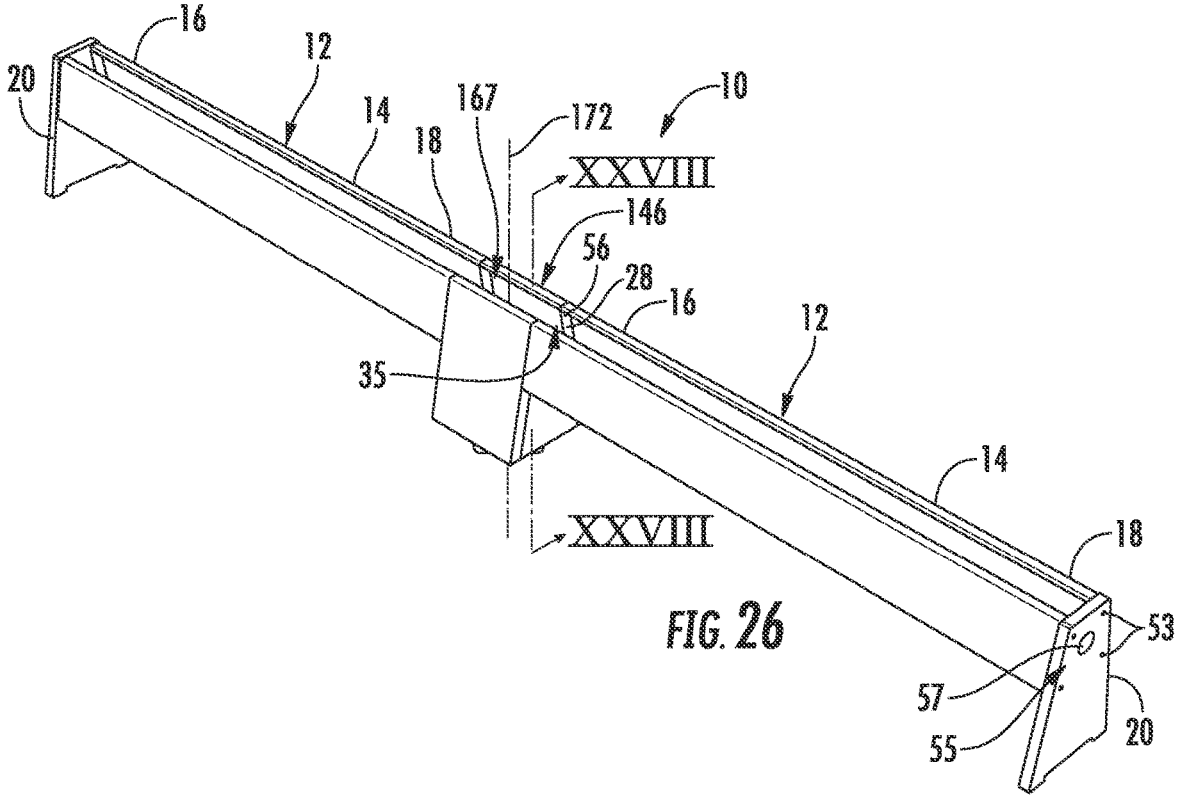
FIG. 26 is a perspective view of the furniture system including a plurality of the beam members supported by a rotating leg assembly.
Figure 27:
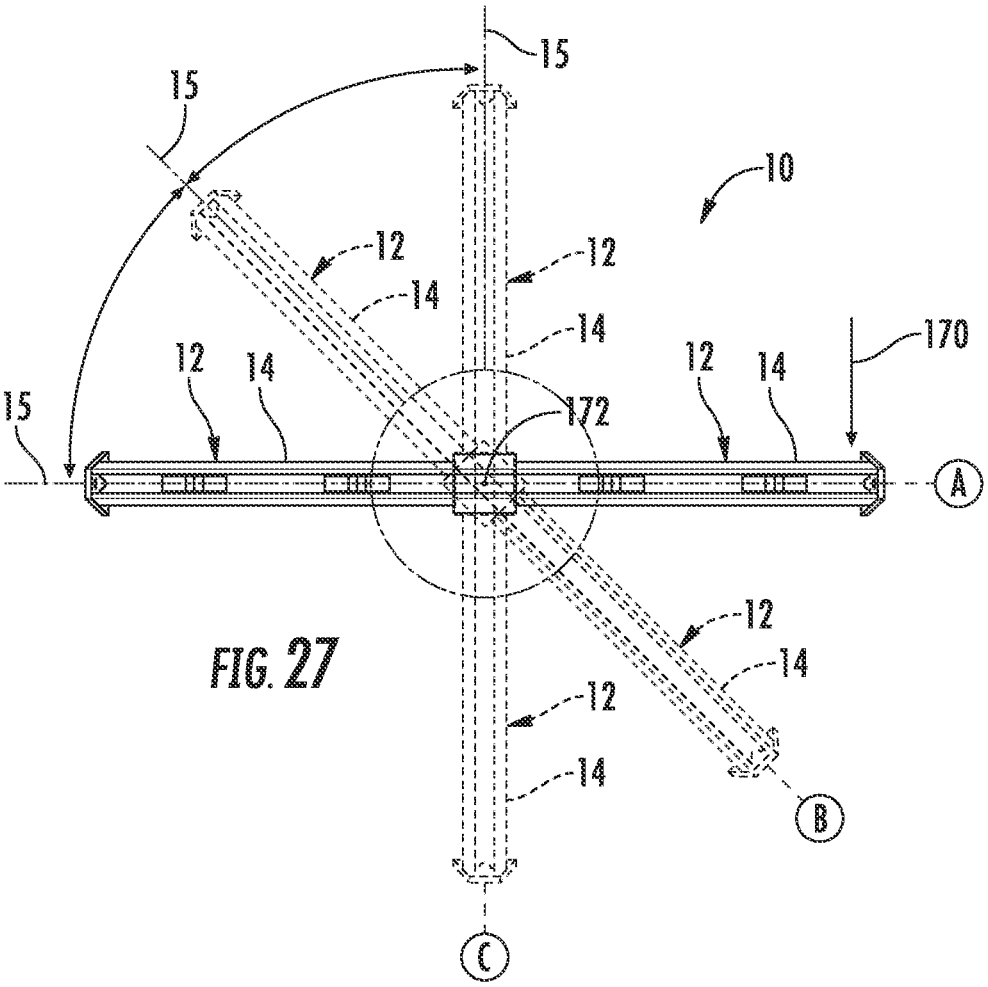
FIG. 27 is a top plan view of the furniture system in the configuration as illustrated in FIG. 26 shown in multiple rotational positions.
Figure 28:
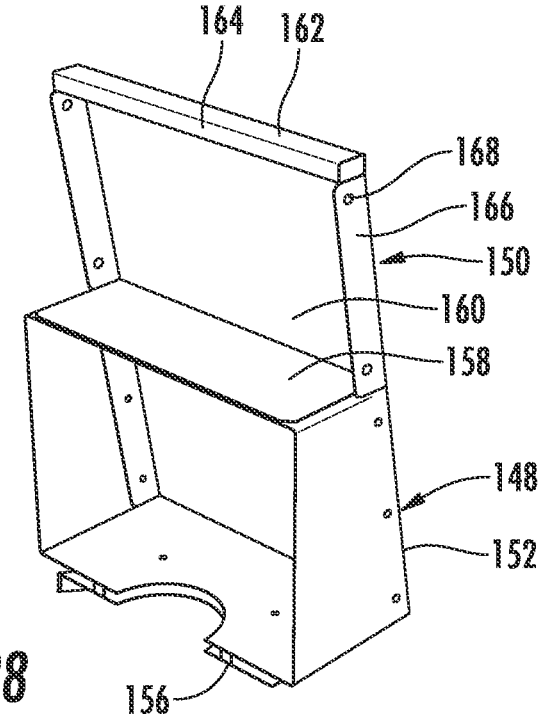
FIG. 28 is a cross-sectional, perspective view of the rotating leg assembly taken along the line XXVIII-XXVIII, FIG. 26.

The furniture system 10 (FIGS. 26-28) may also include a pair of the beam members 14 supported by a rotating leg assembly 146, which allows the beam members 14 to be rotated about the rotating leg assembly 146 between a plurality of arcuately-spaced orientations, including, but not limited to a first position A, a second position B located 45° from the first position A, and a third position C located 90° from the first position A. As best illustrated in FIGS. 26 and 28, the rotating leg assembly 146 includes a base assembly 148 configured to rotatably support an upper attachment portion 150 above the floor surface, where the upper attachment portion 150 is configured to couple the base assembly 148 to the beam members 14. In the illustrated example, the base assembly 148 includes a housing portion 152, and a swivel assembly 156 attached to the housing portion 152 and rotatably supporting the housing portion 152 above the floor surface. The attachment portion 150 is similarly configured to the beam member 14 and includes a bottom wall 158, a pair of side walls 160 extending upwardly from the bottom wall 158, a pair of top walls 162 extending inwardly from the side walls 160, a pair of flanges 164 extending downwardly from the top walls 162, and a pair of flanges 166 located at each end of the attachment portion 150 and including a plurality of mechanical-fastener receiving apertures 168 patterned substantially identically to the apertures 56 of the flanges 28 of each of the beam members 14 and forming a third connection arrangement 167 that is substantially identical to the first and second connection arrangements 35, 55. In operation, a user may grasp one of the legs 20 and/or a distally located first or second end 16, 18 of one of the beam members 14 and apply a force 170 in a direction substantially orthogonal to the longitudinal axis 15 of the beam member 14, thereby rotating the beam arrangements 12 about a vertical axis 172 of the leg assembly 146 between the positions A, B, C, or an infinite number of incremental positions 360° about the axis 172.

Figure 29:
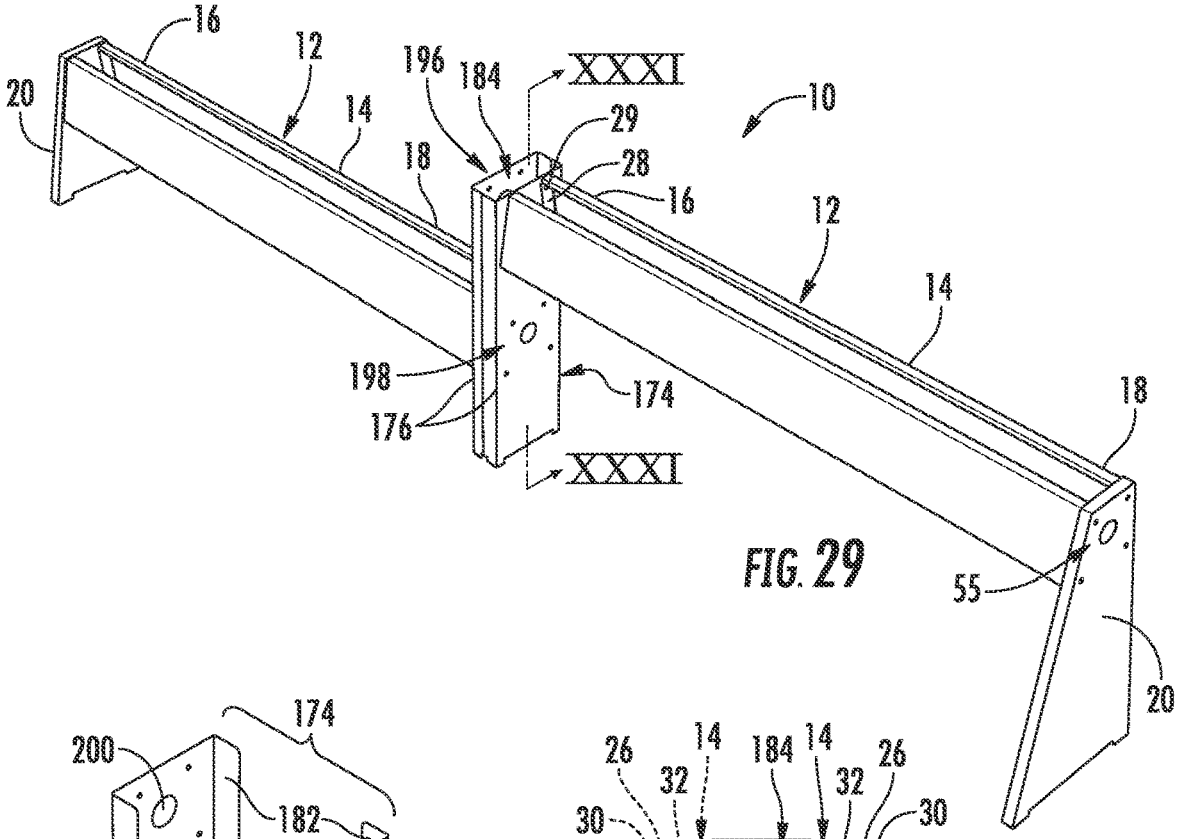
FIG. 29 is a perspective view of the furniture system including a pair of the beam members supported by a common leg assembly including a plurality of leg plates.
Figure 30:
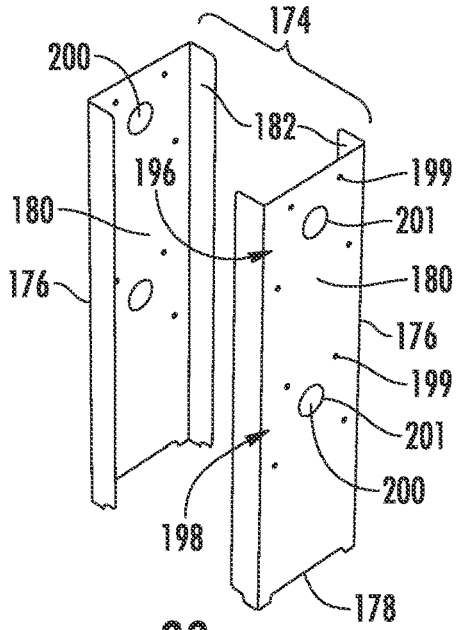
FIG. 30 is an exploded perspective view of the leg assembly in the configuration as shown in FIG. 29.
Figure 31:
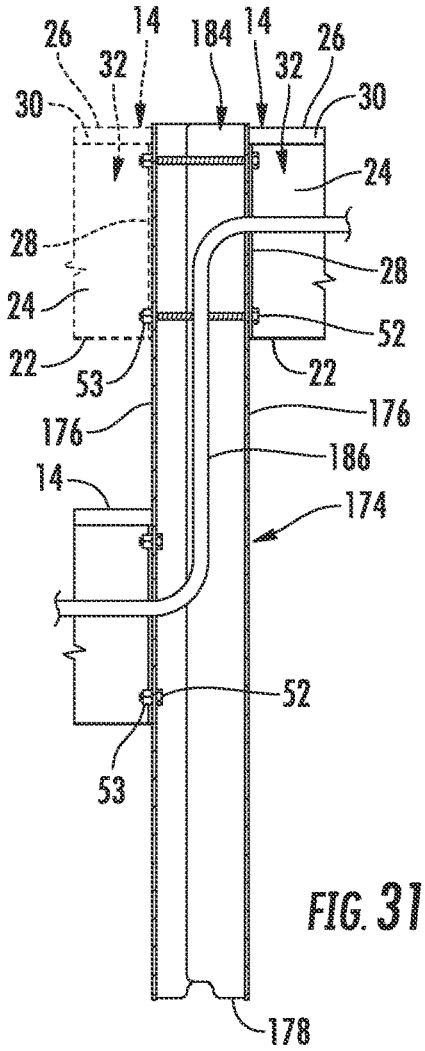
FIG. 31 is a cross-sectional, side elevation view of the furniture system in the configuration as shown in FIG. 29 taken along the line XXXI-XXXI, FIG. 29.

The furniture system 10 (FIG. 29) may also include a pair of the beam arrangements 12 supported by a leg assembly 174, where the leg assembly 174 includes a plurality of substantially identical plate members 176. In the illustrated example, each plate member 176 (FIG. 30) includes a lower end 178 configured to abut the floor surface, a substantially planar body portion 180, and a pair of flanges 182 extending orthogonally from the body portion 180 and along the length thereof. The plate members 176 cooperate to define an interior passage 184 configured to route wires 186 vertically within the leg assembly 174 and between the beam members 14 attached to the leg assembly 174 at different vertical heights from one another or at similar vertical heights, as shown in dashed line, or both. As best illustrated in FIGS. 29 and 30, each of the plate members 176 may be provided with connection arrangements 196, 198 for connecting the beam members 12 to the leg assembly 174 at various heights. Specifically, each plate member 176 may include an upper connection arrangement 196 and a lower connection arrangement 198 that are each substantially identical to the first and second connection arrangements 35, 55, and where each connection arrangement 196, 198 includes a plurality of apertures 199 that are patterned substantially identical to the pattern of apertures 29 of the flanges 28 of each of the beam members 14. A plurality of punch-outs 200 may be provided along the body portion 180 of each of the plate members 176, thereby allowing the forming of a wire aperture 201 at the proper location and such that the wire aperture 201 aligns with the channel 32 of the beam member 14 attached to the leg assembly 174. As illustrated in FIG. 31, each plate member 176 may be attached to a single beam member 174 by a bolt 52 extending through the apertures 199 of one of the plate members 176 and the apertures 29 of one of the legs 20 of the beam member 14, and that threadably engages the nut 53. The bolts 52 may extend through and connect two beam members 14 to a leg assembly 174. Specifically, each bolt 52 may extend through one of the apertures 29 of one of the flanges 58 of one of the beam members 14, through a corresponding and aligned aperture 199 of one of the plate members 176, through a corresponding and aligned aperture 199 of the other of the plate members 176, through a corresponding and aligned aperture 29 of one of the flanges 28 of the other beam member 14 connected to the leg assembly 174 at a similar height as the first beam member 14, and threadably engaging a nut 53, thereby coupling two beam members 14 to the two leg plate members 176 of the leg assembly 174 via a single mechanical fastener passing through each of the components.

Figure 32:
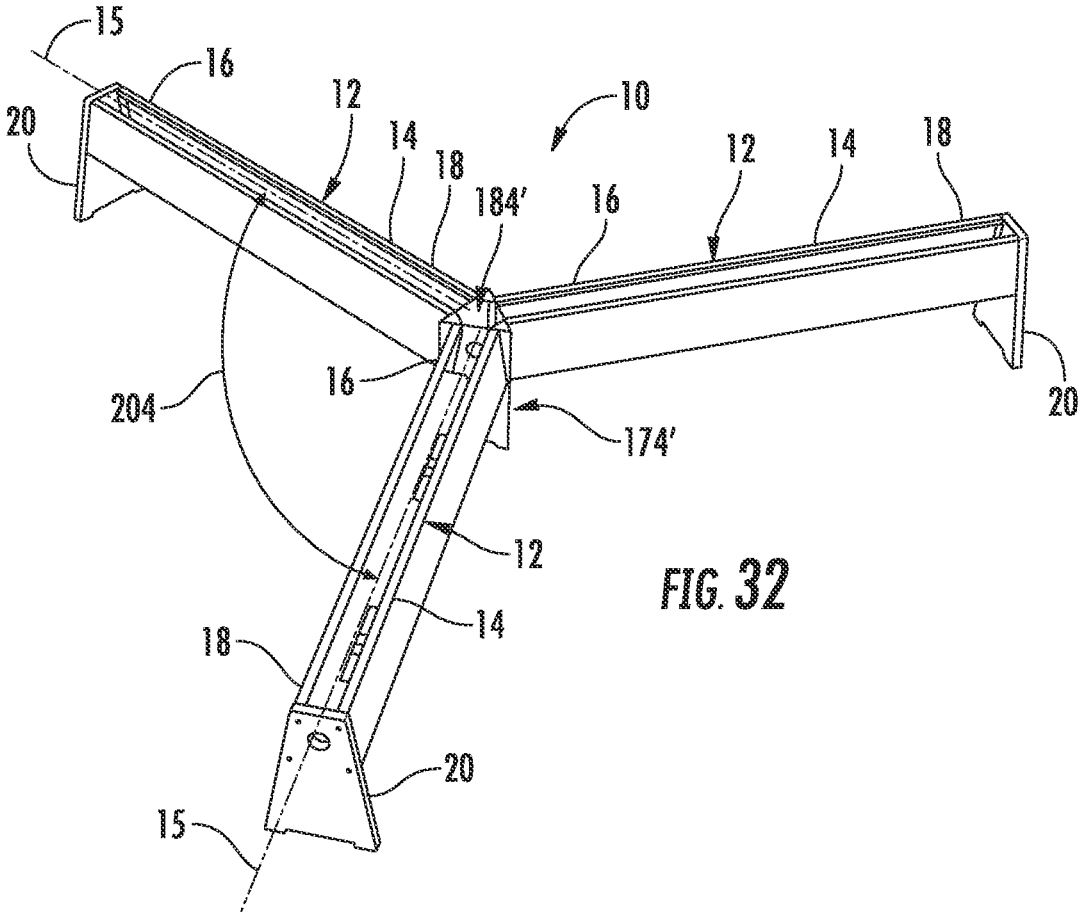
FIG. 32 is a perspective view of the furniture system including three of the beam members supported from a common leg assembly.
Figure 33:
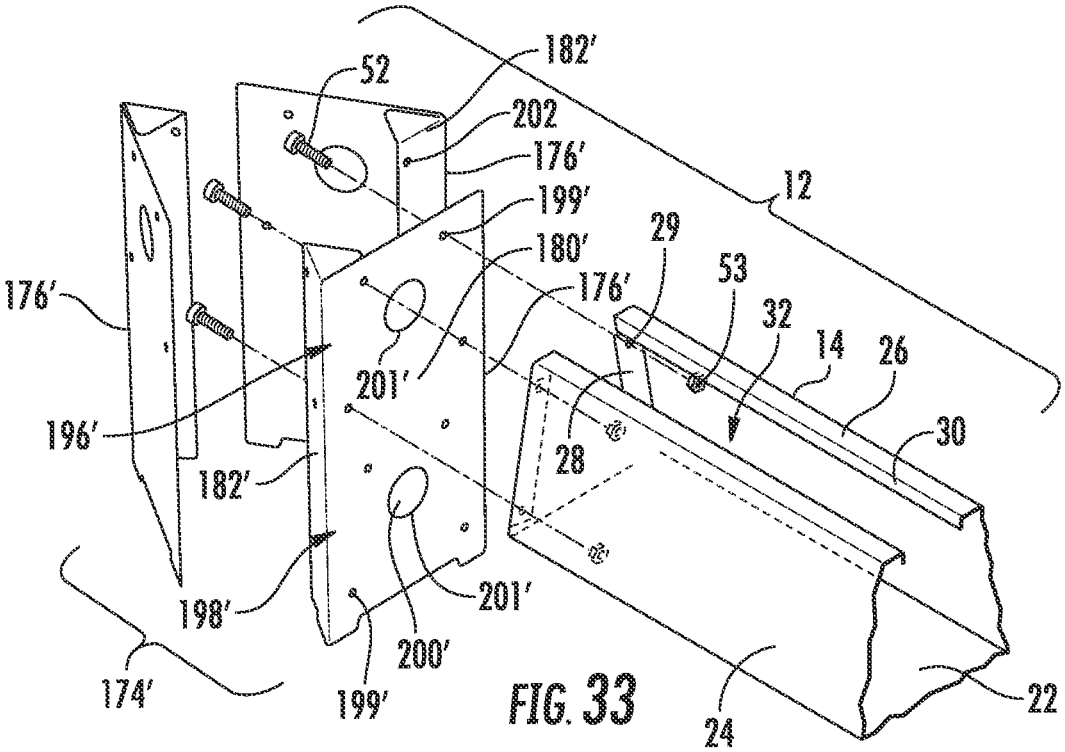
FIG. 33 is an exploded, partial perspective view of one of the beam members of the furniture system in the configuration as shown in FIG. 32 and the leg assembly.
Figure 33A:
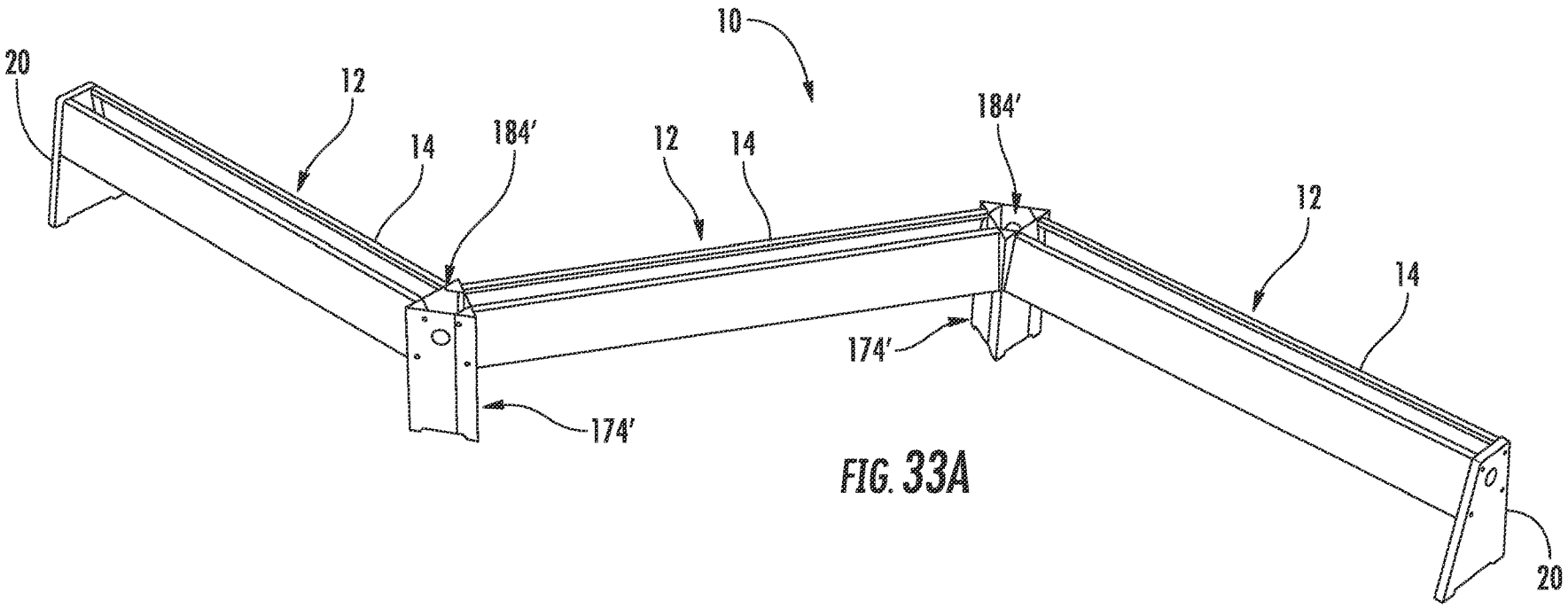
FIG. 33A is a perspective view of the furniture system in the configuration as shown in FIG. 32 illustrated in an alternative configuration.
Figure 34:
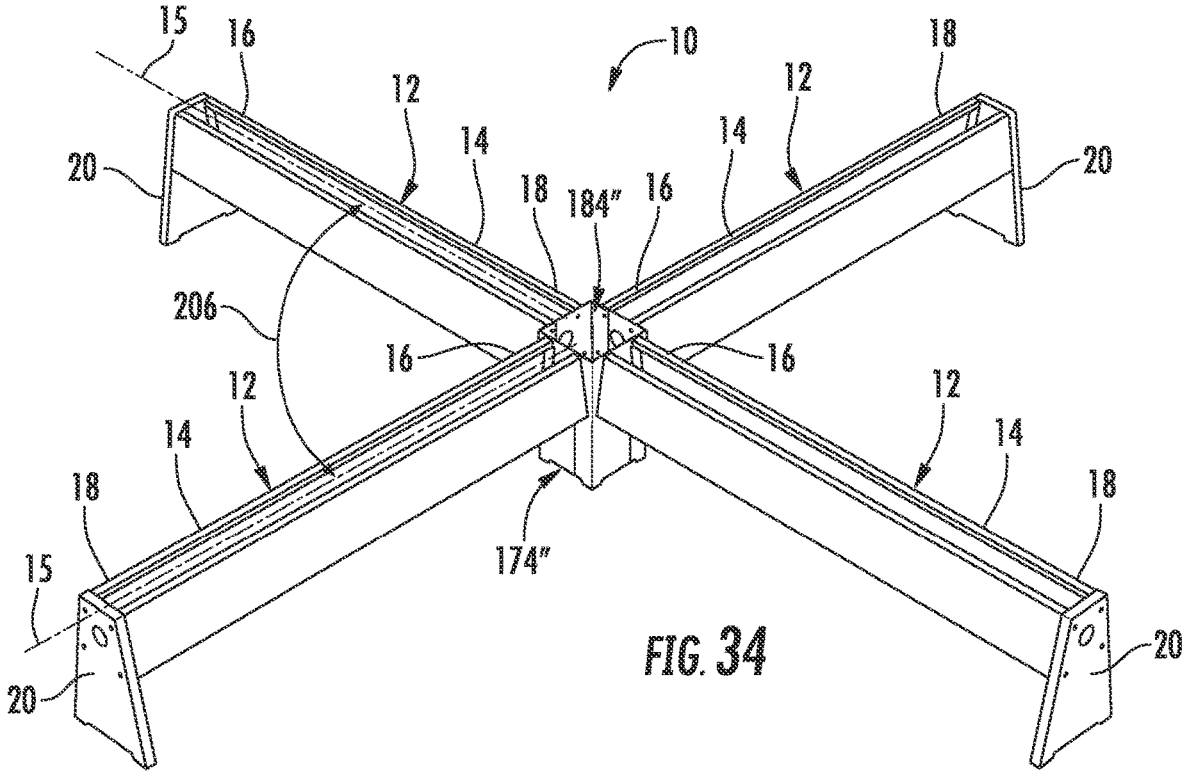
FIG. 34 is a perspective view of the furniture system including four of the beam members supported by a common leg assembly.
Figure 35:
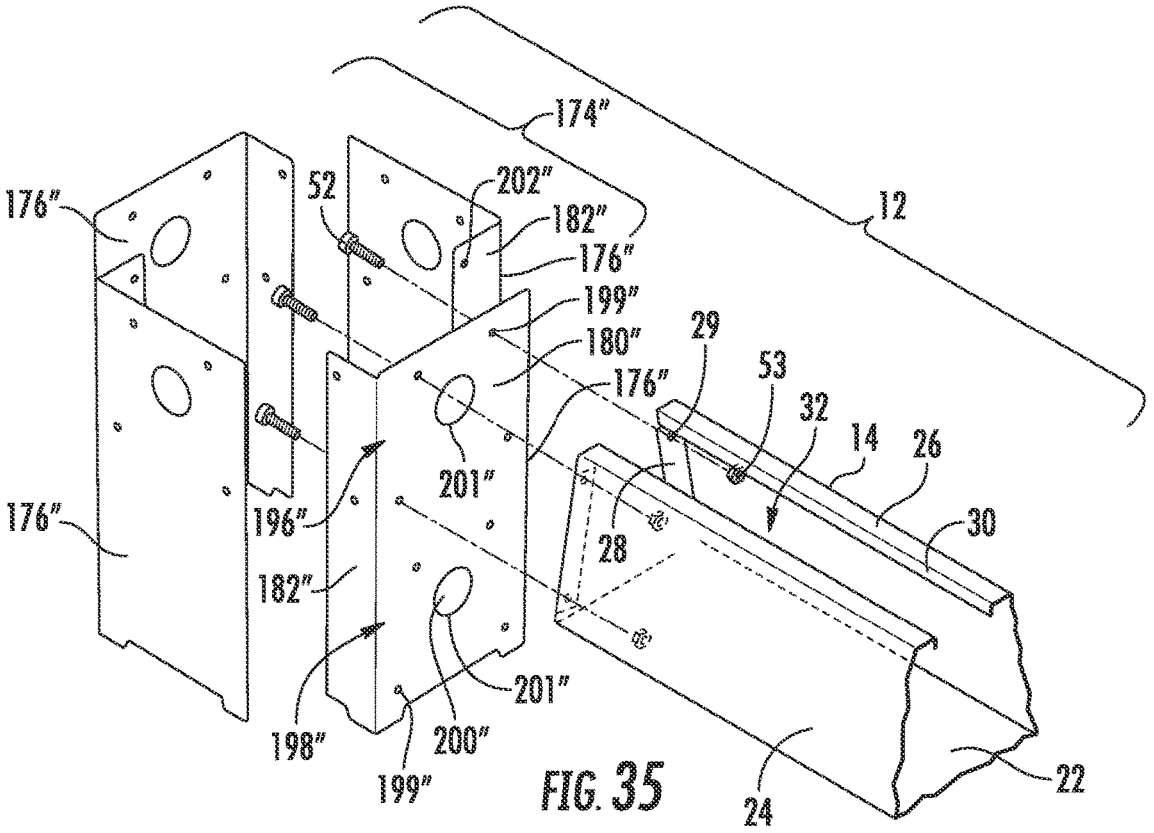
FIG. 35 is an exploded, partial perspective view of one of the beam members of the furniture system in the configuration as shown in FIG. 34 and the leg assembly.

Alternative configurations of the leg assembly 174 may be utilized to support an additional number of beam members from a single leg assembly. For example, the furniture system 10 (FIG. 32) includes three of the beam members 14 each supported by the single leg assembly 174'. As best illustrated in FIG. 33, the leg assembly 174' includes three substantially identical plate members 176' that cooperate to form the leg assembly 174'. Each plate member 176' may include the planar body portion 180', and the flange 182' where the flange 182' has a triangularly-shaped cross-sectional configuration and extends along the length of one of the side edges of the body portion 180'. The body portion 180' may include the upper and lower connection arrangements 196', 198', and the punch-outs 200' for forming the wire apertures 201'. Each flange 182' includes a plurality of apertures 202 spaced along the length of the flange 182' and configured to receive a mechanical fastener therethrough. In assembly, each bolt 52 extends through one of the apertures 202 of the flange 182' of one of the plate members 176', through a corresponding and aligned aperture 199' of another of the plate members 176', through a corresponding and aligned aperture 29 of one of the flanges 28 of the beam member 14, and is threadably coupled to a corresponding nut 53, such that a single mechanical fastener such as the bolt 52, secures multiple plate members 176' with a beam member 14. Once assembled, the leg assembly 174' defines the interior passage 184' that extends vertically along the length of the leg assembly 174' and is configured to route wires therethrough. The beam members 14 may be secured to the leg assembly 174' to provide the furniture system 10 with various plan-form configurations, such as a pinwheel-type configuration as illustrated in FIG. 32, where an angle 204 between the longitudinal axis 15 of two of the beam members 14 is about 120°, and a serpentine-type plan form configuration as illustrated in FIG. 33A, and/or combinations thereof.

In another example, the leg assembly 174" (FIGS. 34 and 35) of the furniture system 10 includes four substantially identical plate members 176" each having a flange 182" extending substantially orthogonally from and along the length of the body portion 180". In the illustrated example, each body portion 180" includes the upper and lower connection arrangements 196", 198", and the punch-outs 200" for forming the wire apertures 201". Each plate member 176" further includes a plurality of the apertures 202" spaced along the length of the flange 182" each configured to receive mechanical fasteners therethrough. In assembly, each aperture 202" of the flange 180" of one of the plate members 176" is aligned with a corresponding aperture 199" of the body portion 180" of another of the plate members 176", and a corresponding one of the apertures 29 of one of the flanges 28 of one of the beam members 14, such that the bolt 52 extends through the aperture 202", the aperture 199", and the aperture 29 and is threadably received and coupled to a corresponding nut 53, thereby fastening a beam member 14 to two of the plate members 176" via a single mechanical fastener. Once assembled, the plate members 176" cooperate to provide the interior passage 184" that extends vertically along the length of the leg assembly 174" and allows the routing of wires therethrough. In the illustrated example, the beam members 14 may be selectively attached to the leg assembly 174" to provide a 90° angle 206 between the longitudinal axis 15 of two beam members 14, and may be used to selectively configure the furniture system 10 into a cross-configuration plan form. Although the various configurations of the furniture system 10 as shown in FIGS. 29-35, include two, three and four beam members 10 supported from a single, common leg assembly 174, 174', 174", respectively, it is noted that any number of leg plate members may be utilized to provide a furniture system that includes a single, common leg assembly supporting a plurality of beam members. In at least some of the illustrated examples, the beam members 14 are equally spaced about the associated common leg assembly 174, 174', 174", such that where an angle between the longitudinal axis of the beam members 14 is about 360° divided by the number of leg plate members 176, 176', 176".

Figure 14:
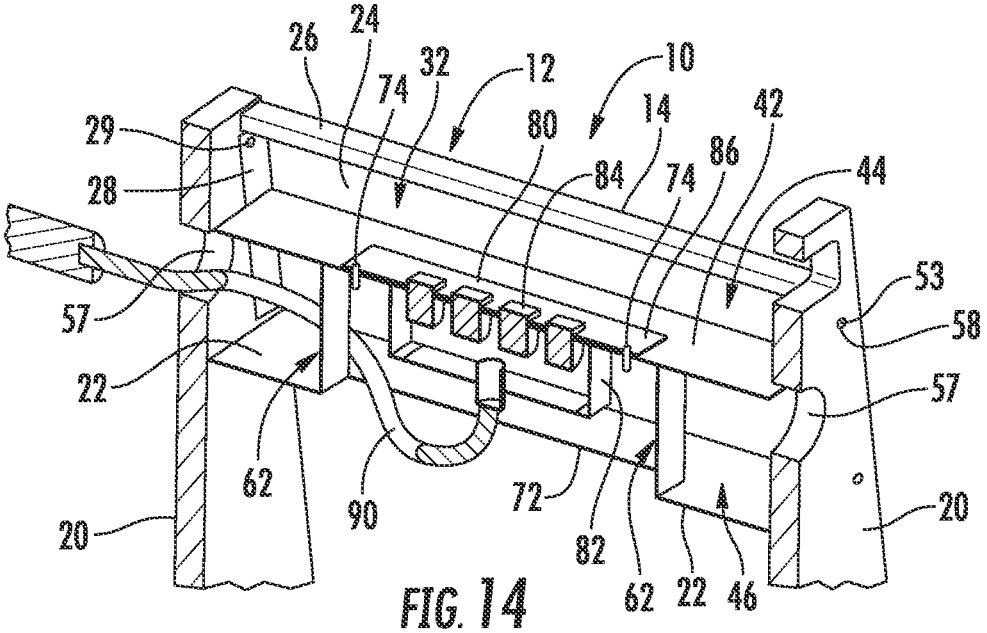
FIG. 14 is a cross-sectional perspective view of the furniture system including the beam member supporting a divider member and an electrical power block.
Figure 15:
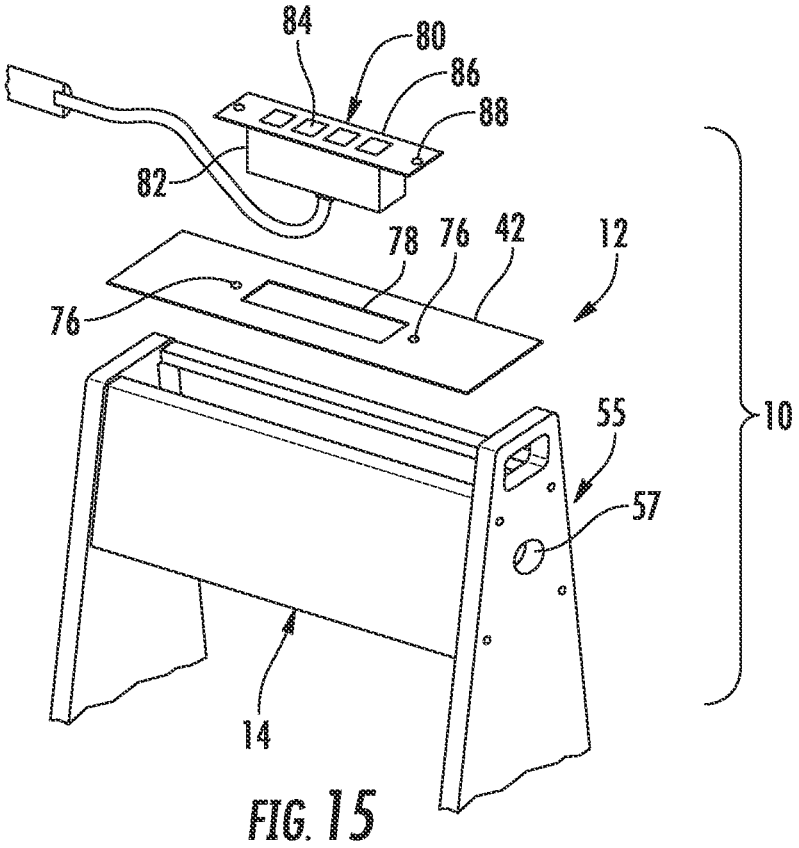
FIG. 15 is an exploded perspective view of the furniture system in the configuration as shown in FIG. 14.
Figure 16:
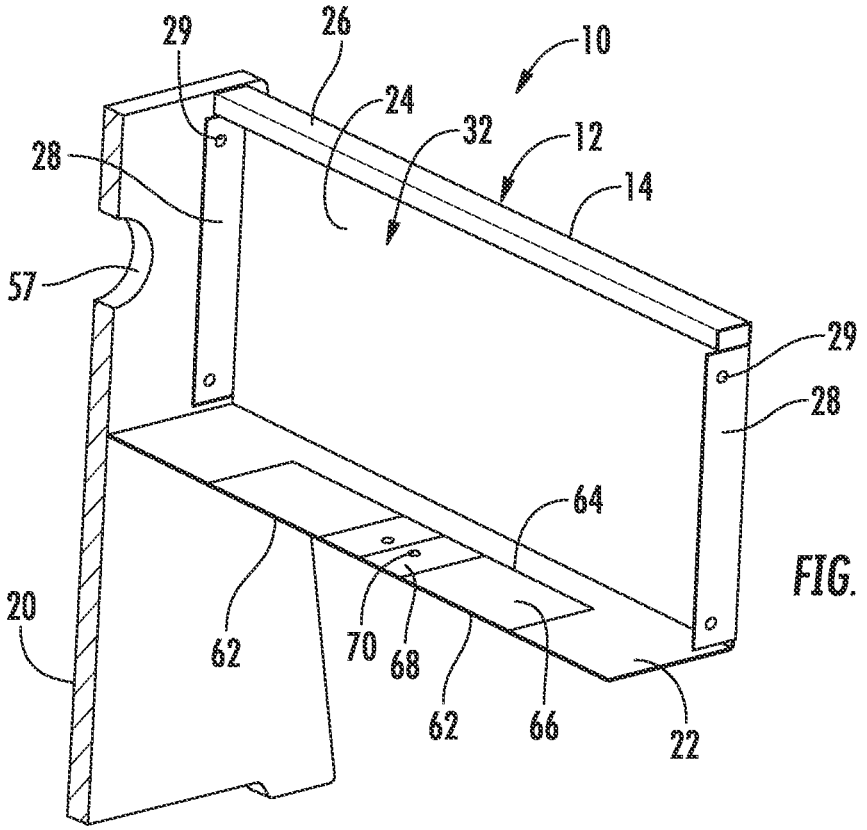
FIG. 16 is a cross-sectional perspective view of the beam member of the furniture system in the configuration as shown in FIG. 14 including a divider and power block supporting portion shown in a first position.
Figure 17:
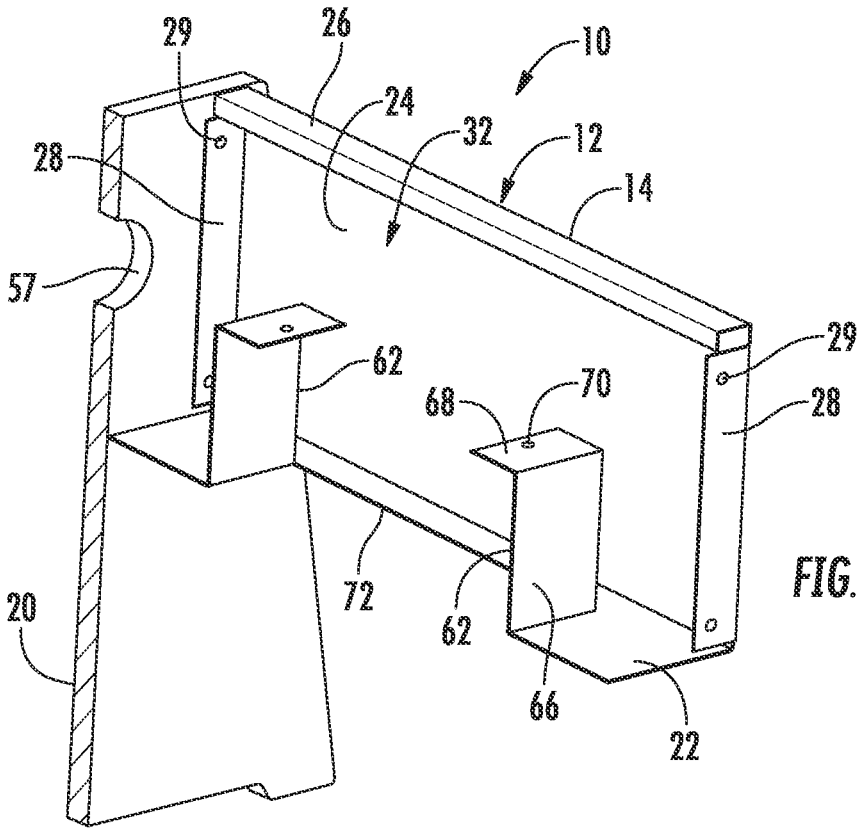
FIG. 17 is a cross-sectional perspective view of the beam member of the furniture system in the configuration as shown in FIG. 14 including a divider and power block supporting portion shown in a second position.
Figure 36:
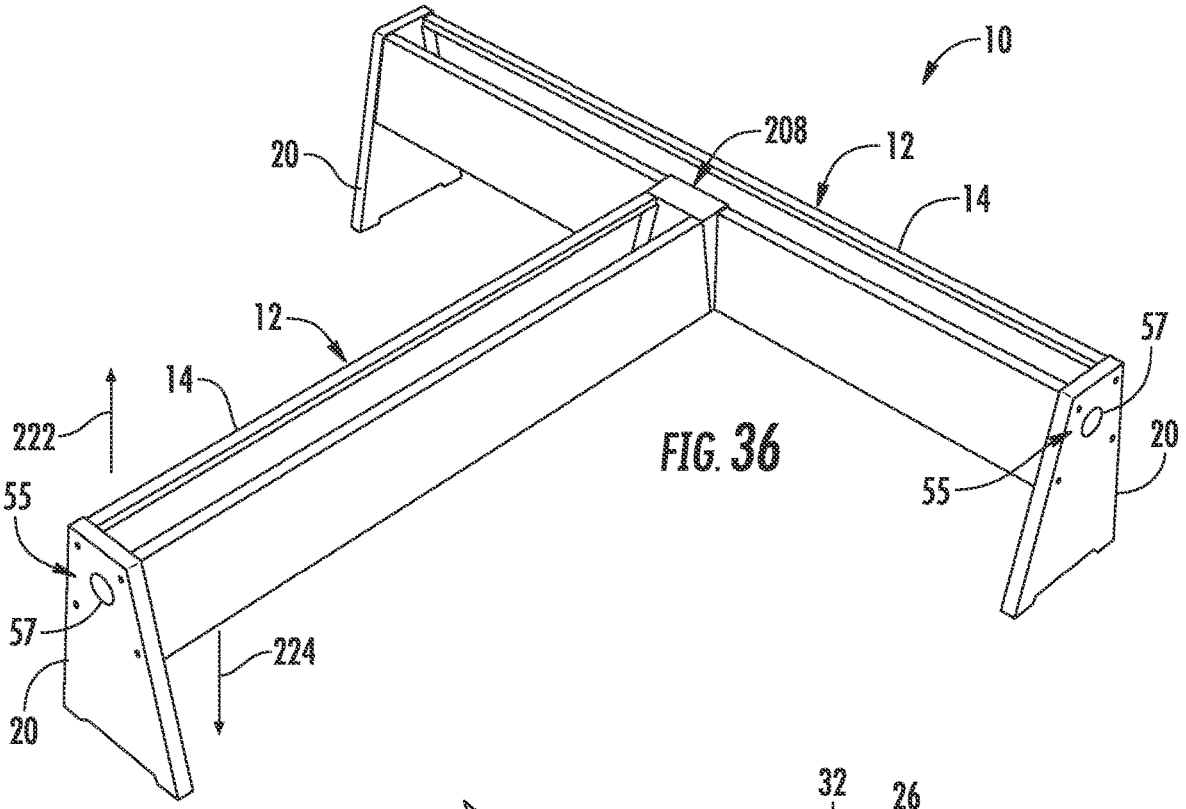
FIG. 36 is a perspective view of the furniture system including a first beam member supporting a second beam member along the length of the first beam member.
Figure 37:
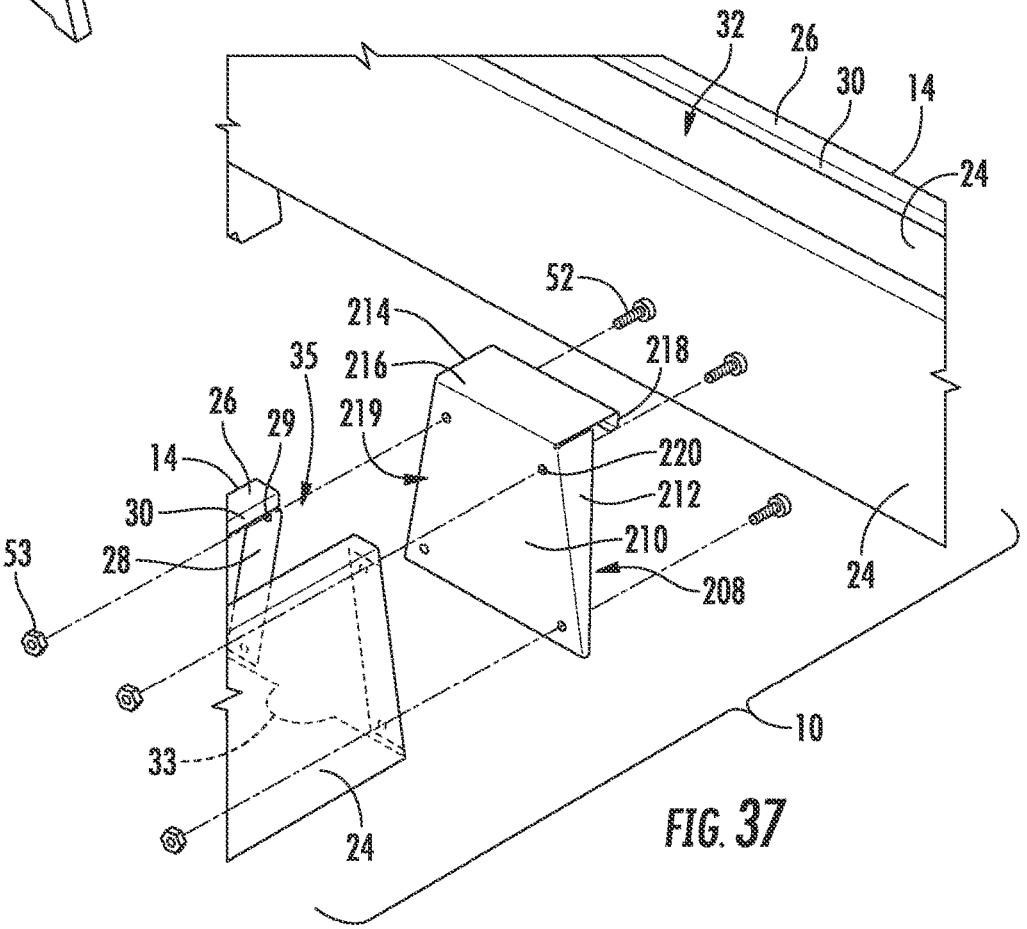
FIG. 37 is an exploded, partial perspective view of the furniture system in the configuration as shown in FIG. 36.

The furniture system 10 (FIGS. 36 and 37) may also include one of the beam members 14, or a first beam member attached along the length of another beam members 14, or a second beam member, via a mid-length support bracket 208. In the illustrated example, the support bracket 208 includes a body portion 210, a pair of angular side walls 212 extending orthogonally from the body portion 210, and a connector portion 214 including a top wall 216 extending orthogonally from the body portion 210 and an L-shaped flange portion 218 extending downwardly from the top wall 216. The body portion 210 includes a connection arrangement 219 that is substantially identical to the first and second connection arrangements 35 and 55, where the connection arrangement 219 includes a plurality of apertures 220 spaced in a pattern that is substantially identical to the first and second patterns. In assembly, the support bracket 208 is secured to the second beam member 14 by mechanical fasteners that include bolts 52, where each bolt 52 extends through one of the apertures 220 of the support bracket 208 and through a corresponding and aligned aperture 29 of one of the flanges 28 of the beam 14, and is threadably received and coupled to a corresponding nut 53. The support bracket 208 is then attached along the length of the first beam members 14 by moving the second beam member 14 in an upward direction 222, placing the L-shaped flange portion 218 of the support bracket 208 over one of the top walls 26 and the corresponding flange 30 of the first beam member 14, and then lowering the second beam member 14 as attached to the support bracket 208 in a downward direction 224 until the connector portion 214 of the support bracket 208 engages the beam member 14 along the length thereof. Wires may be routed beneath and between the first and second beam members 14 via the recess 33 and the aperture 72 (FIGS. 14 and 17).

Figure 38:
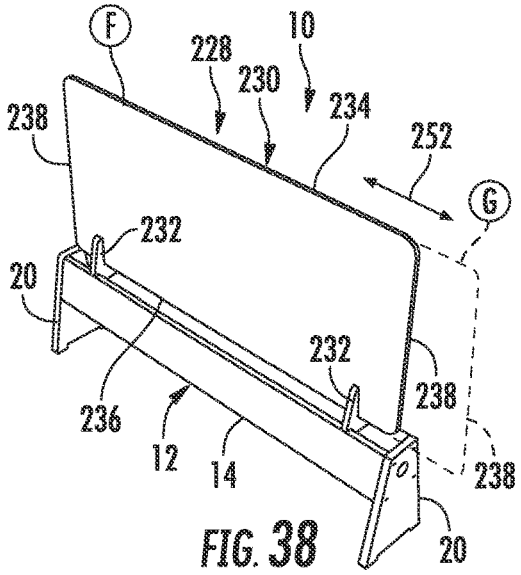
FIG. 38 is a perspective view of the furniture system including the beam arrangement supporting a screen assembly where a screen member of the screen assembly is shown in a retracted position in solid line and an extended position in dashed line.
Figure 39:
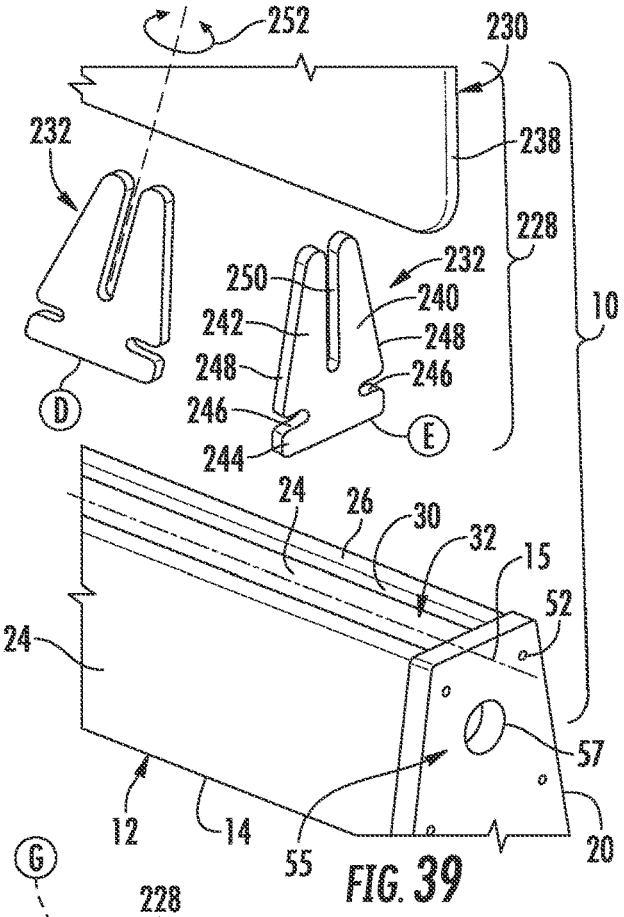
FIG. 39 is an exploded, partial perspective view of the furniture system in the configuration as shown in FIG. 38 including support members shown in a first position and a second position.

The furniture system 10 (FIGS. 38 and 39) may also include a screen assembly 228 supported by the beam member 14. The screen assembly 228 may include a screen member 230 supported by a pair of support members 232. The screen member 230 includes a top edge 234, a bottom edge 236 and a pair of side edges 238. In the illustrated example, the screen member 230 is provided as a privacy screen, although other configurations of the screen member 230 may also be provided, including acoustical panels, utility wall arrangements such as slat walls and pegboards, white boards, and/or magnetic boards.

Figure 40:
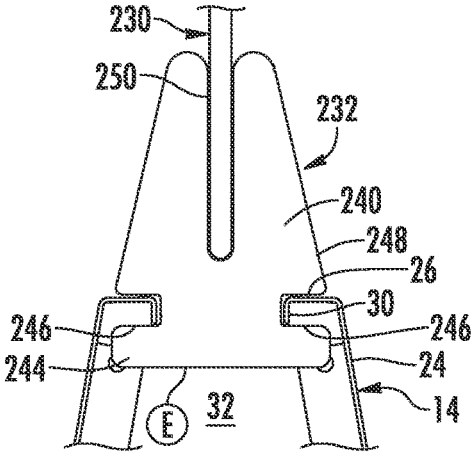
FIG. 40 is a partial, cross-sectional end view of the furniture system in the configuration shown in FIG. 38.

Each support member 232 (FIGS. 39 and 40) may include a body portion 240 having a generally trapezoidal shape that continues the cross-sectional contours of the beam member 14. The body portion 240 may include an upper portion 242 divided from a lower portion 244 by a pair of reliefs or slots 246 that extend inwardly from respective side edges 248. The upper portion 242 includes an upwardly-opening, vertically-extending relief or slot 250. In assembly, each support member 232 is moved to a first orientation D where the body portion 240 is substantially aligned with the longitudinal axis 15 of the beam member 14 such that at least the lower portion 244 of the body portion 240 may be inserted into the channel 32. The support member 232 is then rotated either clockwise or counterclockwise in the directions 252 from the first orientation D to a second orientation E where the top wall 26 and the flanges 30 of the beam member 14 are received within the slots 246 of the support member 232. The screen member 230 is then vertically aligned with and inserted into the slot 250 of each of the support members 232, thereby preventing each of the support members 232 from rotating from the second orientation E to the first orientation or position D and being disengaged from the beam member 14. In one embodiment, the bottom edge of the screen member 230 may slidably and frictionally engage the slot 250 of each of the support members 232, and may be movable between a first position F, where at least one of the side edges 238 does not extend beyond an end of the beam member 14, and a second or extended position G where one of the side edges 238 of the screen member 230 extends beyond one of the ends of the beam member 14.

Figure 41:
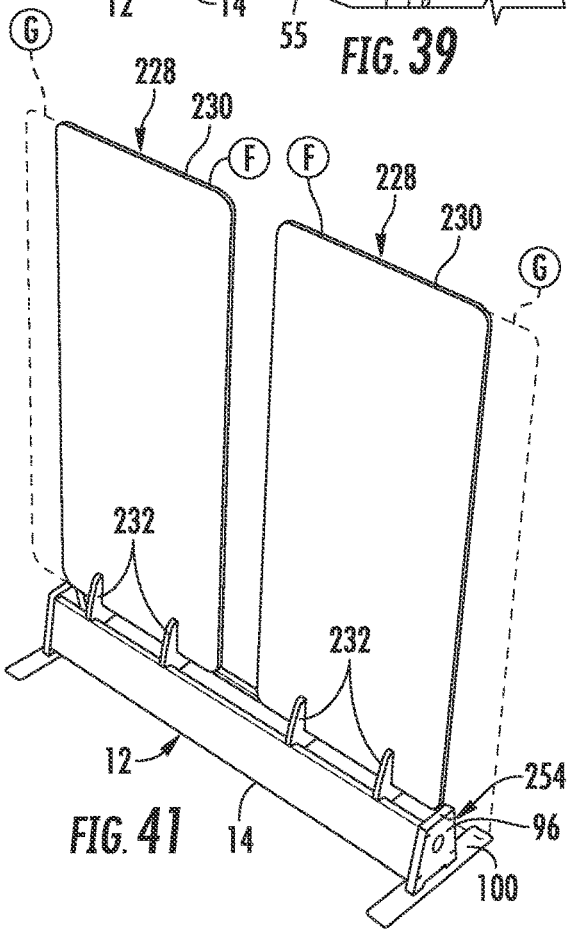
FIG. 41 is a perspective view of the furniture system including the beam arrangement supporting a pair of screen assemblies where each of the screen assemblies are shown in a retracted position in solid line and an extended position in dashed line.
Figure 40A:
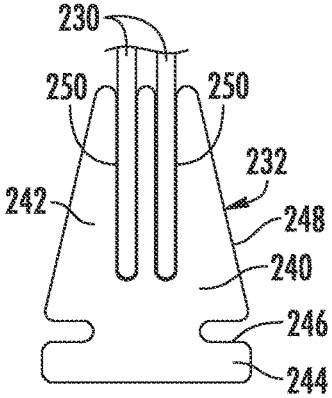
FIG. 40A is an end view of an alternative embodiment of a support member supporting multiple screen members located therein.

A single beam arrangement 12 (FIG. 41) may be utilized to support multiple screen assemblies 228. It is noted that in the illustrated example, the beam member 14 is supported by a leg assembly 254 that includes a reduced-height leg 96 and an outrigger portion 100 similar to those previously described. The support members 232 (FIG. 40A) may each be provided with a pair of upwardly-opening slots 250 that support separate panels 230 laterally spaced from one another. Such an arrangement allows differently configured panels to simultaneously be supported from the support members 232, and further may allow each panel 230 to move separately with respect to the support members 232 and supporting beam member 14, as well as relative to one another.

Figure 42:
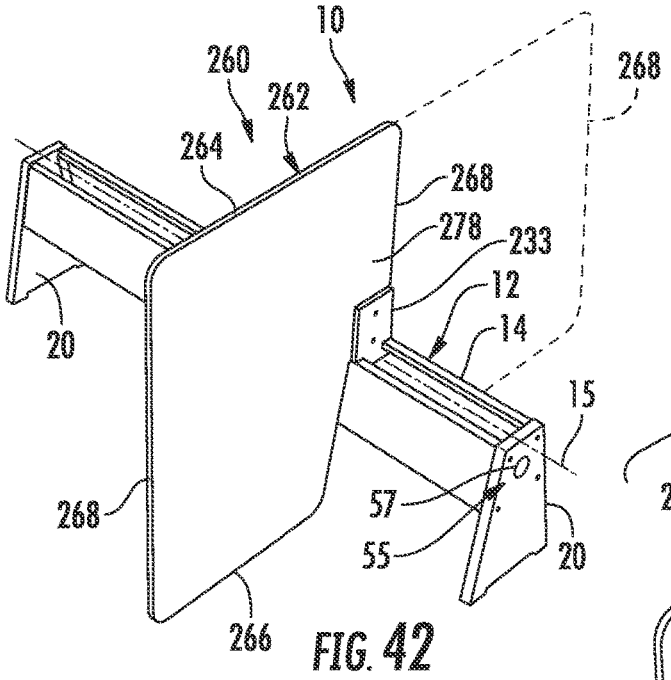
FIG. 42 is a perspective view of the furniture system including the beam arrangement supporting a screen assembly extending orthogonally from the beam member of the beam arrangement.
Figure 43:
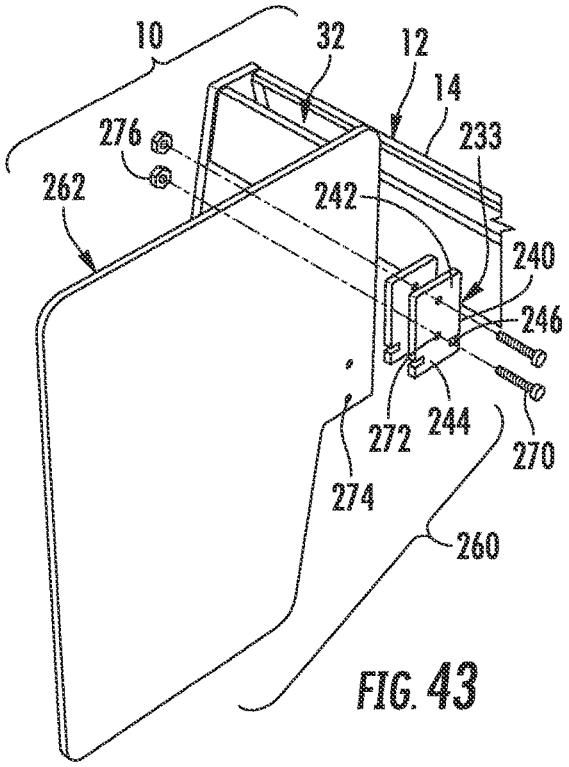
FIG. 43 is an exploded, partial perspective view of the furniture system in the configuration shown in FIG. 42.

The furniture system 10 (FIGS. 42 and 43) may also include a partition assembly 260 supported by the beam arrangement 12 such that the partition assembly 260 extends in a direction generally orthogonally from the longitudinal axis 15 of the beam member 14. In the illustrated example, the partition assembly 260 includes a panel member 262 having a top edge 264, a bottom edge 266, and a pair of side edges 268. The panel member 262 may include a privacy screen or panel, a utility panel such as a slat wall, an acoustical panel, a pegboard, a whiteboard and/or a magnetic board. The panel member 262 may extend asymmetrically from the beam member 14 in a single direction, or, as illustrated in dashed line, the panel member 262 may extend substantially symmetrically from the beam member 14. The partition assembly 260 further includes a pair of support members 233 configured similarly to the previously described support members 232, and positioned within the channel 32 of the beam member 14 in a similar manner to that as previously described with respect to the support members 232 and the beam member 14. Subsequent to positioning the support members 233 within the channel 32 of the beam member 14, the panel member 262 is positioned between the support members 233. The panel member 262 is attached to the support members 233 by mechanical fasteners, such as bolts 270 that extend through corresponding apertures 272 of one of the support members 233, through corresponding and aligned apertures 274 of the panel member 262, through corresponding and aligned apertures 272 of the other of the support members 233, and that are threadably received within corresponding nuts 276. In the illustrated example, the panel member 262 is configured such that a portion 278 of the panel member 262 extends directly vertically above the beam member 14, while the bottom edge 266 of the panel member 262 abuts the floor surface.

Figure 44:
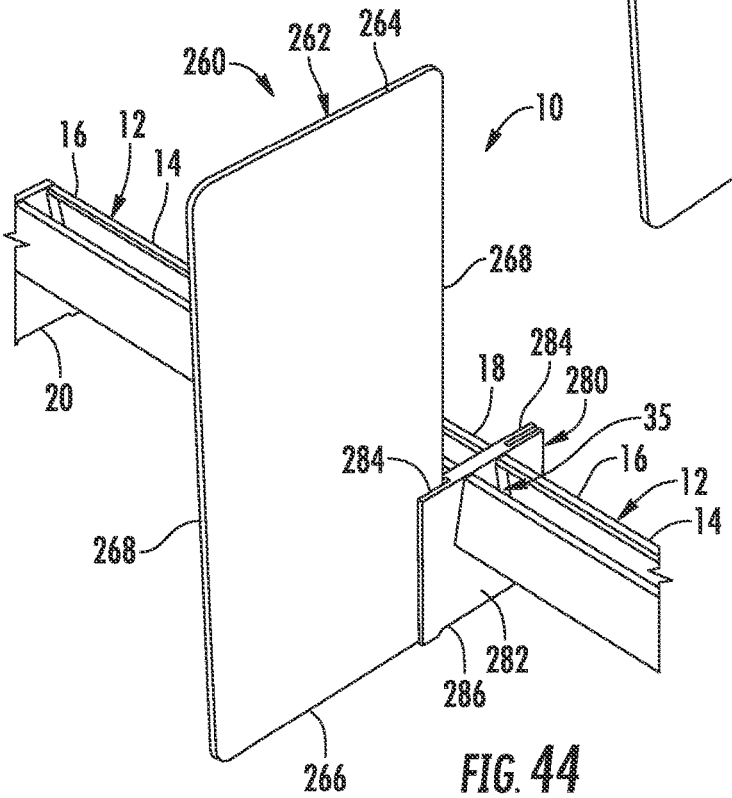
FIG. 44 is a perspective view of another alternative embodiment of the screen assembly supporting a pair of beam members.

The furniture system 10 (FIG. 44) may also include a partition supporting leg 280 that supports the proximate end 18 of one of a pair of beam members 14, the distal end 16 of the other beam member 14 of the pair of beam members, and a panel member 262. In the illustrated example, the panel member 262 includes a top edge 264, a bottom edge 266, and a pair of side edges 268. The partition-supporting leg 280 includes a body portion 282 having a connection arrangement (not shown) substantially identical to the first connecting arrangement 35, a pair of sidewardly-opening, vertically-extending slots 284, and a bottom end 286 configured to abut a floor surface. In assembly, one of side edges 268 of the panel member 262 is inserted into one of the slots 284 of the partition-supporting leg 280. The panel member 262 is illustrated as being frictionally held within the corresponding slot 284, however, other connection arrangements may be utilized such as mechanical fasteners (not shown). In the illustrated example, the partition assembly 260 is configured such that the bottom edge 266 of the panel member 262 abuts the supporting floor surface.

Figure 46:
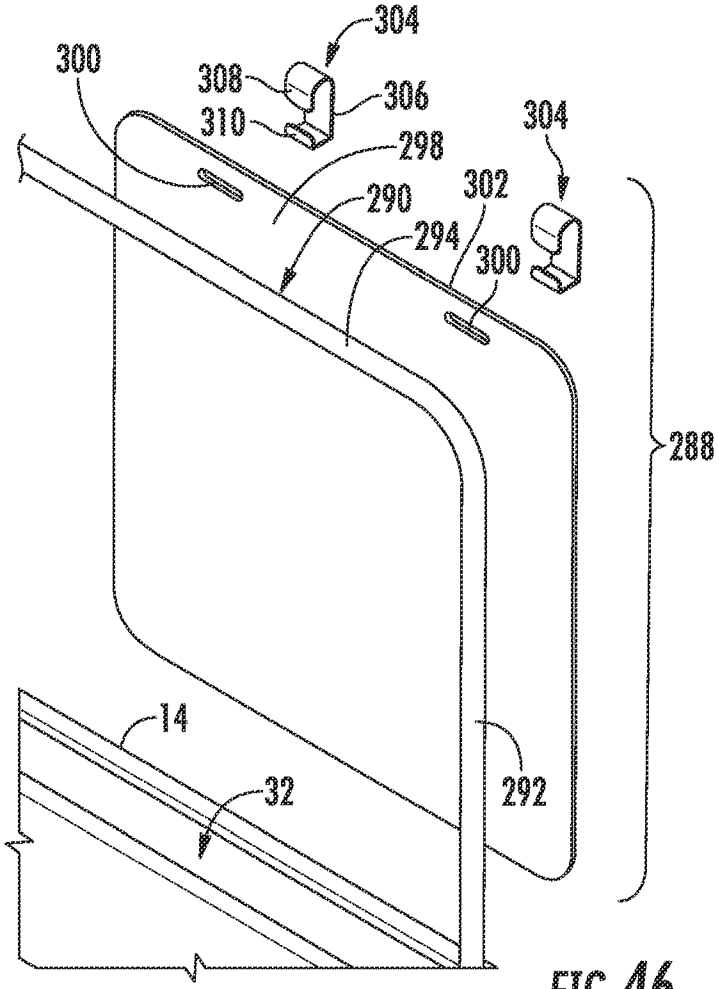
FIG. 46 is an exploded, partial perspective view of the hanging screen assembly in the configuration shown in FIG. 45.
Figure 45:
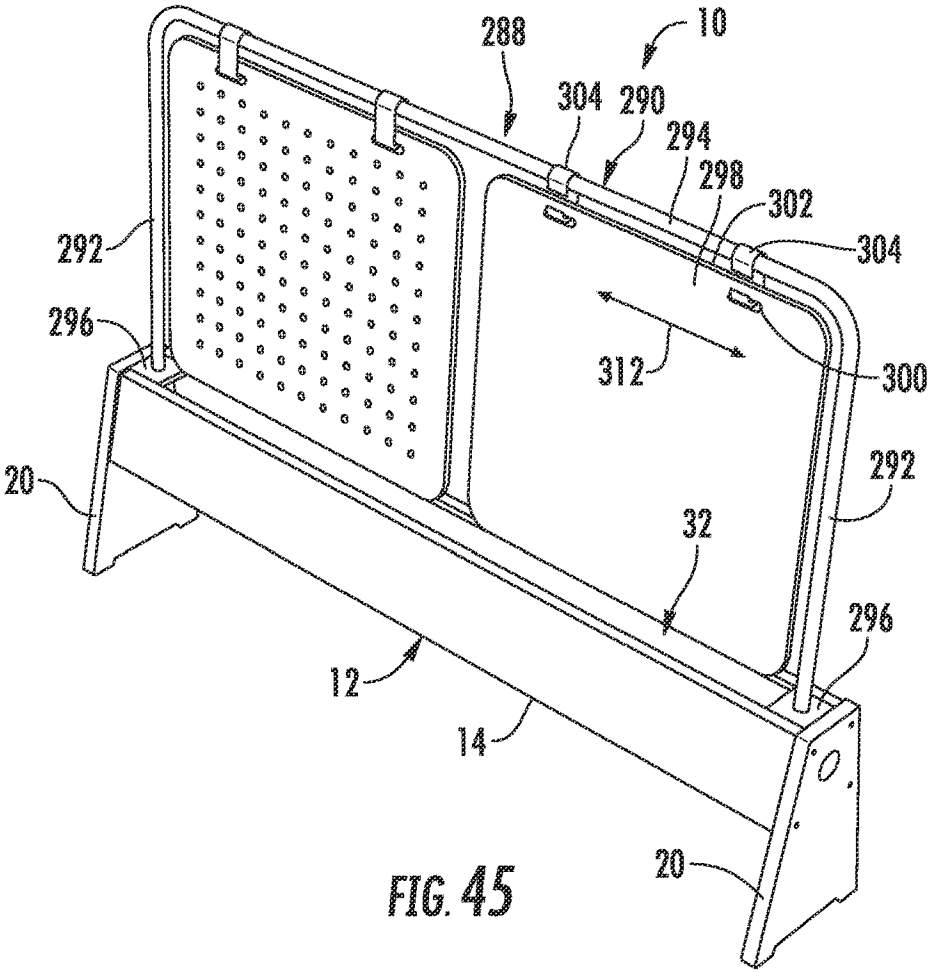
FIG. 45 is a perspective view of the furniture system that includes the beam member supporting a hanging screen assembly.
Figure 51:
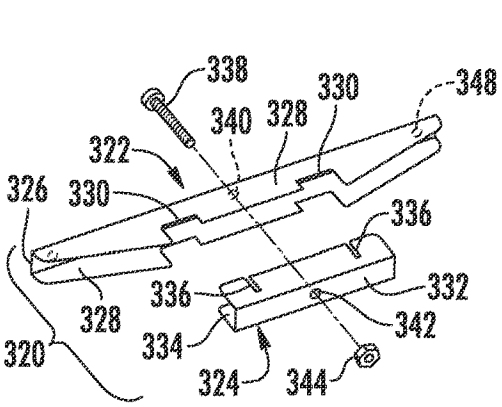
FIG. 51 is an exploded perspective view of a clamping assembly of the furniture system in the configurations shown in FIGS. 47-50.
Figure 52:
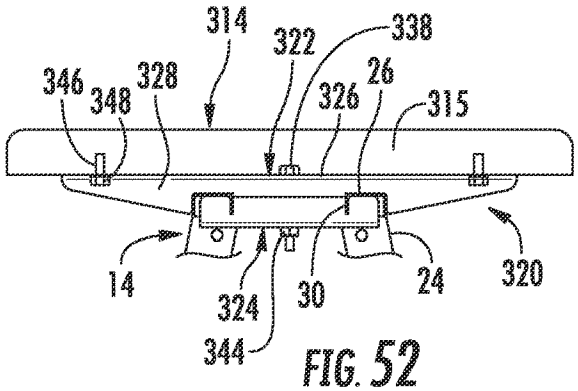
FIG. 52 is a cross-sectional end view of the furniture system in the configuration shown in FIG. 47 taken along the line LII-LII, FIG. 47.
Figure 49:
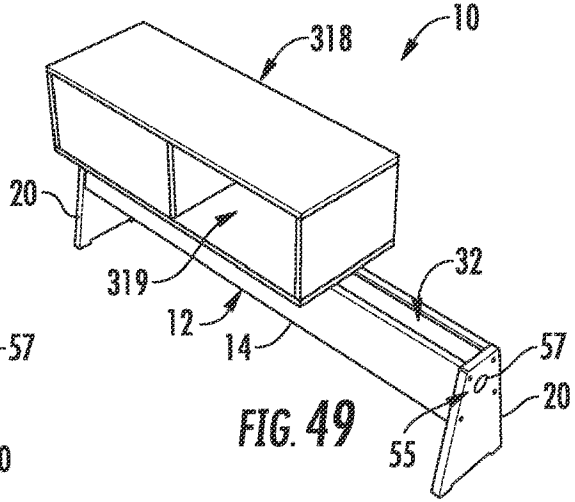
FIG. 49 is a perspective view of the furniture system as shown in FIG. 47, where the beam member supports a storage arrangement.
Figure 50:
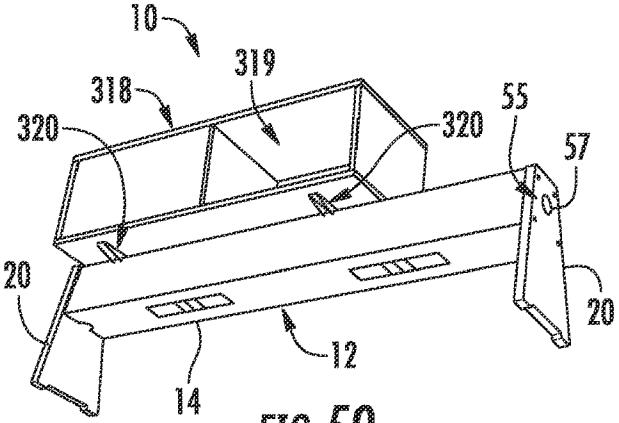
FIG. 50 is a bottom perspective view of the furniture system in the configuration shown in FIG. 49.

The furniture system 10 (FIGS. 45 and 46) may also include a hanging screen assembly 288 supported from the beam member 14. The hanging screen assembly 288 may include a tubular support member 290 including a pair of vertically-extending side portions 292, and an upper portion 294 extending horizontally between the side portions 292. The support member 290 may further include a pair of mounts 296 fixed to the bottom ends of the side portions 292 and received within the channel 32 of the beam member 14. The hanging screen assembly 288 may further include a pair of screen members 298 each having a pair of apertures or slots 300 located proximate an upper edge 302 of the associated screen member 298. The screen assembly 288 may further include a pair of brackets 304 supporting each of the screen members 298, where the brackets 304 engage the upper portion 294 of the support member 290 and the slots 300 of the screen member 298. In the illustrated example, each bracket 304 includes a body portion 306, a downwardly-opening top hook portion 308, and an upwardly-opening bottom hook portion 310.

In assembly, the bottom hook portion 310 is inserted into a corresponding slot 300 of one of the screen members 298, and the top hook portion 308 is placed over the upper portion 294 of the support member 290. The top hook portion 308 of each of the brackets 304 is configured such that the screen member 298 may be moved horizontally in the directions 312 with respect to the support member 290 and the beam arrangement 12. The screen member 290 may be provided as a privacy screen member, a utility screen member such as a slat wall or a pegboard, a whiteboard and/or a magnetic board. Further, single or multiple screen members 290 may be supported from a single support member 290 and a single beam member 14.

The furniture system 10 (FIGS. 47-50) may also include various work accessories supported from the beam member 14, such as seating arrangements 314 that include cushioned seat members 315, worksurface arrangements 316, and variously configured storage arrangements 318 defining interior storage spaces 319. Each of the work accessories, including the seating arrangements 314, the worksurface arrangement 316 and the storage arrangements 318, are supported by multiple support bracket assemblies 320 (FIGS. 48 and 50-52) where each support bracket assembly 320 includes an upper support bracket 322 and a lower support bracket 324. The upper support bracket 322 includes an upper support wall 326, and a pair of side flanges 328 each extending orthogonally downward from the upper support wall 326. Each side flange 328 includes a pair of downwardly-opening reliefs or notches 330 spaced along the bottom edge of the associated side flange 328. Each lower support bracket 324 includes a bottom wall 332 and a pair of side flanges 334 extending orthogonally upward from the bottom wall 332. Each side flange 334 includes a pair of upwardly-opening reliefs or notches 336 spaced along a length of an upper edge of each of the side flanges 334.

In assembly, the lower support bracket 324 is positioned within the channel 32 of the beam member 14 and aligned with the beam member 14 such that the flanges 30 of the beam member 14 are received within the reliefs 336 of the lower support bracket 324. The upper support bracket 322 is positioned over the lower support bracket 324 and with respect to the beam member 14 such that the top walls 26, the flanges 30 and an upper portion of the side walls 24 are received within the reliefs 330 of the upper support bracket 322. The upper support bracket 322 and the lower support bracket 324 are secured to one another via a mechanical fasteners such as a bolt 338 that is received through an aperture 340 extending through the upper support wall 326 of the upper support bracket 322, through an aperture 342 extending through the bottom wall 332 of the lower support bracket 324, and threadably received and connected to a nut 344. The bolt 338 and nut 344 combination are tightened such that the top walls 26 and flanges 30 of the beam member 14 are clamped and secured between the upper support bracket 322 and the lower support bracket 324. The work accessory, such as the seating arrangement 314, the worksurface arrangement 316 and/or the storage arrangements 318 are secured to the upper support bracket 322 via a plurality of mechanical fasteners 346, such as screws or bolts, that extend through apertures 348 of the upper support bracket 322 and are threadably received by the work accessory or a corresponding nut (not shown).

Figure 55:
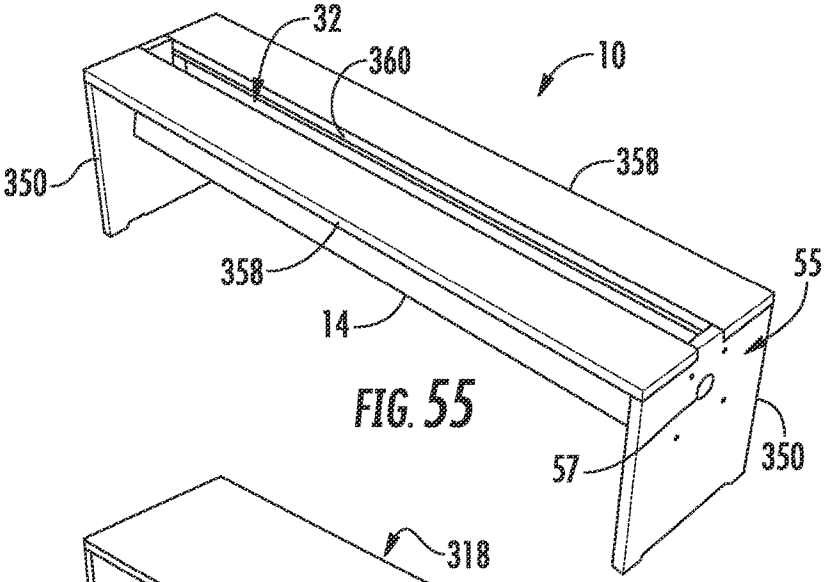
FIG. 55 is a perspective view of the furniture system including the beam member supporting a pair of worksurfaces that define a beam-accessing gap therebetween.
Figure 56:
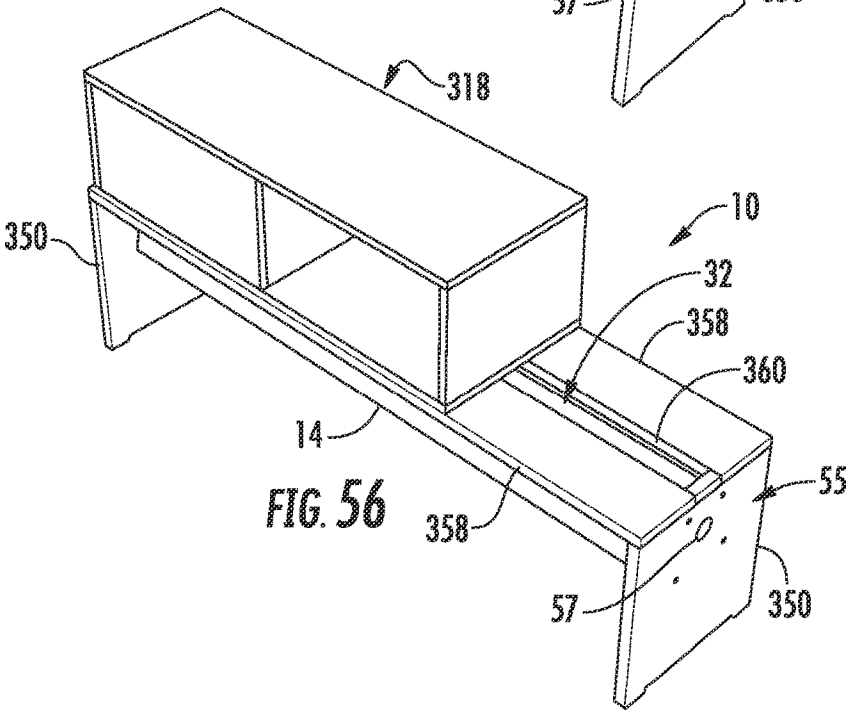
FIG. 56 is a perspective view of the furniture system in the configuration shown in FIG. 55 supporting a storage arrangement.
Figure 53:
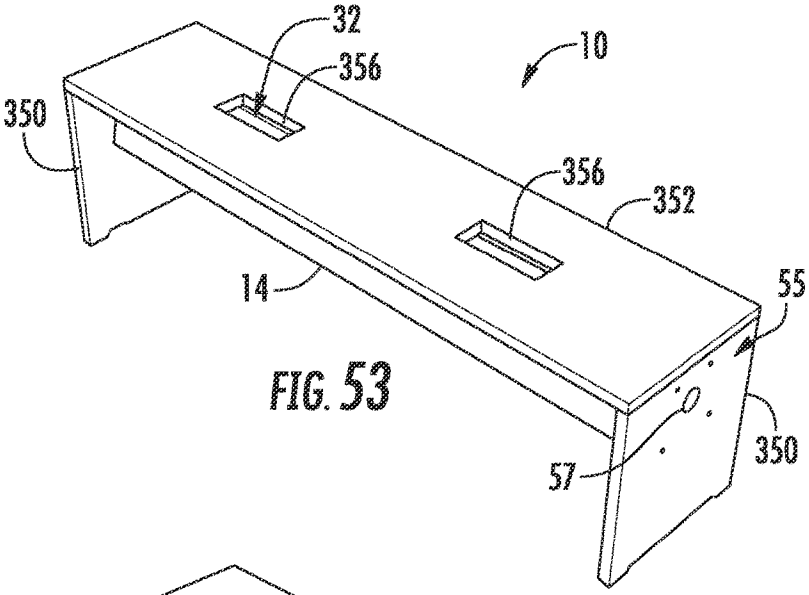
FIG. 53 is a perspective view of the furniture system including the beam member supporting a worksurface that includes beam-accessing apertures spaced therealong.
Figure 54:
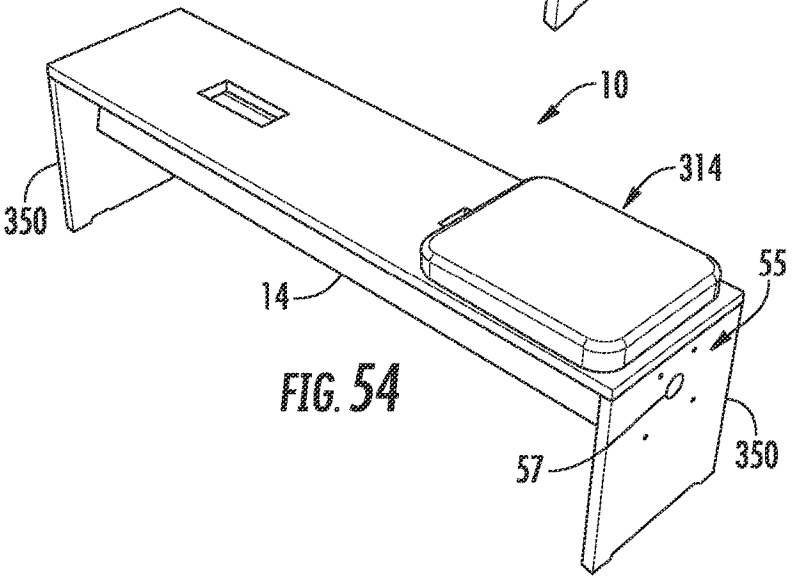
FIG. 54 is a perspective view of the furniture system in the configuration shown in FIG. 53 supporting a seating arrangement thereon.

The furniture system 10 (FIGS. 53 and 54) may include a pair of planar leg members 350 that support the beam member 14. In the illustrated example, the furniture system 10 includes a worksurface 352 that includes a plurality of upwardly-opening apertures 356 configured to allow access through the worksurface 352 and into the channel 32 of the beam member 14. It is noted that the leg members 350 have a width that is substantially similar to the depth of the worksurface 354. Alternatively, a furniture system 10 (FIGS. 55 and 56) may include a pair of longitudinally-extending worksurfaces 358 in place of the single worksurface 354, where the worksurfaces 358 are spaced from one another so as to provide a gap 360 therebetween providing access to the channel 32 of the beam member 14. As best illustrated in FIGS. 54 and 56, the furniture system 10 may be utilized to support or incorporate work accessories, such as seating arrangements 314 and storage arrangements 318 from the worksurfaces 354, 358. It is noted that the work accessories may be either fixedly coupled to the beam member 14 and/or the worksurfaces 354, 358, or alternatively loosely supported atop the worksurfaces 354, 358.

Figure 58:
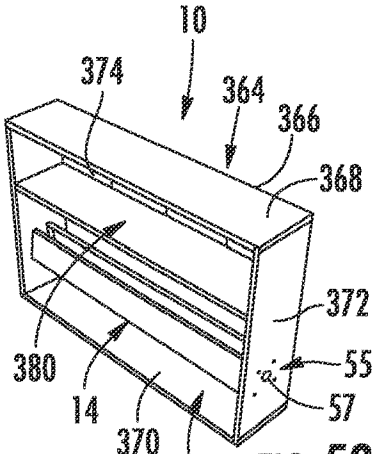
FIG. 58 is a perspective view of the furniture system in the configuration shown in FIG. 57 with doors removed therefrom to show the interior thereof.
Figure 57:
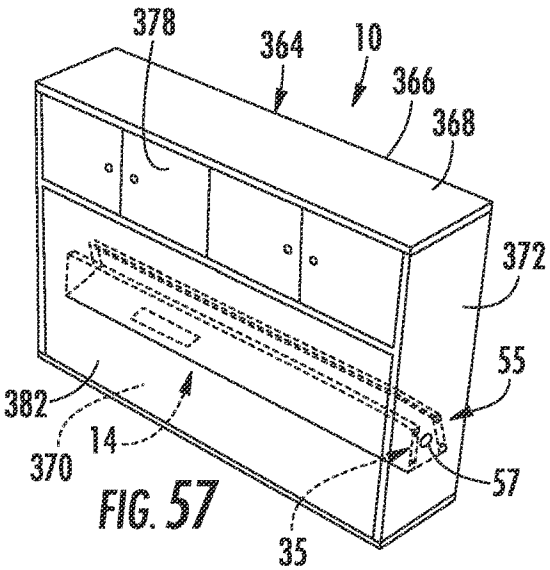
FIG. 57 is a perspective view of the furniture system that includes the beam member supported within a storage arrangement.

The furniture system 10 (FIGS. 57 and 58) may also include the beam member 14 supported within a storage assembly 364. In the illustrated example, an interior storage space 362 of the storage assembly 364 houses and supports the beam member 14. The storage assembly 364 may include a housing assembly 366 that includes a top wall 368, a bottom wall 370, a pair of side walls 372 and a rear wall 374. The side walls 372 may each include the second connection arrangement 55. The storage assembly 364 may also include a plurality of doors 378 providing access to an upper portion 380 of the interior storage space 362, and a lower door 382 providing access to the beam member 14. The storage assembly 364 may also be utilized without the doors 378 being installed.

Figure 59:
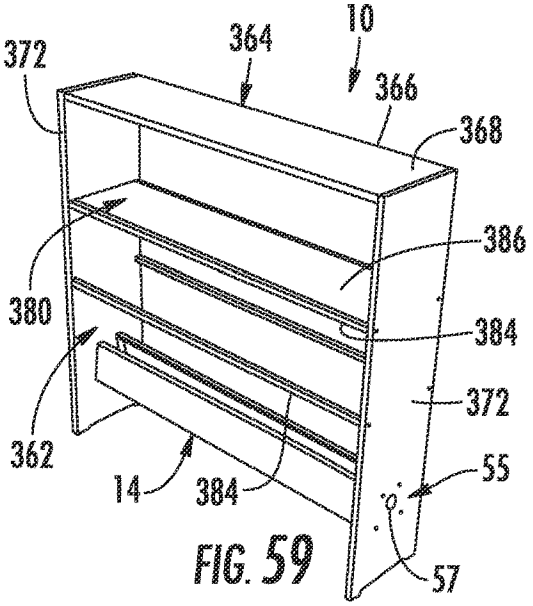
FIG. 59 is a perspective view of an alternative embodiment of the storage assembly that includes the beam member supported therein.

The storage assembly 364 (FIG. 59) may also include a plurality of crossbars or frame members 384 extending between the side walls 372. The crossbars 384 may be configured to support a shelf unit 386 and/or may be utilized to support hanging garments.

Figure 61:
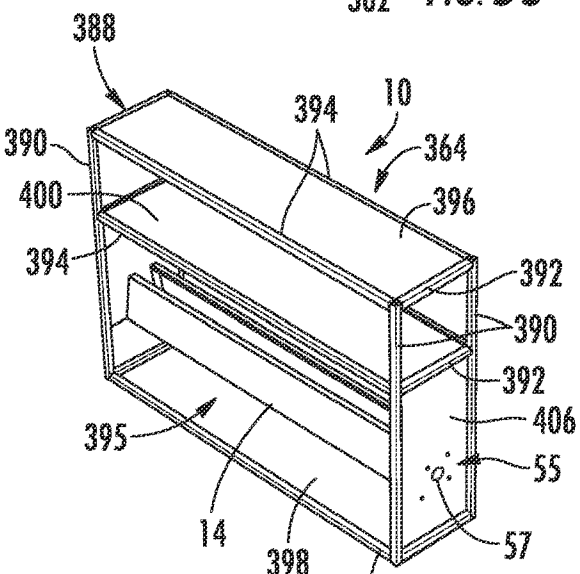
FIG. 61 is a perspective view of yet another alternative embodiment of the storage assembly that includes the beam member supported therein.
Figure 60:
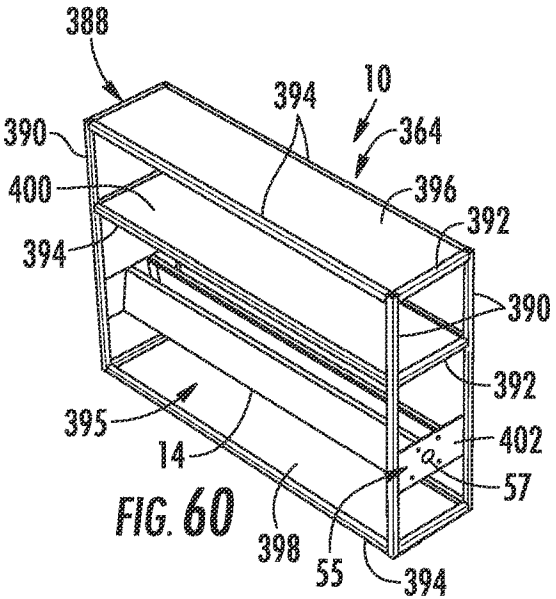
FIG. 60 is a perspective view of another alternative embodiment of the storage assembly that includes the beam member supported therein.

The storage assembly 364 (FIGS. 60 and 61) of the furniture system 10 may also include a frame assembly 388 that includes a plurality of interconnected frame members, including vertical frame members 390, horizontally-extending lateral frame members 392, and horizontally-extending longitudinal frame members 394, where the frame members 390, 392, 394 cooperate to define an interior storage space 395. The lateral frame members 392 and the longitudinal frame members 394 may cooperate to support horizontal upper panels 396, horizontal lower panels 398 and/or horizontal intermediate panels 400, where the intermediate panels 400 bifurcate the interior storage space 395. The beam member 14 may be supported by a pair of end plates 402 that extend between and are fixed to a pair of the vertical frame members 390, where each of the end plates 402 includes the second connection arrangement 55. Alternatively, the end plate 402 may be replaced with a panel member 406 (FIG. 61), where the panel member 406 includes the second connection arrangement 55.

Figure 47:
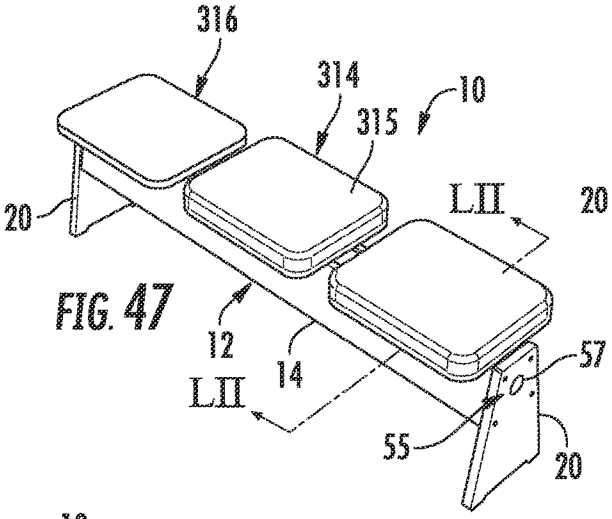
FIG. 47 is a perspective view of the furniture system including a beam member supporting a plurality of seating arrangements and a worksurface arrangement.
Figure 48:
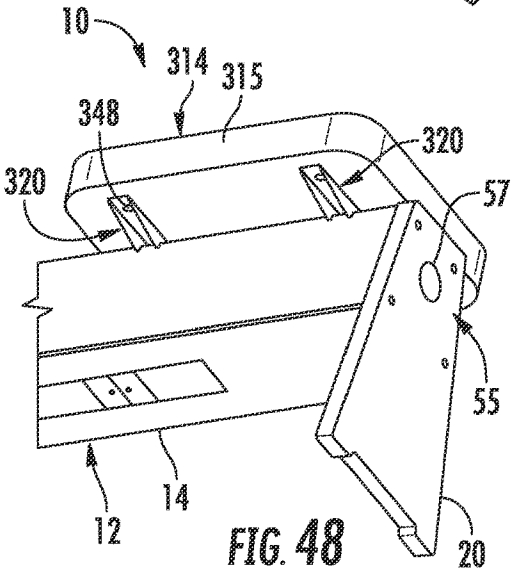
FIG. 48 is a partial, bottom perspective view of the furniture system in the configuration shown in FIG. 47.
Figure 62:
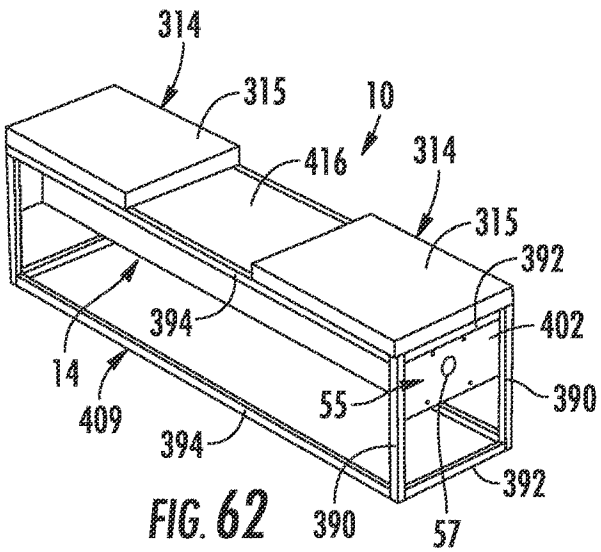
FIG. 62 is a perspective view of an embodiment of the furniture system that includes a short-frame assembly or bench-frame assembly supporting a beam member therein that supports seating arrangements thereon.

The furniture system 10 (FIG. 62), may also include a frame assembly 409 utilized to support a plurality the seating arrangements 314 and the worksurface 316 (FIG. 47). In the illustrated example, the furniture system 10 includes the vertical frame members 390, the horizontally-extending lateral frame members 392, and the horizontally-extending longitudinal frame members 394, where the beam member 14 is supported by the end plates 402 which are in turn supported by the vertical frame members 390. Each end plate 402 may include the second connection arrangement 55. Each of the seating arrangements 314 include the seat members 315 which are supported above the beam member 14 by a top horizontal panel 416, and may be secured to the beam member 14 by a support bracket assembly 320 as previously described, and/or alternatively loosely supported on the panel 416.

Figure 63:
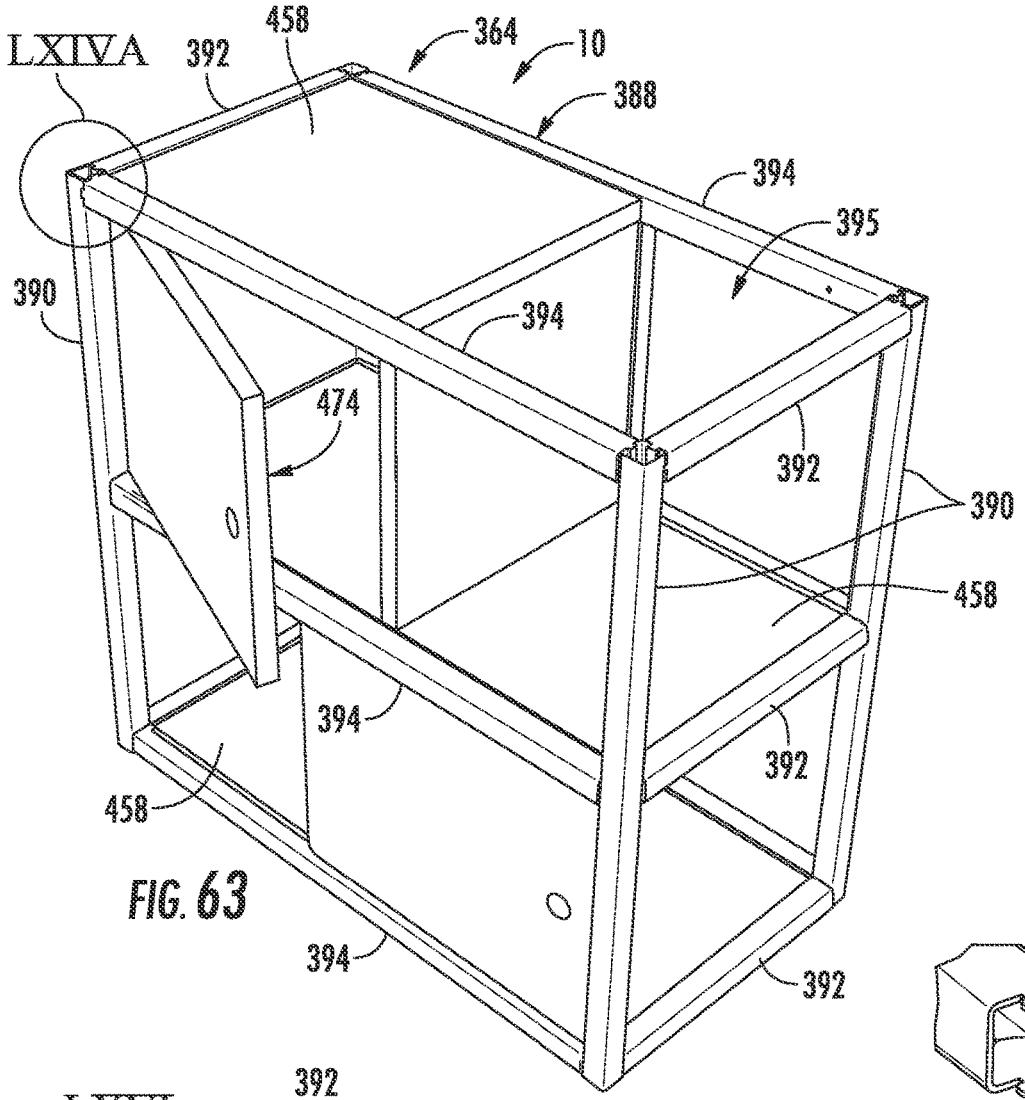
FIG. 63 is a top perspective view of the storage assembly that includes a plurality of connected frame members.
Figure 64C:
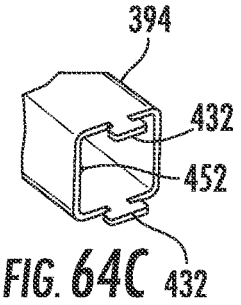
FIG. 64C is a partial perspective view of an end of a frame member.
Figure 64A:
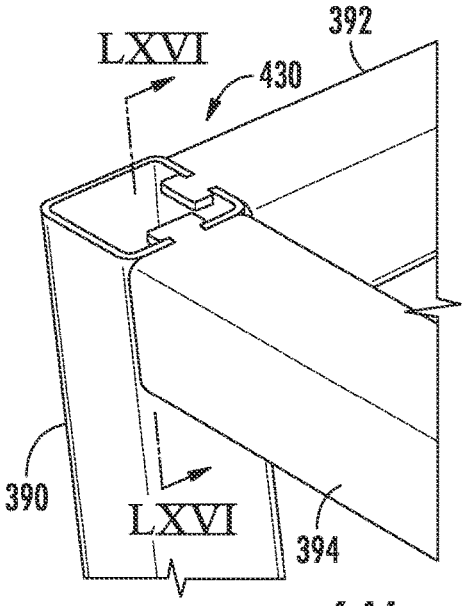
FIG. 64A is an enlarged perspective view of the area LXIVA, FIG. 63.
Figure 64B:
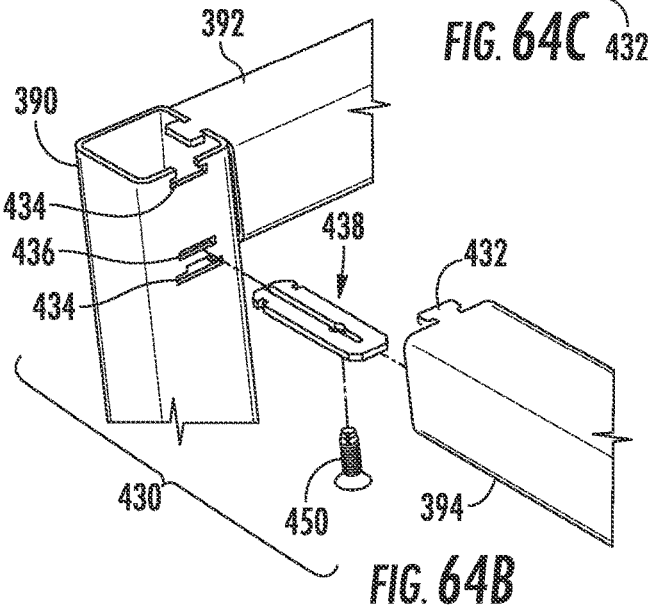
FIG. 64B is an exploded perspective view of a connection arrangement connecting the frame members of the storage assembly in the configuration shown in FIG. 63.
Figure 65A:
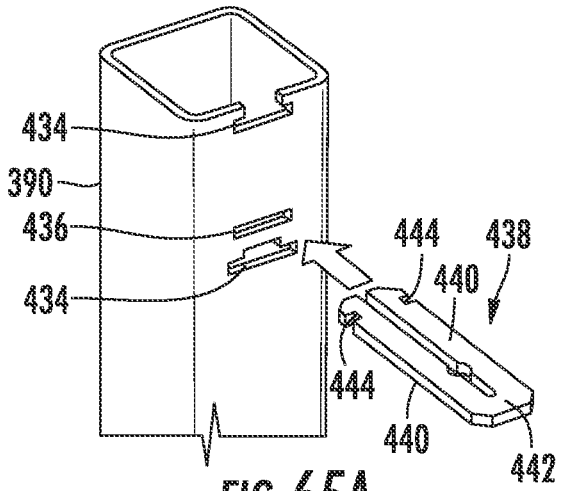
FIGS. 65A-65D are perspective views of the steps of coupling a pair of the frame members of the frame assembly of FIG. 63 via the connection arrangement.
Figure 65B:
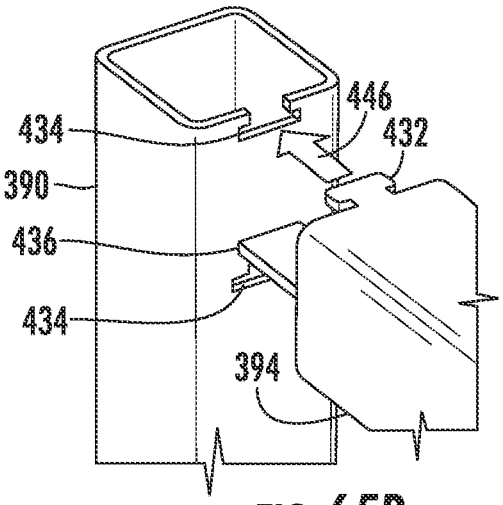
Figure 65C:
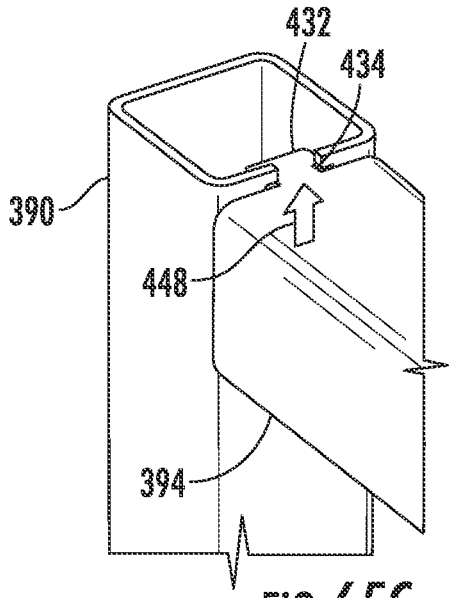
Figure 65D:
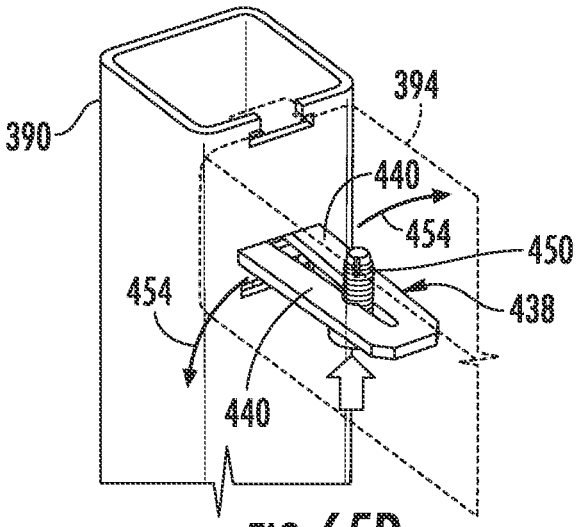
Figure 66:
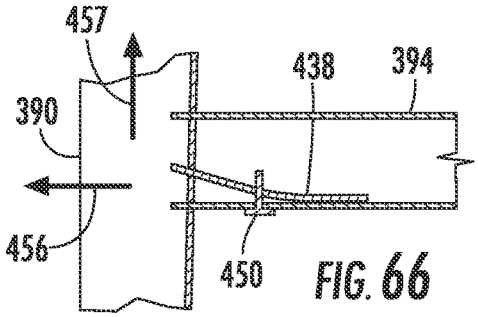
FIG. 66 is a cross-sectional view of the connection arrangement taken along the line LXVI-LXVI, FIG. 64.

As best illustrated in FIG. 63, the lateral frame members 392 and/or the longitudinal frame members 394 may be coupled to the vertical frame members 390 of the frame assembly 388 via a connection arrangement 430 (FIGS. 64A and 64B). The frame assembly 388 may or may not support a beam member 14 therein. Alternatively, the lateral frame members 392 may be fixedly secured to the vertical frame members 390 via welding to form two, single-piece constructions, which are then attached to one another via the longitudinal frame members 394 and the associated connection arrangements 430. In the illustrated example, each connection arrangement 430 includes a pair of horizontally oriented, T-shaped tabs 432 (FIG. 64C) extending from an end of the longitudinal frame member 394. Each vertical frame member 390 includes a corresponding pair of inverted, T-shaped slots 434. The vertical frame member 390 further includes an elongated slot 436 spaced between the T-shaped slots 434. Each connection arrangement 430 further includes a U-shaped locking member 438 (FIG. 65A) including a pair of arms 440 connected to a common base portion 442 at a proximate end, and each including an outwardly-opening relief or notch 444 at a distal end. As best illustrated in FIGS. 65A-65D, the longitudinal frame member 394 is connected with one of the vertical frame members 390 by inserting the locking member 438 into the slot 436 of the vertical frame member 390 such that the reliefs 444 are aligned with the edges of the slot 436. The longitudinal frame member 394 is placed over the locking member 438 and moved in a direction 446 until the T-shaped tabs 432 are received within the corresponding T-shaped slots 434. The longitudinal frame member 394 is then moved in an upward vertical direction 448 until the T-shaped tabs 432 are aligned with the narrow or neck portion of the T-shaped slots 434. A screw 450 is threadably inserted into an aperture (not shown) located in a bottom wall of the longitudinal frame member 394 and threadably received between the arms 440, thereby moving the arms away from one another in a direction 454 until the edges of the slot 436 are engaged within the reliefs 444 of the arms 440, thereby preventing the T-shaped tabs 432 from being removed from within the T-shaped slots 434 and the longitudinal frame member 394 from being disassembled from the vertical frame member 390. It is noted that engagement of the screw 450 (FIG. 66) into the locking member 438 causes the locking member 438 to bend along the length thereof thereby exerting a horizontal force on the longitudinal frame member 394 in the direction 456 and drawing the longitudinal frame member 394 toward the vertical frame member 390, and in an upward direction 457 with respect to the longitudinal frame member 394 and driving the T-shaped tabs 432 into engagement with the T-shaped slots 434.

Figure 67A:
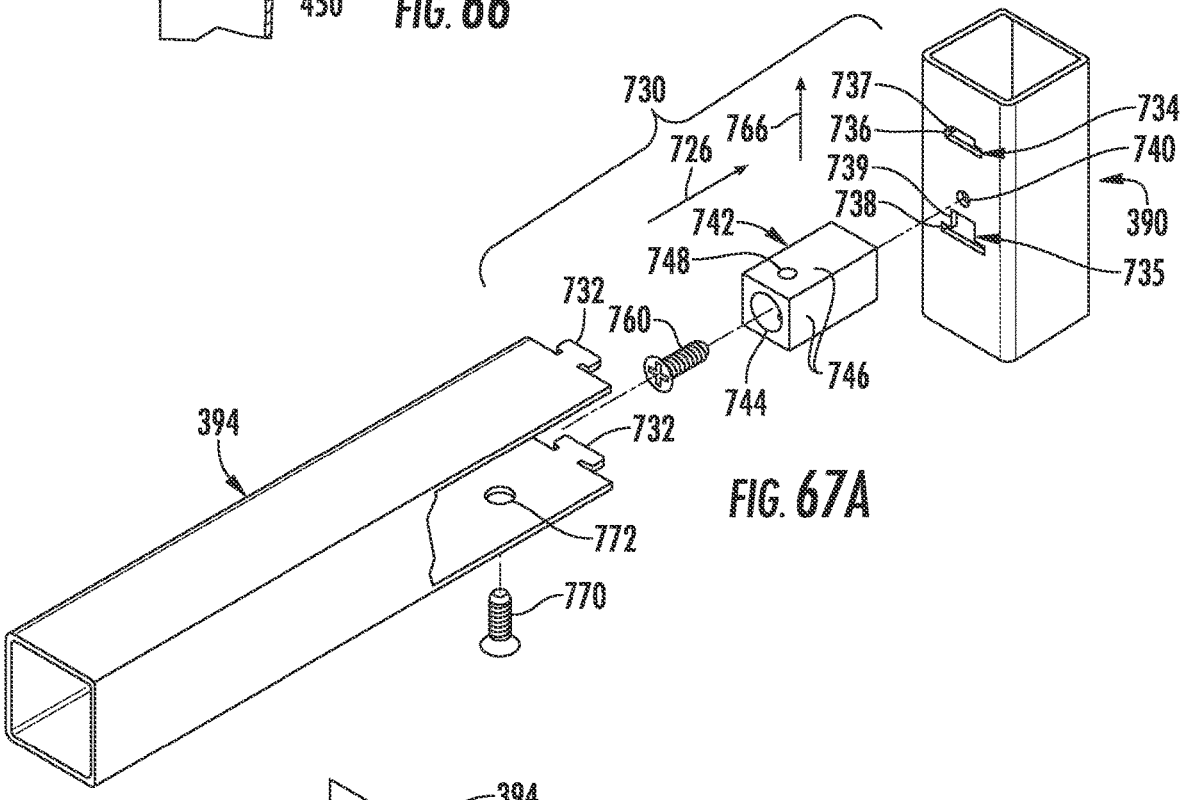
FIG. 67A is an exploded perspective view of another connection arrangement connecting the frame members of the storage assembly.
Figure 67B:
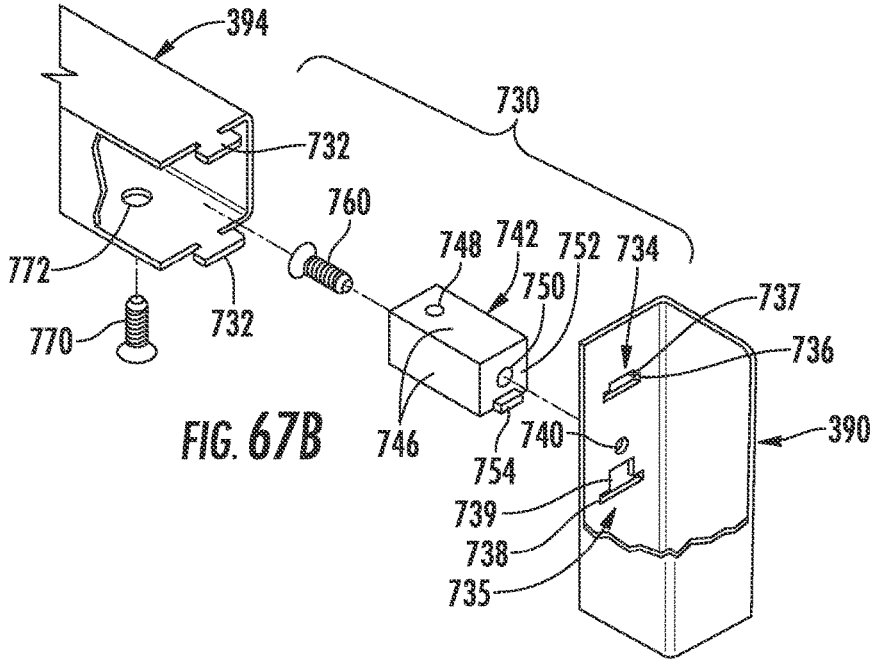
FIG. 67B is a second exploded perspective view of the connection arrangement of FIG. 67A.
Figure 67C:
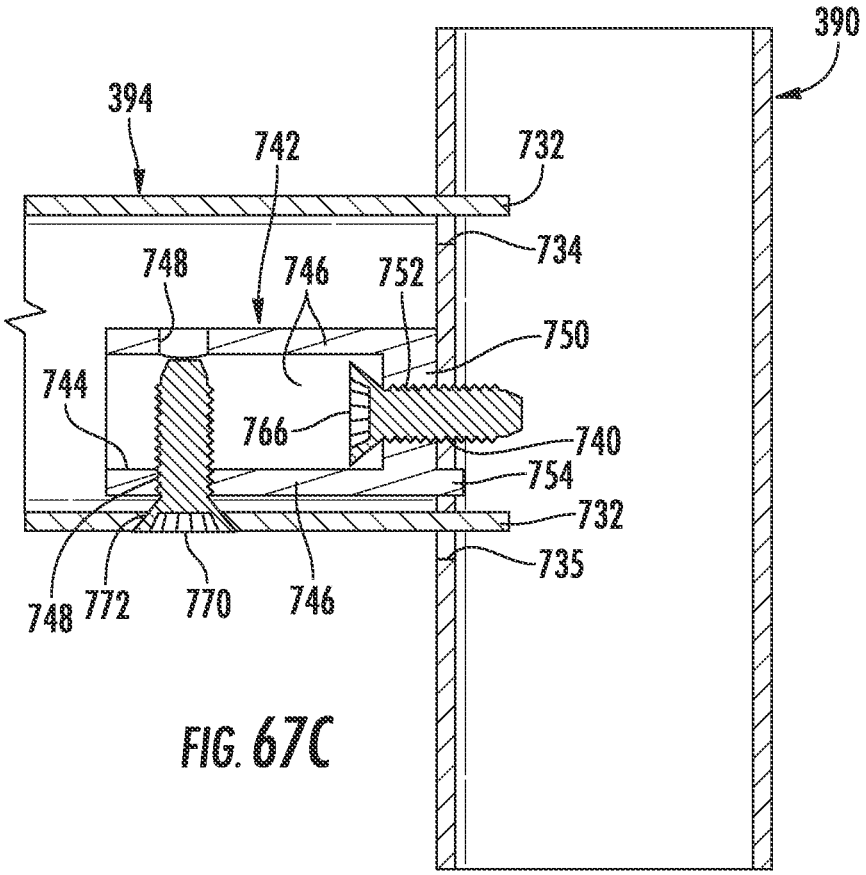
FIG. 67C is a cross-section side elevation view of the connection arrangement of FIG. 67A.

In another example as illustrated in FIGS. 67A and 67B, the lateral frame members 392 and/or the longitudinal frame members 394 may be coupled to the vertical frame members 390 of the frame assembly 388 via a connection arrangement 730. Each connection arrangement 730 may include a pair of horizontally oriented, T-shaped tabs 732 extending from an end of the longitudinal frame member 394. Each vertical frame member 390 includes a corresponding pair of inverted, T-shaped slots including a T-shaped upper slot 734 and a T-shaped lower slot 735, where the upper slot includes a widened lower portion 736 and a narrowed upper portion 737, and the lower slot 735 includes a widened lower portion 738 and a narrowed upper portion 739. The vertical frame member 390 may further include a relief 740 for receiving a mechanical fastener as described below. Each connection arrangement 730 further includes a connector block 742 (FIGS. 67A-67C and 68A) having a longitudinally-extending relief 744 defined by a plurality of sidewalls 746. The connector block 742 further includes an aperture 748 extending through at least one of the sidewalls 746 and an aperture 750 extending through an end wall 752, each configured to receive a mechanical fastener as described below. The connector block 742 may still further include an engagement tab 754 extending outwardly from the end wall 752.

Figure 68A:
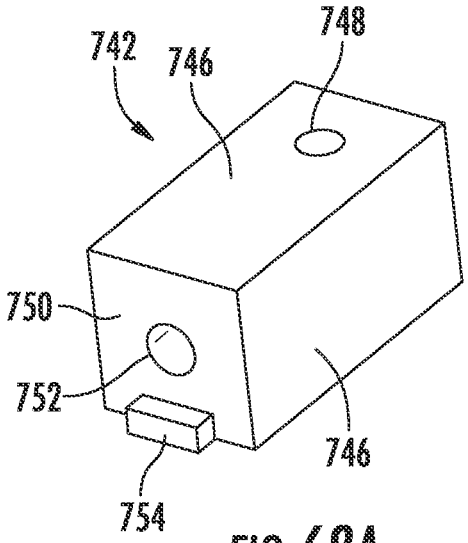
FIG. 68A is a perspective view of a connector block of the connection arrangement of FIG. 67A.
Figure 68B:
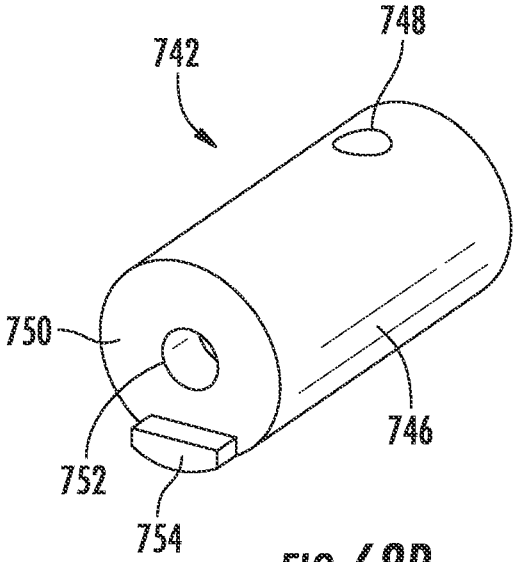
FIG. 68B is a perspective view of another configuration of the connector block.

In the illustrated example, the longitudinal frame member 394 is connected with one of the vertical frame members 390 by aligning and inserting the tab 754 of the connector block 742 into an upper area of the upper portion 739 of the lower slot 735 of the vertical frame member 390. A mechanical fastener such as a screw 760 is inserted through the aperture 752 of the connector block 742 via the relief 744 and threadably inserted into the aperture 740 of the vertical frame member 390. The longitudinal frame member 394 is then placed over the connector block 742 and moved in a direction 762 until the T-shaped tabs 764 are received within the corresponding T-shaped slots 734, 735. The longitudinal frame member 394 is then moved in an upward vertical direction 766 until the T-shaped tabs 732 are aligned with the narrow or neck portion 737, 739 of the slots 734, 735. A mechanical fastener such as a screw 770 is then extended through an aperture 772 of the longitudinal frame member 394 and threadably inserted into the aperture 748 of the connector block 742, thereby securing the longitudinal frame member 394 with the connector block 742 and the vertical frame member 390. As best illustrated in FIGS. 68A and 68B, the connector block 742 may be provided with various cross-sectional configurations depending on the geometry of the associated frame members.

Figure 70:
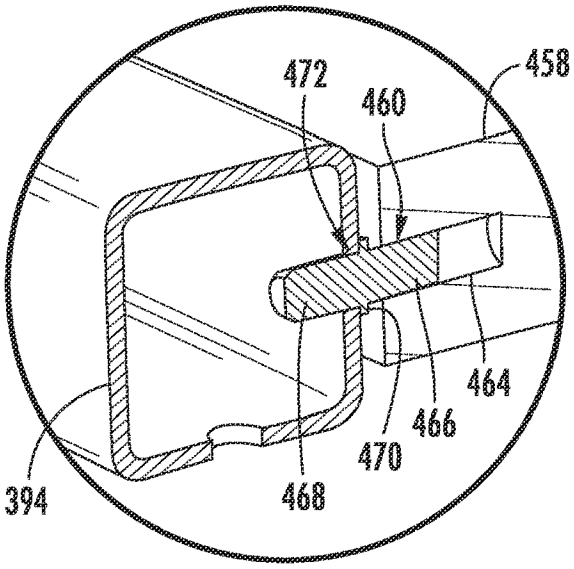
FIG. 70 is an enlarged, cross-sectional view of one of the fastener pins of FIG. 69 captured between one of the frame members and a horizontal panel.
Figure 69:
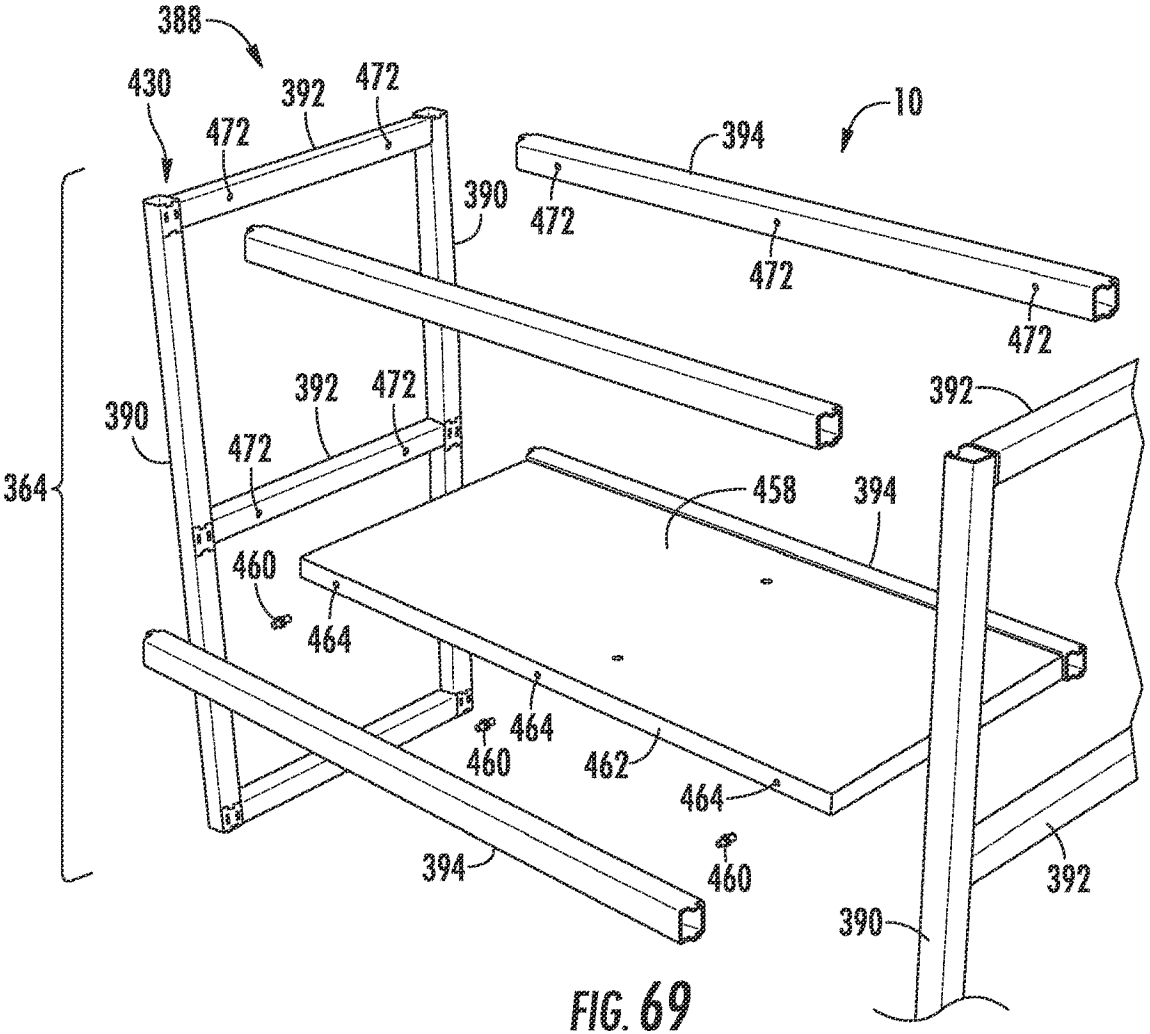
FIG. 69 is an exploded perspective view of the storage assembly including a plurality of captured fastener pins.

The storage assembly 364 (FIG. 69) may also include a plurality of horizontal panel members 458 supported by the lateral frame members 392 and/or the longitudinal frame members 394. In the illustrated example, the panel members 458 may be supported by a plurality of captured fasteners such as pins 460. Each panel member 458 may be provided with a plurality of side edges 462 with a plurality of holes 464 spaced along the length thereof. Each pin 460 (FIG. 70) is provided with a first end 466 and a second end 468 bifurcated from one another by an integral ring 470. In assembly, the first end 466 of each pin 460 is placed within one of the corresponding holes 464 of the panel member 458. The frame members 392, 394 are placed about the side edges 462 of the panel members 458 such that the pins 460 are aligned with and received within corresponding apertures 472 spaced along the frame members 392, 394, such that once the frame assembly 388 is assembled, the pins 460 are captured between the frame members 392, 394 and the panel member 458, thereby supporting the panel member 458 from the frame members 392, 394.

Figure 72A:
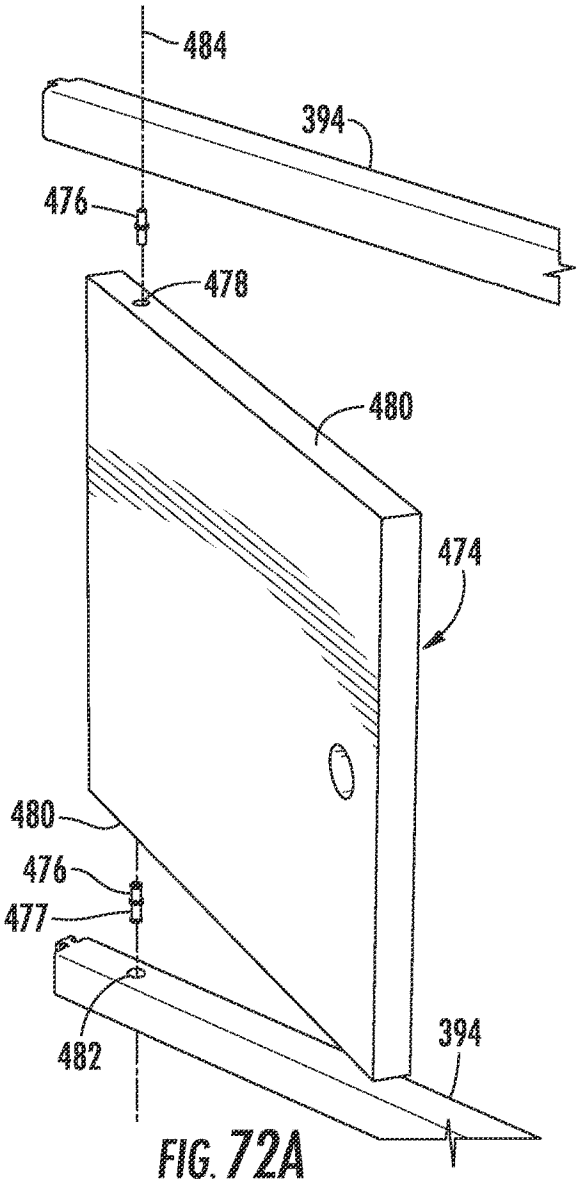
FIG. 72A is an exploded, partial perspective view of the pair of frame members supporting the pivoting door via the captured pivot pins.
Figure 71:
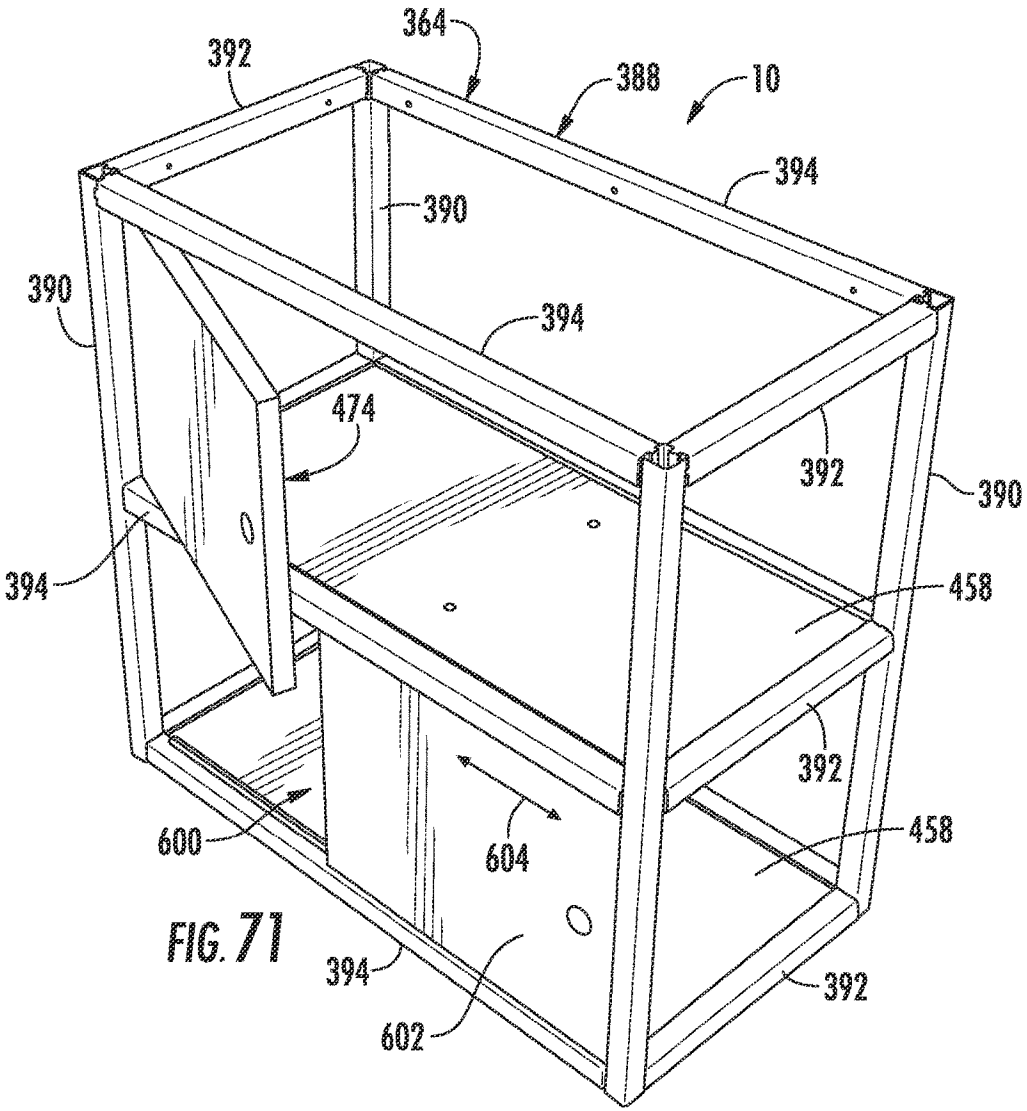
FIG. 71 is a perspective view of the storage assembly includes the frame members supporting a pivoting door member and a sliding door member.

As best illustrated in FIGS. 71 and 72A, a similar fastening arrangement may be utilized to pivotably support a door member 474 from the frame assembly 388. In the illustrated example, a pair of captured fasteners such as pins 476 that are similar in configuration to the pins 460, pivotally support the door 474. Specifically, the pins 476 are received within holes 478 located within top and bottom edges 480 of the door member 474, and corresponding apertures 482 of the longitudinal frame members 394, such that the pins 476 are captured between the longitudinal frame members 394 and the door member 474 and the door pivots about a pivot axis 484. Alternatively, friction rings 477 may be placed about at least one of the pins 476, therefore holding the door 474 in a selected open pivot position.

Figure 72B:
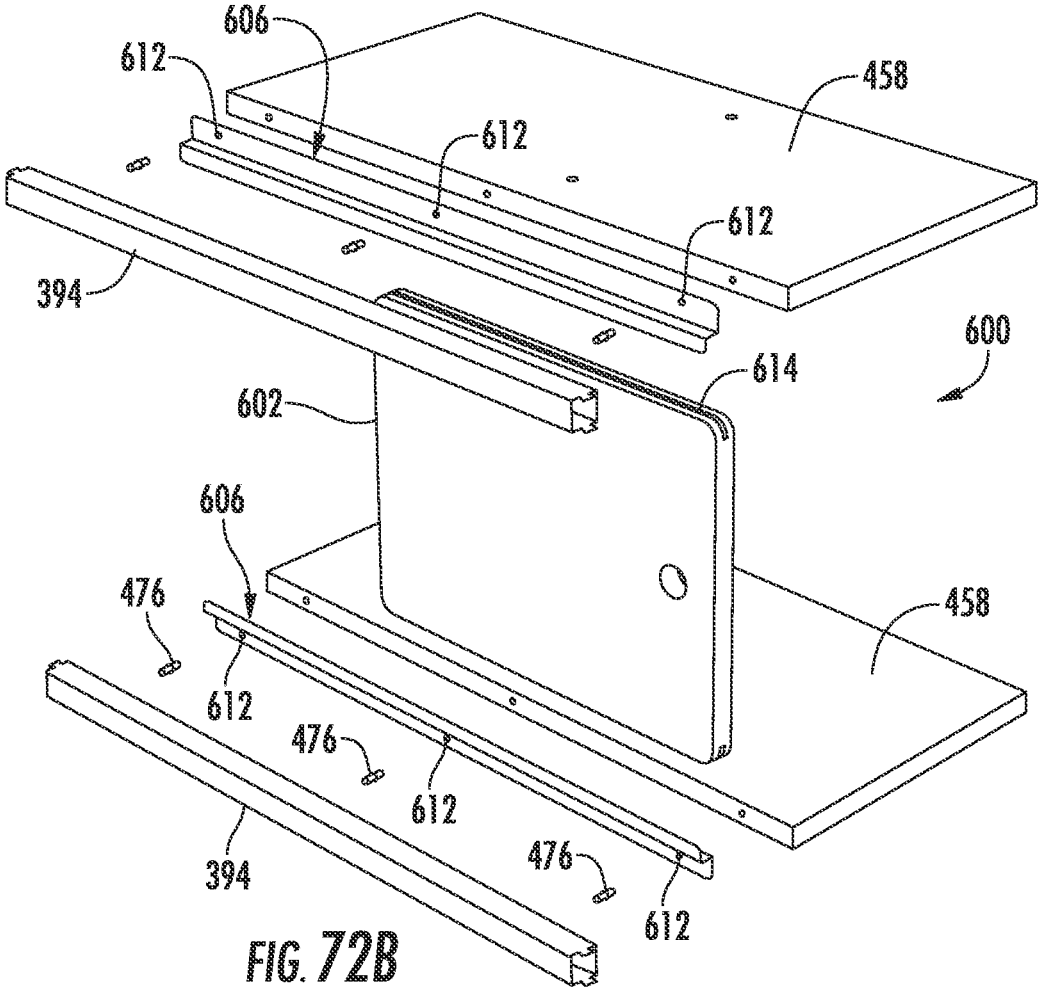
FIG. 72B is an exploded perspective view of the sliding door assembly of the furniture system in the configuration shown in FIG. 71.
Figure 72C:
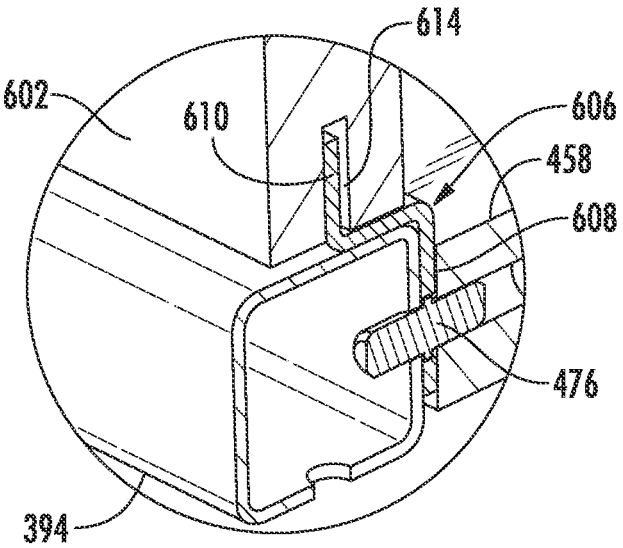
FIG. 72C is an enlarged cross-sectional perspective view of a guide rail member of the sliding door assembly engaging an associated door member.

The storage assembly 364 may include a sliding door assembly 600 that includes a door member 602 slidable with respect to the frame assembly 388 in the directions 604. In the illustrated example, the sliding door assembly 600 further includes guide rail members 606 (FIGS. 72B and 72C) each having a Z-shaped cross-sectional configuration, and including a mounting portion 608 and a guiding portion 610, where the mounting portion 608 includes a plurality of mechanical-fastener receiving apertures 612 spaced therealong. In assembly, the panel member 458 and longitudinal frame members 394 are assembled in a similar manner to that previously described with the pins 476 secured therebetween. The mounting portion 608 of the guide rail member 606 may be positioned between the longitudinal frame member 394 and the panel member 458 with the pins 476 extending through the apertures 612 of the mounting portion 608. The guiding portions 610 are slidably received within corresponding top and bottom slots 614 of the door member 602, thereby slidably supporting the door member 602 within the frame assembly 388.

Figure 75:
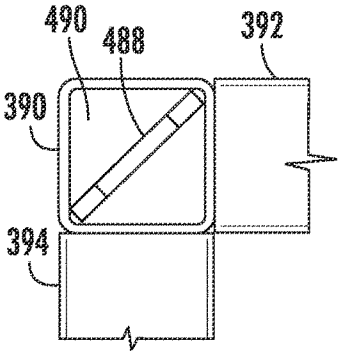
FIG. 75 is a bottom elevational view of the area LXXV, FIG. 74.
Figure 76:
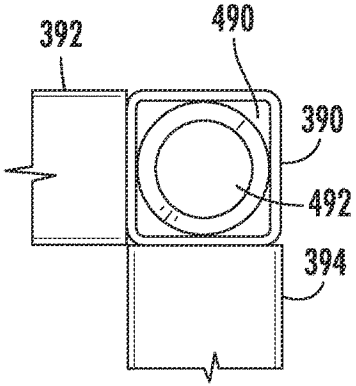
FIG. 76 is a bottom elevational view of the area LXXVI, FIG. 74.
Figure 74:
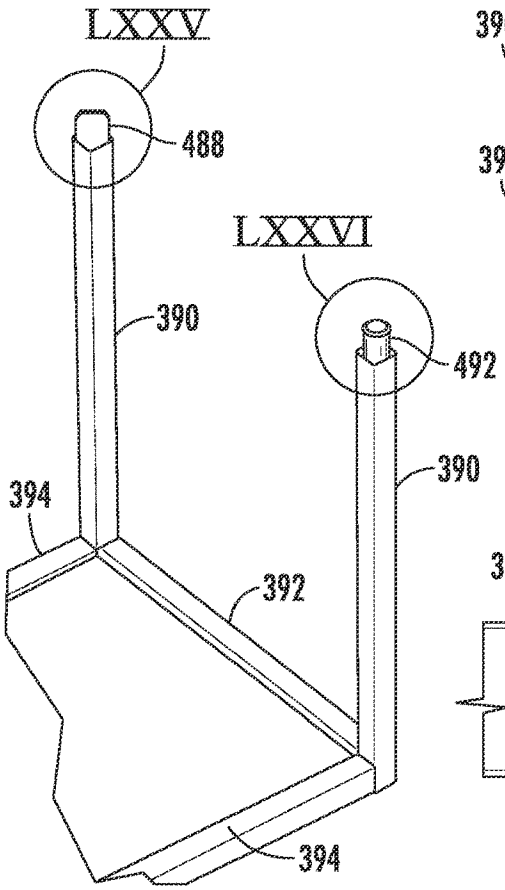
FIG. 74 is a perspective view of two different embodiments of frame connection arrangements of the storage assembly in the configuration as shown in FIG. 73.
Figure 73:
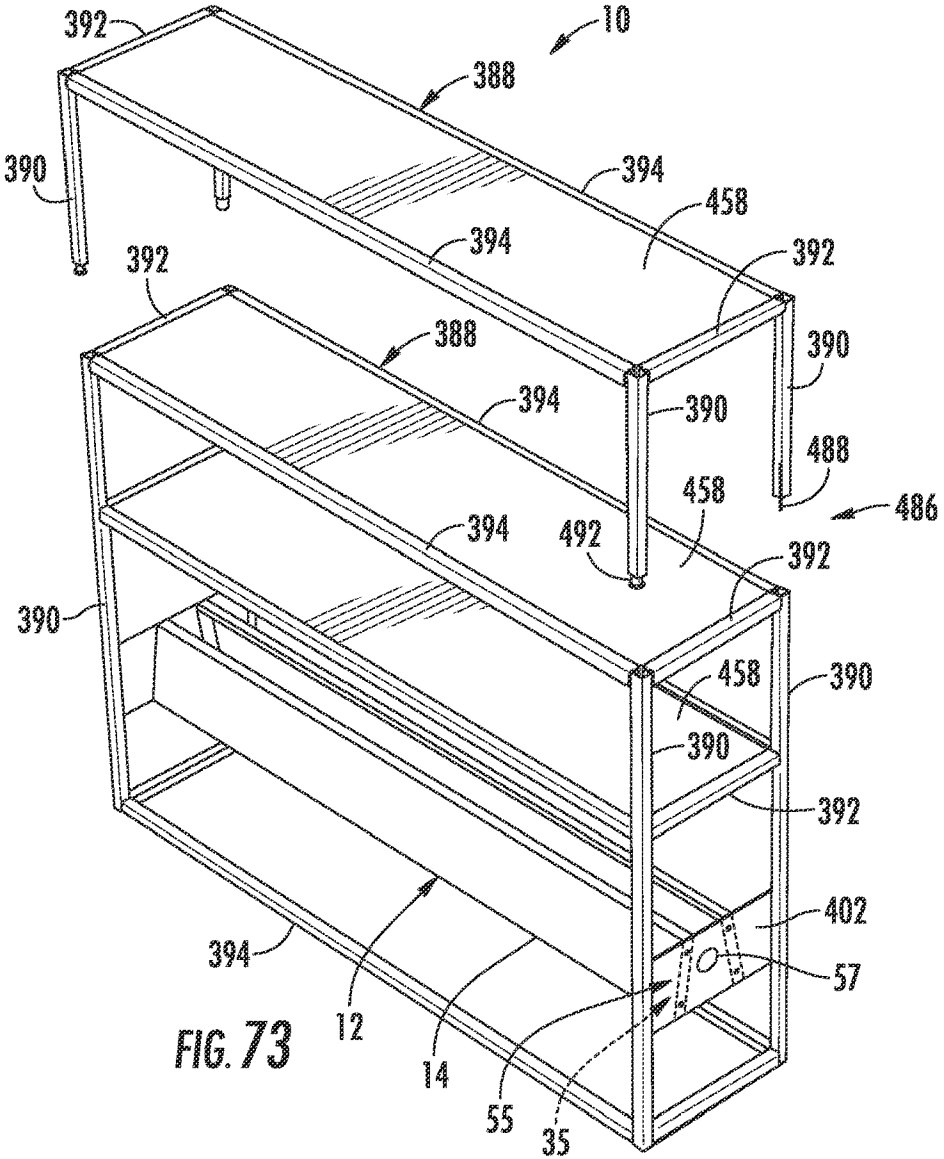
FIG. 73 is an exploded perspective view of the storage assembly including a plurality of stacked frame assemblies.

The frame assembly 388 (FIG. 73) of the furniture system 10 may further include a stackable frame arrangement 486. In the illustrated example, a first embodiment of the stackable frame arrangement 486 includes a planar connector 488 (FIGS. 74 and 75) that is located within a hollow interior 490 of the vertical frame member 390 such that the connector 488 spans between vertically adjacent vertical frame members 390 thereby connecting the same to one another. In the illustrated example, the vertical frame member 390 is provided with a square cross-sectional configuration and the planar connector 488 spans between opposite corners of the vertical frame member 390, however, other configurations may also be utilized. In a second embodiment, a circular-shaped connector 492 (FIGS. 74 and 76) is positioned within the hollow interior of the vertical frame member 390 such that the connector 492 spans between a pair of vertically adjacent vertical frame members 390 thereby coupling the vertical frame members 390 to one another.

Figures 77, 78, 79, 80, 81, 82:
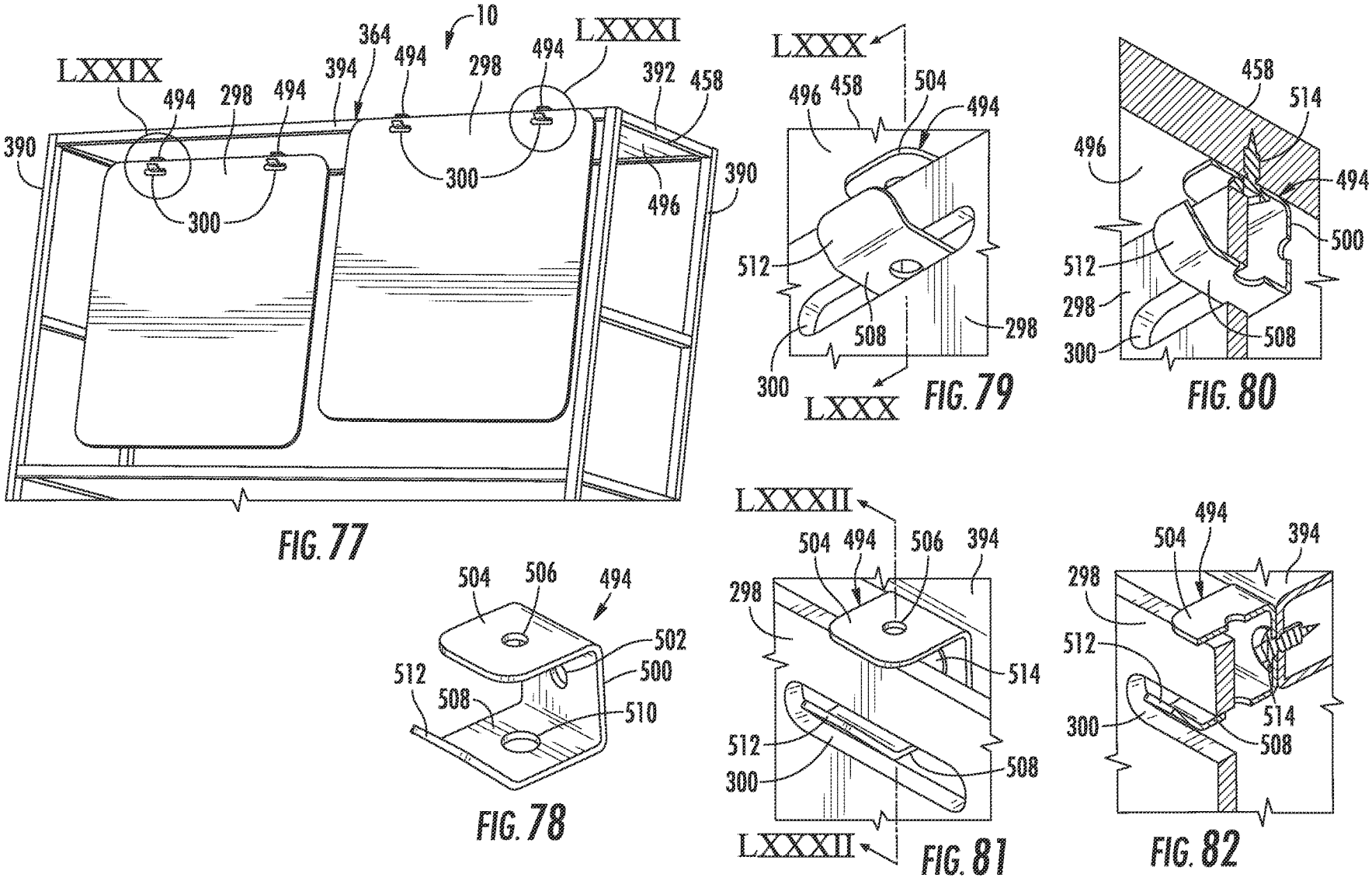
FIG. 77 is a perspective view of the furniture system that includes a pair of privacy panel assemblies supported by a storage assembly.
FIG. 78 is a perspective view of a universal mounting bracket.
FIG. 79 is an enlarged perspective view of the area LXXIX, FIG. 77.
FIG. 80 is a cross-sectional view taken along the line LXXX-LXXX, FIG. 79.
FIG. 81 is an enlarged perspective view of the area LXXXI, FIG. 77.
FIG. 82 is a cross-sectional perspective view taken along the line LXXXII-LXXXII, FIG. 81.

The furniture system 10 (FIG. 77), which may or may not support a beam member 14 therein, includes a universal support bracket 494 (FIGS. 77 and 78) configured to support the screen member 298 from the bottom surface 496 of a panel member 458 and the longitudinal frame member 394 of the storage assembly 364. As best illustrated in FIG. 78, the support bracket 494 includes a vertical portion 500 having an aperture 502 extending therethrough and adapted to receive a mechanical fastener therein, a top horizontal portion 504 extending from the vertical portion 500 and including an aperture 506 configured to receive a mechanical fastener therethrough, a bottom horizontal portion 508 extending from the vertical portion 500 and including a tool-receiving aperture 510 extending therethrough, and a lip 512 extending angularly upward from the bottom horizontal portion 508. In a first configuration, as best illustrated in FIGS. 79 and 80, the top horizontal portion 504 is placed against the bottom surface 496 of the panel member 458 and a mechanical fastener such as a screw 514 is inserted into the aperture 506 of the top horizontal portion 504 and received into the panel member 458, thereby securing the support bracket 494 to the bottom surface 496 of the panel member 458. It is noted that the tool receiving aperture 510 allows the installer to access the screw 514 with the appropriate tool through the bottom horizontal portion 508. In a second configuration, as best illustrated in FIGS. 81 and 82, the support bracket 494 is secured to the frame member 394 via a screw 514 that is received through the aperture 502 of the vertical portion 500 and into the frame member 394. The lip 512 and bottom horizontal portion 508 of each of the support brackets 494 are received within the corresponding slots 300 of the screen members 298, thereby supporting the screen members 298 from the support brackets 494.

Figure 84:
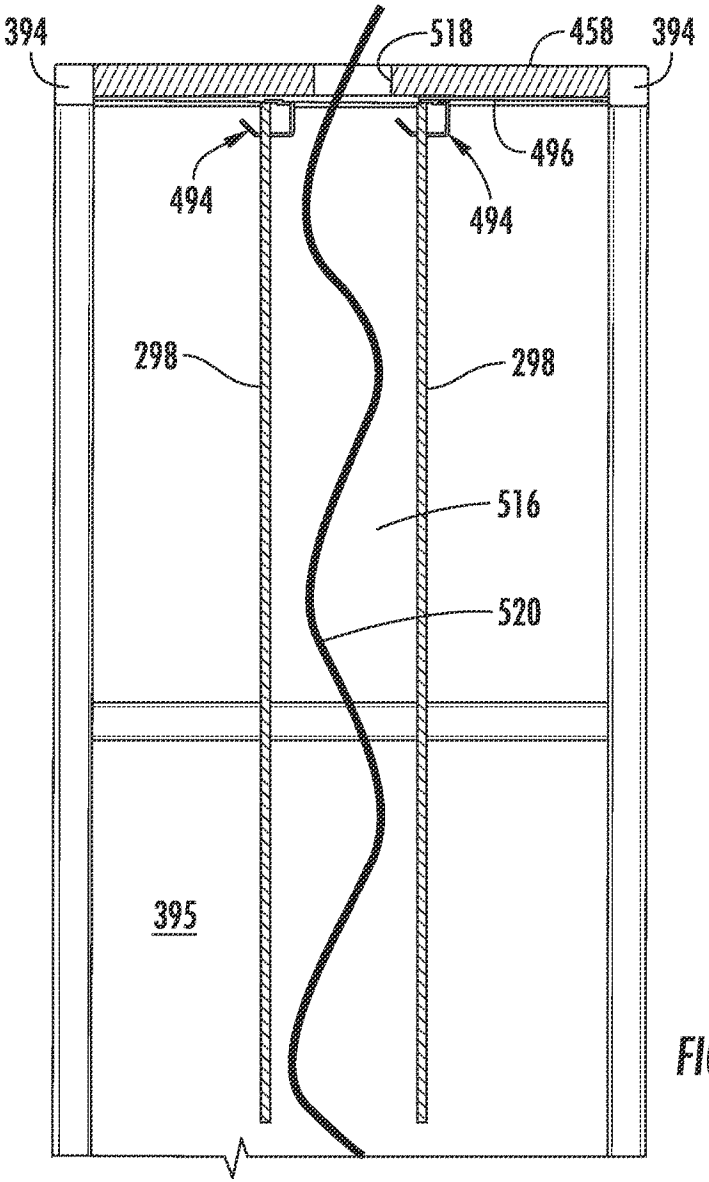
FIG. 84 is an end cross-sectional view of the furniture system in the configuration as shown in FIG. 83 taken along the line LXXXIV-LXXXIV, FIG. 83.
Figure 83:
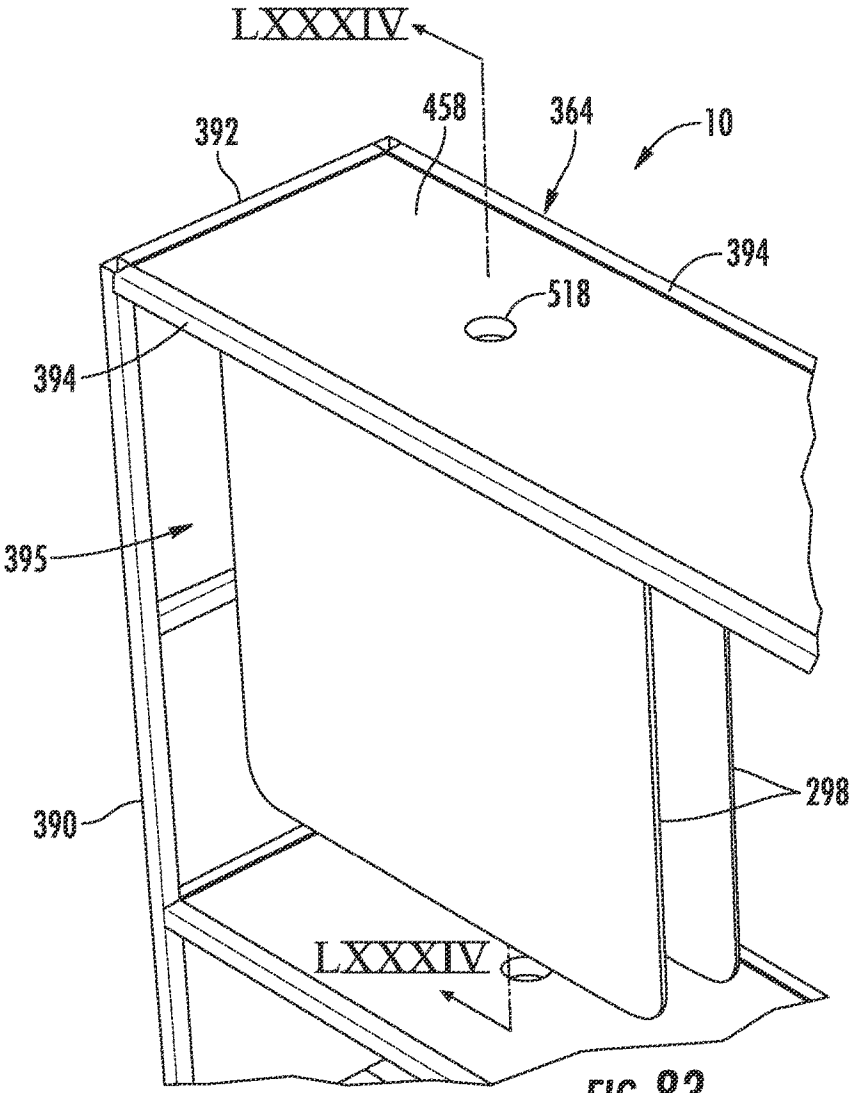
FIG. 83 is a perspective view of the furniture system including a pair of the partition assemblies supported within an interior space of the storage assembly.

In one configuration, a pair of the screen members 298 (FIGS. 83 and 84) are supported within an interior storage space 395 of the storage assembly 364 so as to define a wire-routing gap 516 therebetween. Specifically, the furniture assembly 10 may include a plurality of the support brackets 494 secured to the bottom surface 496 of a panel member 458 and supporting the screen members 298 therefrom. In the illustrated example, the screen members 298 are positioned such that the screen members 298 at least partially overlap with one another so as to create the wire routing gap 516 therebetween where the gap 516 is at least partially located within the interior storage space 395. The panel member 458 may be provided with an aperture 518 configured to allow the routing of wires 520 from a position located above the panel member 458 and into the gap 516.

Figure 85:
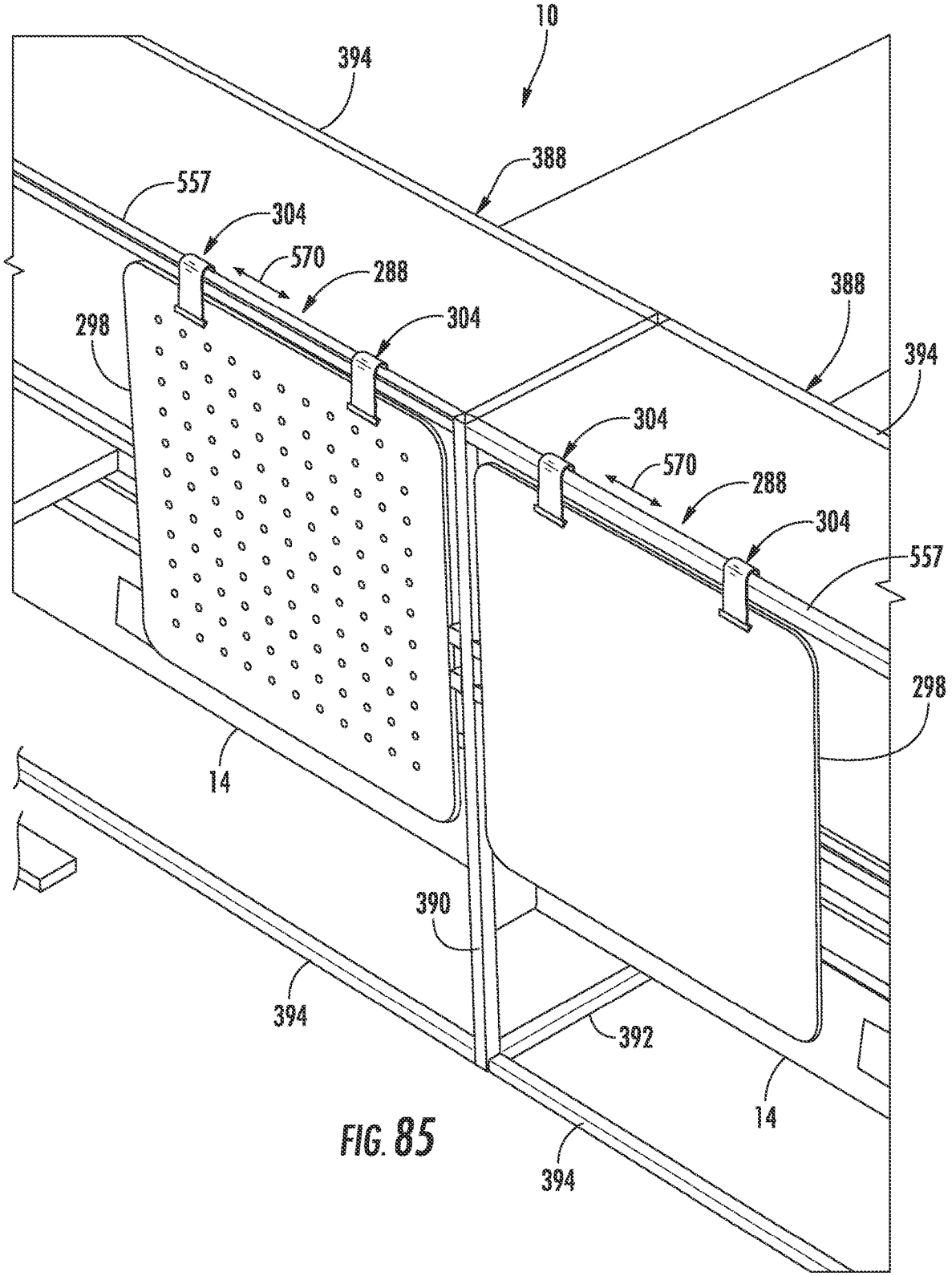
FIG. 85 is a perspective view of the furniture assembly that includes a pair of privacy screens slidably supported on a pair of storage arrangements.

As best illustrated in FIG. 85, the frame assembly 388 may also include the vertical frame members 390, the horizontally-extending lateral frame members 392, the horizontally-extending longitudinal frame members 394, and horizontally-extending rail members 557 configured to support hanging screen assemblies 288 therefrom. In the illustrated example, the rail members 557 are configured to slidably support the brackets 304 on an exterior of the frame assembly 388, such that the screen assemblies 288 may be slidably repositioned along the length of the rail members 557 in the directions 570.

In the foregoing description, it will be readily appreciated by those skilled in the art that modifications may be made to the described embodiments without departing from the concepts disclosed herein. Such modifications are to be considered as included in the following claims, unless these claims by their language expressly state otherwise. While certain claims may depend from a certain claim or certain number of claims, each claim as presented herein may alternatively be combined with any other claims or claims. Components, parts, elements, assemblies, sub-assemblies and arrangements of any particular embodiment or configuration of the furniture assemblies may be combined with the components, parts, elements, assemblies, sub-assemblies and arrangements of another embodiment, embodiments or configurations of the furniture assemblies disclosed herein.

The invention claimed is:

1. A furniture system, comprising:

a plurality of vertical and horizontal frame members adapted to interconnect and form a furniture element; and a connection assembly configured to couple at least one horizontal frame member of the plurality of horizontal frame members to at least one vertical frame member of the plurality of vertical frame members, the connection assembly comprising:

at least one T-shaped slot located within the at least one vertical frame member;

at least one T-shaped tab extending from an end of the at least one horizontal frame member and configured to engage the at least one T-shaped slot;

at least one locking slot located within the at least one vertical frame member;

a locking member configured to engage the locking slot; and a fastener configured such that when the fastener is secured to the locking member the T-shaped tab is driven into engagement with the T-shaped slot and the at least one horizontal frame member is pulled toward the at least one vertical member so as to connect the at least one horizontal frame member to the at least one vertical frame member, wherein the fastener is configured such that when the fastener is secured to the locking member the at least one horizontal frame member is pulled upward with respect to the at least one vertical member.

2. The furniture system of claim 1, wherein the at least one T-shaped slot and the locking slot are separate from one another.

3. The furniture system of claim 1, wherein the locking member has a circular cross-sectional configuration.

4. The furniture system of claim 1, wherein the at least one T-shaped slot is one of a pair of T-shaped slots, and wherein the T-shaped tab is one of a pair of T-shaped tabs.

5. The furniture system of claim 1, wherein the fastener engages the horizontal frame member.

6. The furniture system of claim 1, wherein the fastener is threaded and threadably engages the locking member.

7. The furniture system of claim 1, wherein at least one T-shaped slot includes a first portion having a first width and a second portion having a second width that is greater than the first width, and wherein the first portion is located above the second portion.

8. The furniture system of claim 1, wherein the connection assembly is one of a pair of connection assemblies offset from one another about the at least one vertical frame member.

9. The furniture system of claim 8, wherein the first and second connection assemblies as offset about the at least one vertical frame member by about 90°.

10. The furniture system of claim 1, wherein the furniture element comprises a storage assembly that includes an interior storage space.

11. A furniture system, comprising:

a plurality of vertical frame members;

a plurality of horizontal frame members extending between the vertical frame members; and a connection arrangement connecting at least one of the horizontal frame members of the plurality of horizontal frame members to at least one of the vertical frame members of the plurality of vertical frame members, the connection arrangement comprising:

a receiving slot and a locking slot located in the at least one vertical frame member, the receiving slot including a first portion having a first width and a second portion having a second width that is less than the first width;

a tab extending from the at least one horizontal frame member, the tab having a first portion having a first width and a second portion having a second width that is less than the first width of the first portion of the tab;

a locking member received within the at least one horizontal frame member and having an engagement portion configured to be received within the locking slot, the locking member movable between a locked position where the engagement portion is located a first distance from the tab, and an unlocked position where the engagement portion is located a second distance from the tab that is less than the first distance; and an actuator engagable with the horizontal frame member and the locking member;

wherein the tab is configured to be positioned within the receiving slot such that the second portion of the tab is vertically aligned with the second portion of the locking slot, thereby preventing disengagement of the tab from within the receiving slot in a horizontal direction, and wherein the actuator engages the horizontal frame member and the locking member, thereby moving the locking member from the unlocked position to the locked position and preventing the locking member from moving in a horizontal direction with respect to the horizontal frame member.

12. The furniture system of claim 11, wherein the receiving slot is T-shaped.

13. The furniture system of claim 11, wherein the receiving slot is one of a pair of receiving slots, and wherein the tab is one of a pair of tabs.

14. The furniture system of claim 11, wherein the receiving slot and the locking slot are separate from one another.

15. The furniture system of claim 11, wherein the first portion of the receiving slot is located below the second portion of the receiving slot.

16. The furniture system of claim 11, wherein the actuator threadably engages at least one of the at least one horizontal frame member and the locking member.

17. The furniture system of claim 16, wherein the actuator threadably engages the at least one horizontal frame member and the locking member.

18. The furniture system of claim 11, wherein the locking member has a circular cross-sectional configuration.

19. The furniture system of claim 11, wherein the connection assembly is one of a pair of connection assemblies offset from one another about the at least one vertical frame member.

20. The furniture system of claim 19, wherein the first and second connection assemblies as offset about the at least one vertical frame member by about 180°.

21. The furniture system of claim 11, wherein the furniture element comprises a storage assembly that includes an interior storage space.

22. A furniture system, comprising:

a plurality of vertical and horizontal frame members adapted to interconnect and form a furniture element; and a connection assembly configured to couple at least one horizontal frame member of the plurality of horizontal frame members to at least one vertical frame member of the plurality of vertical frame members, the connection assembly comprising:

a first aperture located within the at least one vertical frame member, wherein the first aperture is T-shaped;

a T-shaped tab extending from the at least one horizontal frame member and configured to engage the first aperture;

a locking member configured to engage the at least one vertical frame member; and a fastener configured such that when the fastener is secured to the locking member the locking member engages the at least one vertical frame member and the T-shaped tab is driven into engagement with the first aperture and the at least one horizontal frame member is moved vertically with respect to the vertical frame member and is pulled toward the at least one vertical member so as to connect the at least one horizontal frame member to the at least one vertical frame member.

23. The furniture system of claim 22, wherein the locking member engages a second aperture located within the at least one vertical frame member.

24. The furniture system of claim 23, wherein the first and second apertures are vertically offset from one another.

25. The furniture system of claim 22, wherein the connection assembly is one of a pair of connection assemblies offset from one another about the at least one vertical frame member.

26. The furniture system of claim 25, wherein the first and second connection assemblies as offset about the at least one vertical frame member by about 90° or about 180°.

27. The furniture system of claim 22, wherein the furniture element comprises a storage assembly that includes an interior storage space.

* * * * *